US012405046B2

(12) United States Patent
Hong et al.

(10) Patent No.: US 12,405,046 B2
(45) **Date of Patent: *Sep. 2, 2025**

(54) ICE MAKER AND REFRIGERATOR

(71) Applicant: LG Electronics Inc., Seoul (KR)

(72) Inventors: Jinil Hong, Seoul (KR); Yonghyun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 18/412,176

(22) Filed: Jan. 12, 2024

(65) Prior Publication Data

US 2024/0151450 A1 May 9, 2024

Related U.S. Application Data

(63) Continuation of application No. 16/511,871, filed on Jul. 15, 2019, now Pat. No. 11,874,045.

(30) Foreign Application Priority Data

Nov. 16, 2018 (KR) ..... 10-2018-0142079

(51) Int. Cl.
*F25C 1/243* (2018.01)
*F25C 1/045* (2018.01)

(52) U.S. Cl.
CPC ..... *F25C 1/243* (2013.01); *F25C 1/045* (2013.01)

(58) Field of Classification Search
CPC ..... F25C 1/243; F25C 1/045
See application file for complete search history.

(56) References Cited

U.S. PATENT DOCUMENTS 2,389,317 A 11/1945 Kitto
9,581,372 B2 2/2017 Lee et al.
11,874,045 B2 1/2024 Hong et al.
(Continued)

FOREIGN PATENT DOCUMENTS

CN 1472496 2/2004
CN 101529173 A 9/2009
(Continued)

OTHER PUBLICATIONS

Extended European Search Report in European Application No. 19209336.7, dated Mar. 27, 2020, 7 pages.
(Continued)

*Primary Examiner* — Emmanuel S Luk
(74) *Attorney, Agent, or Firm* — Fish & Richardson P.C.

(57) ABSTRACT

An ice maker includes an upper assembly having an upper tray that defines upper portions of a plurality of ice making chambers. The ice maker also includes a lower assembly that is located vertically below the upper assembly and configured rotate relative to the upper assembly. The lower assembly includes a lower tray that defines lower portions of the plurality of ice making chambers, and a lower support that is configured to receive the lower tray and restrict an outward expansion of the lower portions of the plurality of ice making chambers. The lower tray includes a lower tray body configured to hold a first volume of water, and a circumferential wall that extends upward from the lower tray body and is configured to hold a second volume of water above the first volume of water.

20 Claims, 38 Drawing Sheets

(56) References Cited

U.S. PATENT DOCUMENTS

| | | | | |
|---|---|---|---|---|
| 12,013,167 | B2 * | 6/2024 | Lee | F25C 1/10 |
| 12,072,132 | B2 * | 8/2024 | Hong | F25C 1/18 |
| 12,163,715 | B2 * | 12/2024 | Kim | F25C 5/22 |
| 12,173,947 | B2 * | 12/2024 | Kim | F25C 1/243 |
| 12,222,148 | B2 * | 2/2025 | Kim | F25C 1/24 |
| 2009/0026349 | A1 | 1/2009 | Shoukyuu et al. | |
| 2009/0277191 | A1 | 11/2009 | Heger et al. | |
| 2010/0192614 | A1 | 8/2010 | Kim et al. | |
| 2011/0314860 | A1 | 12/2011 | Tafoya et al. | |
| 2013/0014535 | A1 | 1/2013 | Son et al. | |
| 2013/0014536 | A1 | 1/2013 | Son et al. | |
| 2013/0081412 | A1 | 4/2013 | Son et al. | |
| 2013/0327074 | A1 | 12/2013 | Lee et al. | |
| 2013/0327082 | A1 | 12/2013 | Son et al. | |
| 2014/0130537 | A1 | 5/2014 | Gu et al. | |
| 2014/0165598 | A1 | 6/2014 | Boarman et al. | |
| 2014/0182325 | A1 | 7/2014 | Lee et al. | |
| 2015/0021458 | A1 | 1/2015 | Zorovich et al. | |
| 2015/0316306 | A1 | 11/2015 | Ji et al. | |
| 2017/0138655 | A1 | 5/2017 | Cronin et al. | |
| 2020/0158403 | A1 | 5/2020 | Hong et al. | |
| 2020/0158406 | A1 * | 5/2020 | Kim | F25C 1/04 |
| 2020/0300527 | A1 * | 9/2020 | Kim | F25C 1/04 |
| 2021/0372686 | A1 * | 12/2021 | Lee | F25C 1/10 |
| 2021/0404726 | A1 * | 12/2021 | Kim | F25D 29/00 |
| 2024/0295354 | A1 * | 9/2024 | Lee | F25C 1/25 |

FOREIGN PATENT DOCUMENTS

| | | | |
|---|---|---|---|
| CN | 101922843 | | 12/2010 |
| CN | 102803874 | | 11/2012 |
| CN | 102878743 | | 1/2013 |
| CN | 102878744 | | 1/2013 |
| CN | 102933925 | A | 2/2013 |
| CN | 103486811 | | 1/2014 |
| CN | 103486812 | | 1/2014 |
| CN | 103542662 | | 1/2014 |
| CN | 104956166 | A | 9/2015 |
| DE | 29820139 | | 3/2000 |
| EP | 2549207 | | 1/2013 |
| EP | 2730865 | | 5/2014 |
| EP | 3862675 | | 8/2021 |
| JP | 2005016873 | A | 1/2005 |
| JP | 2005090801 | | 4/2005 |
| JP | 2005-326035 | A | 11/2005 |
| JP | 2007232336 | A | 9/2007 |
| JP | 2013204882 | | 10/2013 |
| JP | 3201285 | U | 12/2015 |
| JP | 2017-053617 | A | 3/2017 |
| KR | 10-2003-0040437 | A | 5/2003 |
| KR | 20-0371852 | Y1 | 1/2005 |
| KR | 10-2013-0009332 | A | 1/2013 |
| KR | 10-2013-0009521 | | 1/2013 |
| KR | 20140074795 | | 6/2014 |
| KR | 10-2014-0088321 | A | 7/2014 |
| KR | 10-2016-0026012 | A | 3/2016 |
| KR | 20160150394 | | 12/2016 |
| KR | 10-1850918 | | 5/2018 |
| KR | 10-1890939 | | 8/2018 |
| KR | 10-2020-0038118 | | 4/2020 |
| KR | 10-2020-0057558 | | 5/2020 |

OTHER PUBLICATIONS

Notice of Allowance in Chinese Appln. No. 202210705845.5, mailed on Oct. 7, 2023, 7 pages (with English translation).
Office Action in Chinese Appln. No. 201911126681.5, dated Mar. 17, 2021, 15 pages (with English translation).
Office Action in Chinese Appln. No. 202210705818.8, mailed on Apr. 29, 2023, 20 pages (with English translation).
Office Action in Chinese Appln. No. 202210705818.8, mailed on Sep. 28, 2023, 7 pages (with English translation).
Office Action in Chinese Appln. No. 202210705843.6, mailed on Mar. 25, 2023, 21 pages (with English translation).
Office Action in European Appln. No. 19209336.7, mailed on Jun. 26, 2023, 5 pages.
Office Action in Korean Appln. No. 10-2023-0003078, dated Feb. 10, 2023, 9 pages (with English translation).
Office Action in Korean Appln. No. 20230003078, mailed on Jun. 15, 2023, 10 pages (with English translation).
Search Report for Request for Accelerated Examination in Korean Appln. No. 10-2023-0003078, dated Jan. 25, 2023, 12 pages.
Office Action in Korean Appln. No. 10-2019-0087558, mailed on Jul. 5, 2024, 12 pages (with English Translation).
Office Action in Korean Appln. No. 10-2023-0003075, mailed on Jul. 20, 2024, 13 pages (with English translation).
Office Action in Korean Appln. No. 10-2023-0003076, mailed on Jul. 24, 2024, 11 pages (with English translation).
Office Action in Korean Appln. No. 10-2023-0003077, mailed on Jul. 24, 2024, 16 pages (with English translation).
Office Action in Korean Appln. No. 10-2023-0003075, mailed on Apr. 1, 2025, 10 pages.
Office Action in Korean Appln. No. 10-2023-0003076, mailed on Mar. 7, 2025, 10 pages.
Office Action in Korean Appln. No. 10-2019-0087558, mailed on Jul. 7, 2025, 7 pages.

* cited by examiner

ICE MAKER AND REFRIGERATOR

CROSS-REFERENCE TO RELATED APPLICATIONS

This application is a continuation of U.S. application Ser. No. 16/511,871, filed on Jul. 15, 2019, which claims the benefit of the Korean Patent Application No. 10-2018-0142079 filed on Nov. 16, 2018, which are hereby incorporated by reference as if fully set forth herein.

TECHNICAL FIELD

The present disclosure relates to an ice maker and a refrigerator.

BACKGROUND

Generally, refrigerators are appliances that can be used to cool and store food items. A storage space inside the refrigerator may be cooled using cool air, and the food items may be stored in a refrigerated or a frozen state.

In some cases, an ice maker may be provided in the refrigerator. For example, water can be supplied automatically from a water supply source to an ice tray to form ice pieces. In some cases, the formed ice pieces may be removed by heating the tray or by physically removing the ice pieces. Ice pieces formed in this manner typically have crescent or cubic shapes. In some cases, spherical ice may be made by the use of appropriately designed ice trays.

During the ice making process, air bubbles can become trapped inside the ice, thus leading to a cloudy, opaque appearance. Allowing the air bubbles to escape during the ice making process, on the other hand, can help lead to the formation of clear, transparent ice pieces.

SUMMARY

According to one aspect of the subject matter described in this application, an ice maker includes: an upper assembly including an upper tray that defines upper portions of a plurality of ice making chambers and that defines a water receiving hole configured to receive water to the plurality of ice making chambers; and a lower assembly located vertically below the upper assembly and configured rotate relative to the upper assembly. The lower assembly includes: a lower tray that is made of a flexible material, that is configured to contact the water received through the water receiving hole, and that defines lower portions of the plurality of ice making chambers; and a lower support that is configured to receive the lower tray and that is configured to restrict an outward expansion of the lower portions of the plurality of ice making chambers. Each of the plurality of ice making chambers is configured to: based on rotation of the lower assembly to a first position relative to the upper assembly, receive water through the water receiving hole; and based on joining of the upper portions and the lower portions of the plurality of ice making chambers at a second position different from the first position, generate an ice piece within an ice making chamber among the plurality of ice making chambers. The lower tray includes: a lower tray body that defines the lower portions of the plurality of ice making chambers, the lower portions of the plurality of ice making chambers being configured to hold a first volume of water; and a circumferential wall that extends upward from the lower tray body, that is configured to, based on the lower assembly being at the first position, come in contact with and hold a second volume of water above the first volume of water, and that is configured to, based on the lower assembly being at the second position, vertically overlap at least a portion of the upper tray. The plurality of ice making chambers are configured to, based on joining of the upper portions and the lower portions of the plurality of ice making chambers at the second position, be filled with water from the first and second volumes of water.

Implementations according to this aspect may include one or more of the following features. For example, the circumferential wall may include an vertical portion that extends vertically from an upper surface of the lower tray body and a curved portion that extends laterally toward a rotation axis of rotation of the lower assembly relative to the upper assembly. In some cases, a horizontal distance from a center of the ice making chamber to an outer end of the curved portion may be greater than a horizontal distance from the center of the ice making chamber to an outer end of the vertical portion. In some cases, the lower tray may also include an horizontal extension part that extends horizontally outward from an interface between the lower tray body and the circumferential wall. Also, a distance between an upper end of the vertical portion and the horizontal extension part may be greater than or equal to a distance between an upper end of the curved portion and the horizontal extension part.

In some implementation, the upper tray may include a horizontal extension part and an upper tray body that extends downward from the horizontal extension part and that defines an inner surface of the upper portions of the plurality of ice making chambers, the inner surface having a hemispherical shape. In some cases, the upper tray body may include a vertical wall that defines a first portion of an outer surface of the upper tray body, the first portion extending in a vertical direction from the horizontal extension part and a curved wall that defines a second portion of the outer surface of the upper tray body, the second portion having a curved shape extending toward the rotation axis. The vertical portion of the lower tray body may be configured to, based on the lower assembly being at the first position, hold at least a portion of the second volume of water in a space between the vertical wall of the upper tray body and the vertical portion of the lower tray body, and the curved portion mat be configured to, based on the lower assembly being at the first position and the second position, vertically overlap at least a portion of the curved wall of the upper tray body.

In some implementations, the plurality of ice making chambers may include a first ice making chamber and a second ice making chamber that are arranged in a direction parallel to a rotation axis of rotation of the lower assembly relative to the upper assembly. At least a portion of the circumferential wall may extend vertically upward from an upper surface of the lower tray body. The circumferential wall may include a first circumferential wall located at the first ice making chamber and a second circumferential wall located at the second ice making chamber. A vertical distance between the upper surface of the lower tray body and an upper end of the first circumferential wall may be less than or equal to a vertical distance between the upper surface of the lower tray body and an upper end of the second circumferential wall. In some cases, the circumferential wall may include a first portion that extends vertically from a first portion of an upper surface of the lower tray body by a first length and a second portion that extends vertically from a second portion of the upper surface of the lower tray body by a second length different from the first length. The lower support may define a lower support opening configured to receive the lower tray, and an upper end of the lower support may be configured to be coplanar with an upper end of the lower tray based on the lower tray being received in the lower support.

In some implementations, the lower support may include a lower plate that extends horizontally, that is located at an upper end of the lower tray body, and that defines a lower support opening configured to receive the lower tray. The lower support may also include a wall portion that extends upward from the lower plate and that is configured to face the circumferential wall of the lower tray based on the lower tray being received in the lower support. The lower tray may further include a coupling protrusion that protrudes horizontally from the circumferential wall and that is configured to insert into a coupling slit defined at the wall portion of the lower support, and the coupling protrusion may be configured to, based on being inserted into the coupling slit, protrude outward of the wall portion of the lower support.

In some implementations, an upper surface of the lower tray may define, based on the lower assembly being located at the first position relative to the upper assembly, a first angle with respect to a lower surface of the upper tray, and the upper surface of the lower tray may define, based on the lower assembly being located at the second position relative to the upper assembly, a second angle with respect to the lower surface of the upper tray, the second angle being less than the first angle. The first angle may be less than 10 degrees. In some cases, the upper tray is made of a flexible material, and the upper assembly may further include an upper case located vertically above the upper tray and an upper support located vertically below the upper tray and configured to couple the upper tray to the upper case, the upper support defining a plate opening configured to allow a bottom portion of the upper tray to pass through based on the upper tray being coupled to the upper case.

In some implementations, the circumferential wall of the lower tray may be configured to, based on the lower assembly being at the first position, vertically overlap a first area of an outer surface of the upper tray, and the circumferential wall of the lower tray may be configured to, based on the lower assembly being at the second position, vertically overlap a second area of the outer surface of the upper tray, the second area being greater than the first area. In some cases, the upper tray and the lower tray may be made of a silicone material, and the ice maker may further include a direct current heater that contacts the upper tray and is configured to supply heat to the upper portions of the plurality of ice making chambers. In some cases, based on joining of the upper portions and the lower portions of the plurality of ice making chambers at the second position, a first water escape passage may be defined between the curved portion of the circumferential wall and the curved wall of the upper tray body. Also, based on joining of the upper portions and the lower portions of the plurality of ice making chambers at the second position, a second water escape passage may be defined between the vertical portion of the circumferential wall and the vertical wall of the upper tray body.

DETAILED DESCRIPTION

Figure 1:
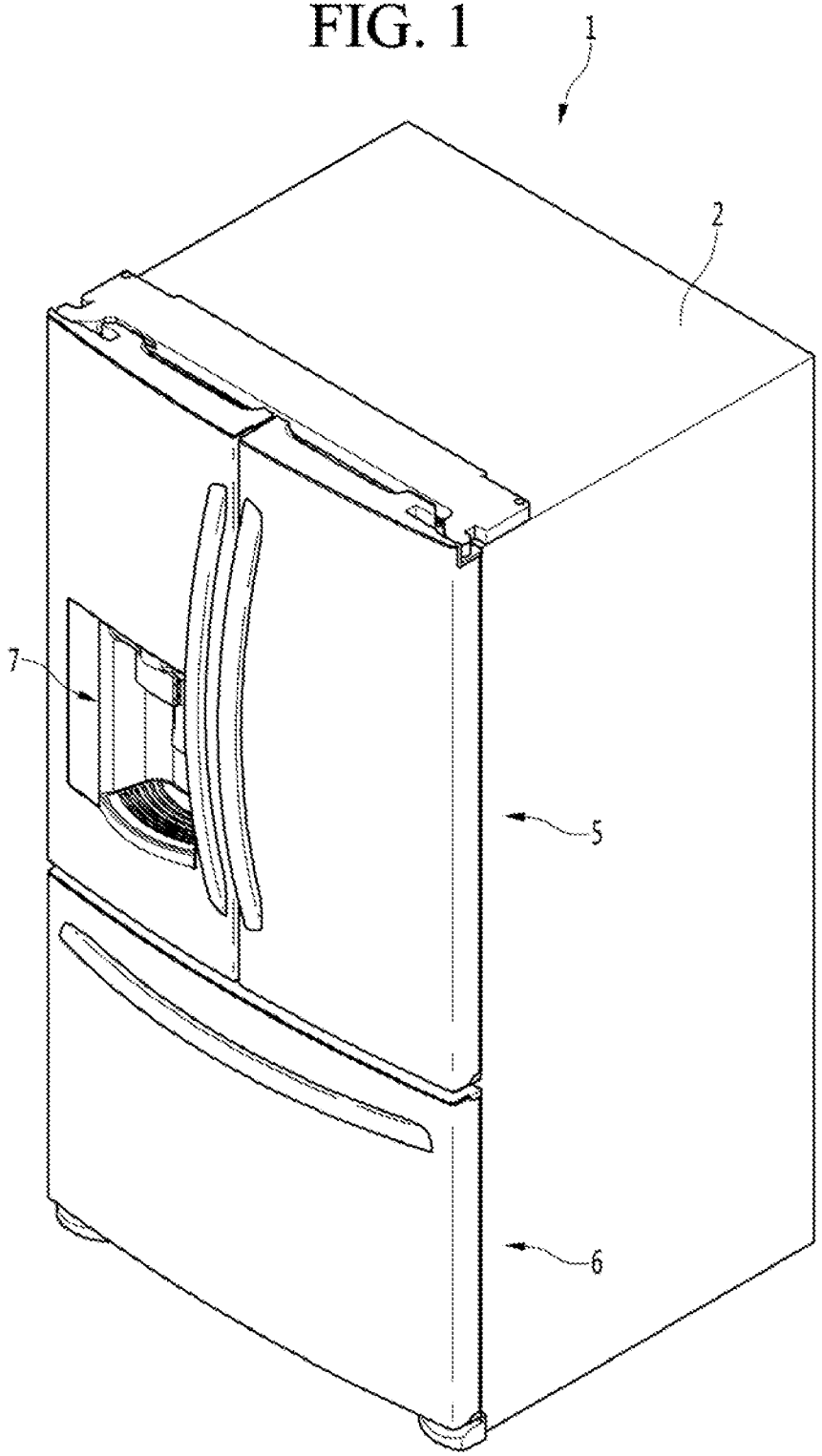
FIG. 1 is a perspective view illustrating an example refrigerator.
Figure 2:
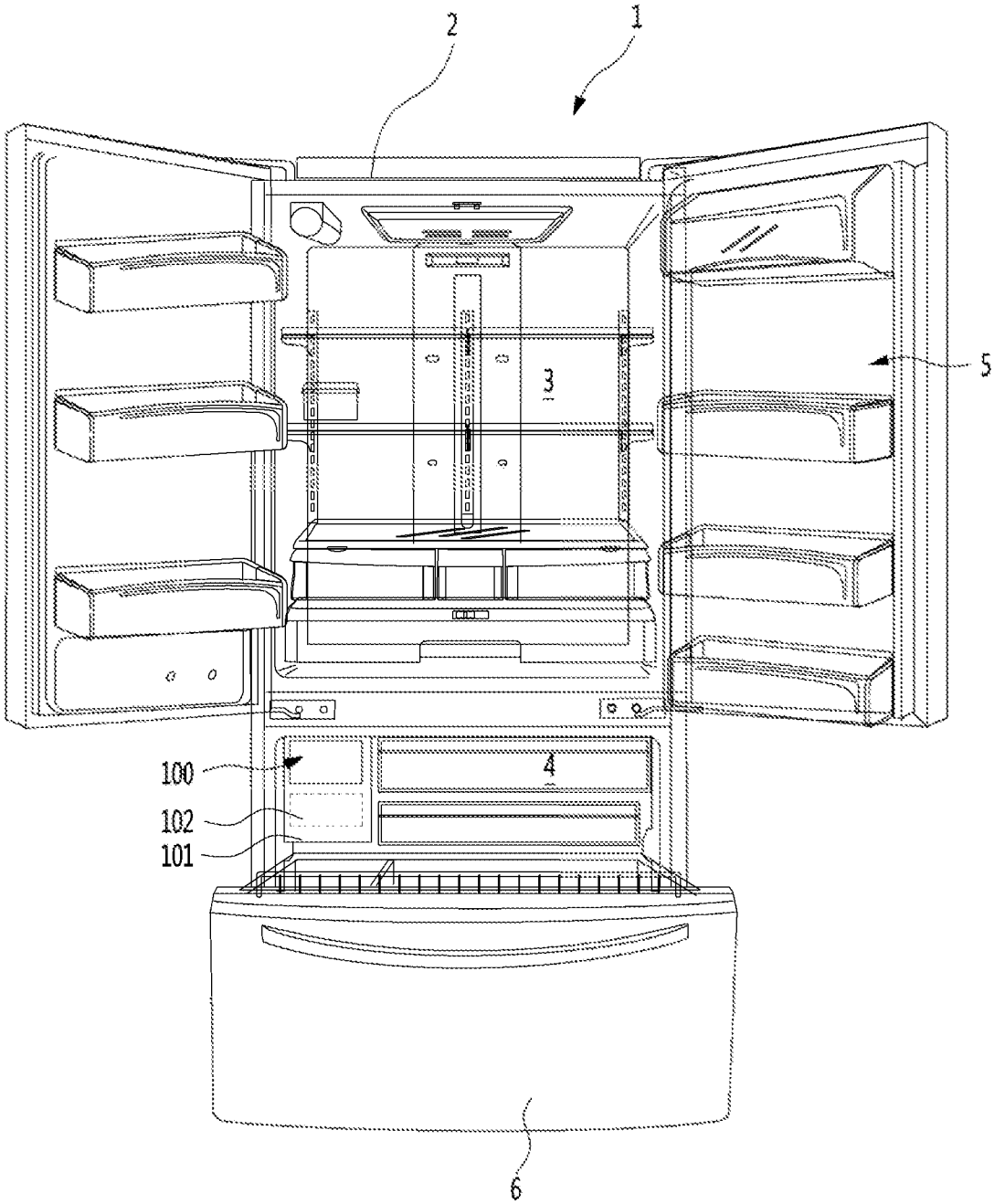
FIG. 2 is a front view illustrating an example state in which doors of the refrigerator of FIG. 1 are opened.

Referring to FIGS. 1 and 2, a refrigerator 1 may include a cabinet 2 that defines a storage space for storing items, for example food items. In some cases, the cabinet 2 may define a refrigerating compartment 3 at an upper portion and a freezing compartment 4 at a lower portion. Various accommodation members such as a drawer, a shelf, a basket, and the like may be provided in the refrigerating compartment 3 and the freezing compartment 4.

One or more doors may be provided to open and close the storage space of the refrigerator. For example, a refrigerating compartment door 5 may be provided for the refrigerating compartment 3, and a freezing compartment door 6 may be provided for the freezing compartment 4. As illustrated in FIG. 2, the refrigerating compartment door 5 may include a pair of left/right doors that are configured to swing open, and the freezing compartment door 6 may be part of a drawer that is inserted and withdrawn from the freezing compartment.

The refrigerating and freezing compartments may be arranged in various alternative ways, as readily apparent to those of ordinary skill in the art. For example, the refrigerating and freezing compartments may be arranged side by side. In some cases, the freezing compartment may be positioned above the refrigerating compartment.

As illustrated in FIG. 2, an ice maker 100 may be provided in the freezing compartment 4. The ice maker 100 is configured to make ice by using supplied water. As explained further below, the ice may have a spherical shape. Alternatively, the ice maker 100 may be provided in the freezing compartment door 6, the refrigerating compartment 3, or the freezing compartment door 5. An ice bin 102 may be provided to receive and store ice generated by the ice maker 100. The ice maker 100 and the ice bin 102 may be provided in an ice maker housing 101. The ice maker 100 and the ice bin 102 may be removed, for example, for servicing or replacement.

The ice made by the ice maker 100 may be obtained by a user by, for example, opening the appropriate door to gain access to the ice bin 102. Alternatively, or additionally, a dispenser 7 for dispensing water and/or ice may be provided at an external side of the refrigerating compartment door or the freezing compartment door. A transfer unit may be used to transfer the ice stored in the ice bin 102 to the user via the dispenser 7.

Figure 3A:
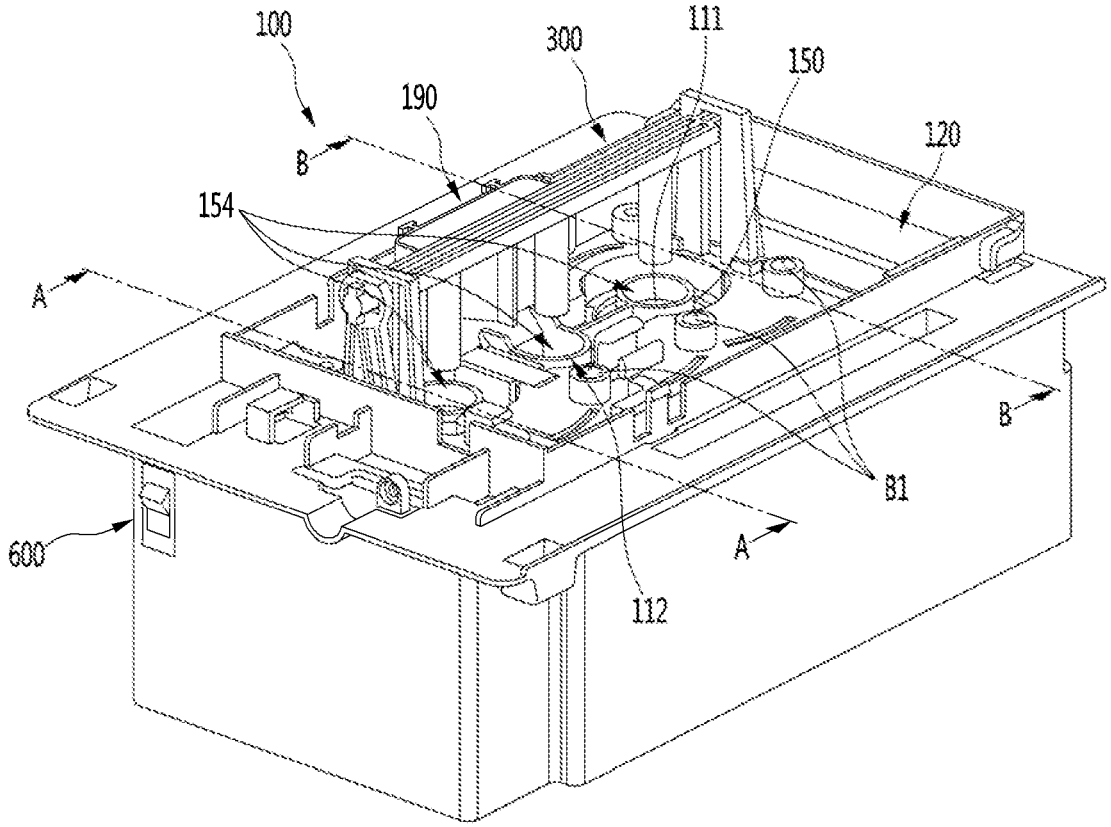
FIGS. 3A and 3B are perspective views illustrating an example ice maker.
Figure 3B:
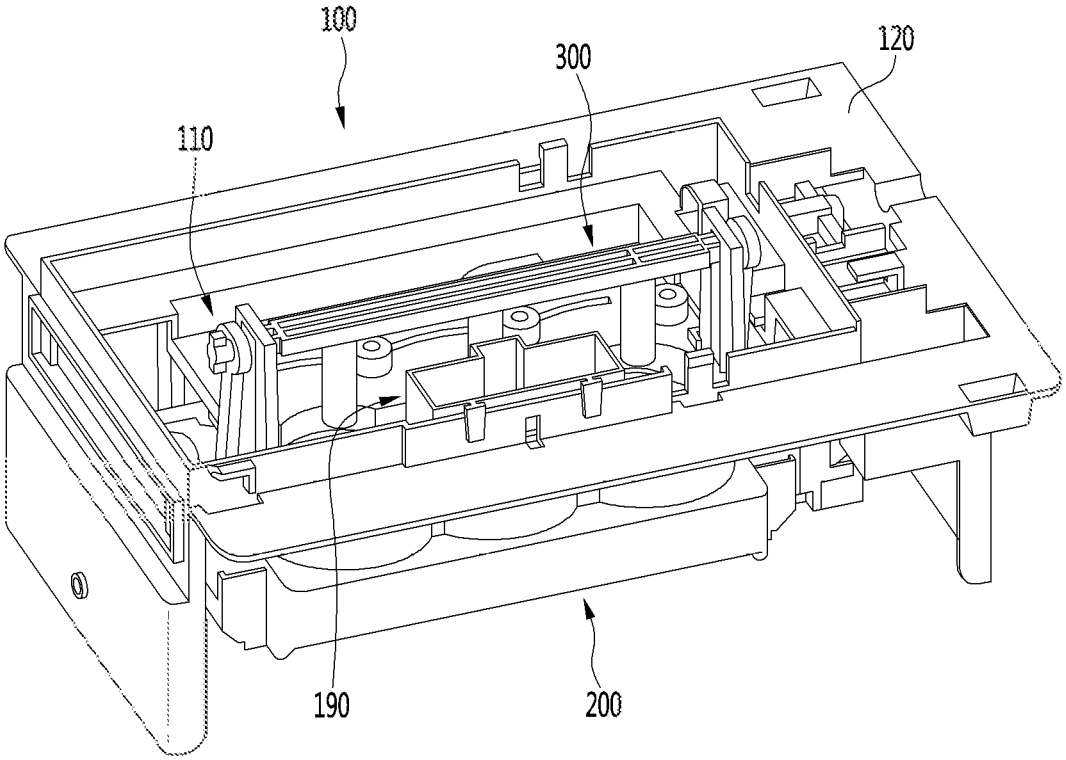
Figure 4:
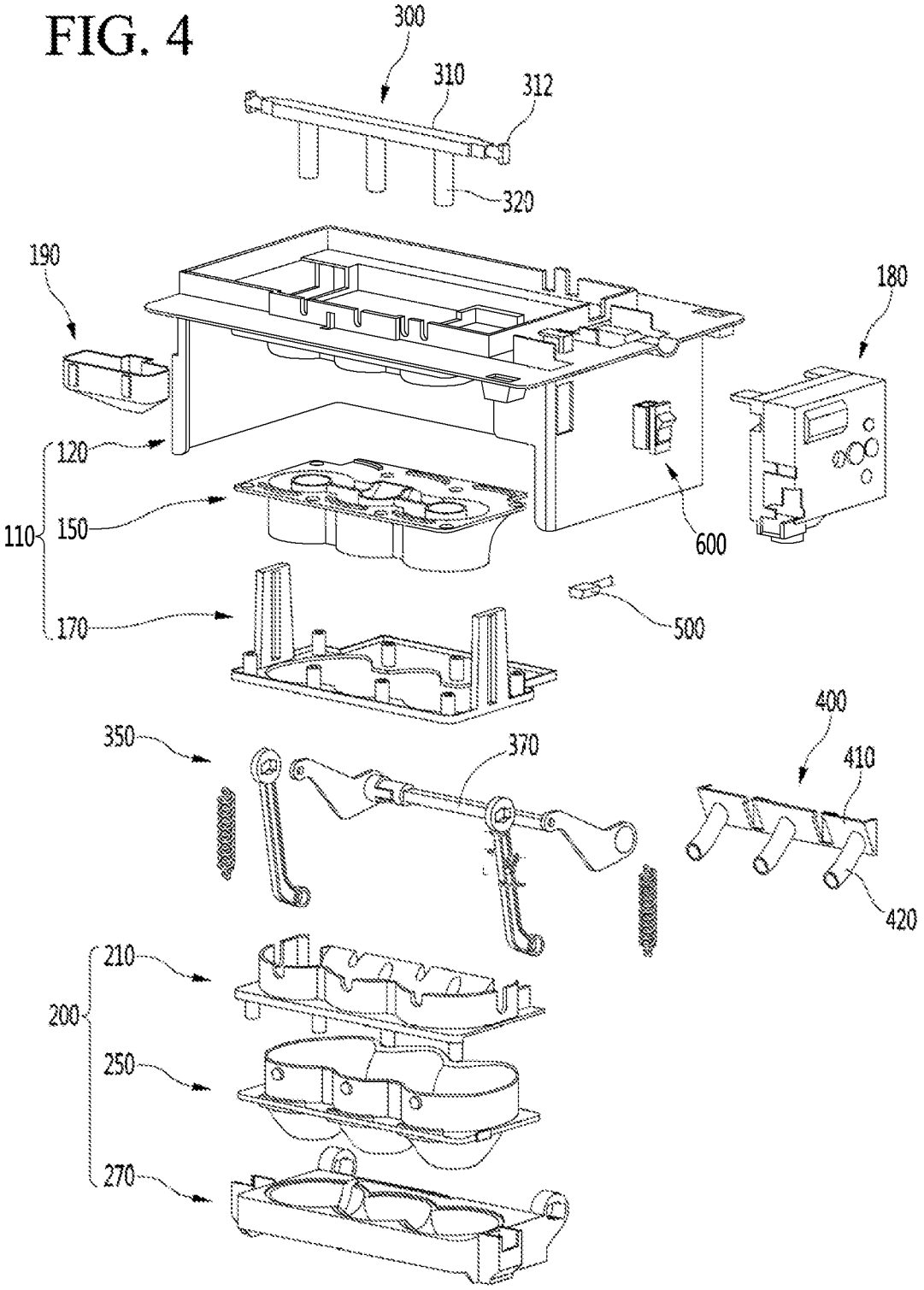
FIG. 4 is an exploded perspective view of the ice maker in FIG. 3A.

Referring to FIGS. 3A, 3B, and 4, an ice maker 100 according to one implementation is shown. As illustrated, the ice maker 100 includes an upper assembly 110 and a lower assembly 200. The lower assembly 200 may be rotatably coupled with respect to the upper assembly 110, with the upper and lower assemblies 110, 200 being designed to come together to form an ice making chamber 111 for spherical ice. The ice making chamber 111 may be formed, for example, by a lower tray that defines the shape of a lower half of the ice and an upper tray that defines the shape of an upper half of the ice. As shown, a plurality of ice making chambers 111 may be provided. For example, three or more chambers may be linearly arranged along a row. In some cases, the chambers may be provided in multiple rows that are arranged parallel to each other. Other shapes of ice, for example cubic or cylindrical among others, may be formed using a similar configuration of upper and lower assemblies but with differently shaped ice making chambers.

In more detail, referring to FIGS. 3A and 3B, the ice maker 100 includes an upper assembly 110 and a lower assembly 200. As explained further below, the lower assembly 200 is configured to rotate relative to the upper assembly 110 during the ice making process.

The upper assembly 110 includes an upper case 120 that defines an outer appearance and an upper tray 150 that is mounted within the upper case 120. The upper tray 150, which can be made from a flexible material such as silicone, defines the upper portion of the plurality of ice making chambers 111. For example, in the case of spherical chambers 111 designed to form spherical ice pieces, the upper hemisphere of the chambers may be defined by the upper tray 150 (with the lower hemisphere being defined by a corresponding lower tray, as further detailed below).

The upper tray 150 defines, at its upper surface, a plurality of upper tray openings 154. An upper ejector 300 includes a plurality of corresponding protrusions that are designed to pass through the upper tray openings 154 during an ice ejection stage to thereby push downward and remove any ice pieces that may be located within the upper portions of the ice making chambers 111. One of the plurality of upper tray openings 154 may further be configured as a water receiving hole 112. In some cases, the water receiving hole 112 may be separately provided to the upper tray 150 in addition to the upper tray openings 154. In either case, the water receiving hole 112 is configured to receive water from a water supply part 190.

The water supply part 190 may be a trough-like structure that is coupled to the upper assembly 110 and that is configured to receive water from a water supply source of the refrigerator. The water supply part 190 may further include a spout-like structure through which the received water flows into the ice making chambers 111. As illustrated, the water supply part 190 can supply water through only a single opening in the upper tray 150. However, because the plurality of ice making chambers 111, as explained in greater detail below, are fluidically connected to one another during the water filling stage, the water received through the single opening can be distributed to all the chambers. As a result, all of the ice making chambers 111 may be filled simultaneously with water using a single water supply part 190. In some implementations, multiple water supply parts, or alternatively a water supply part having multiple spouts, may be used to deliver water directly to more than one chamber at a time.

Referring further to FIG. 4, which shows an exploded view of the ice maker 100, the lower assembly 200 may include a lower tray 250, a lower support 270, and a lower case 210. The lower tray 250, which can also be made from a flexible material such as silicone, defines the lower portion of the plurality of ice making chambers 111. For example, in the case of spherical chambers 111 designed to form spherical ice pieces, the lower hemisphere of the chambers may be defined by the lower tray 250, with the upper hemisphere being defined by the upper tray 150 as explained above.

In some cases, the lower tray 250 may be formed from a silicone material that is more elastically deformable than the silicone material used to form the upper tray 150. Therefore, by way of example, the lower tray 250 may be more easily flexed during the ice removal process compared to the upper tray 150.

A driving unit 180 may be provided to the ice maker 100. The driving unit 180 is configured to rotate the lower assembly 200 relative to the upper assembly 110 during the ice making process. The driving unit 180 may include a driving motor and a power transmission part, such as one or more gears, to actuate the lower assembly 200. The driving motor may be rotatable in both directions, thereby allowing the lower assembly 200 to be rotated in both directions. Although FIG. 4 shows a single driving unit 180 provided at one side of the ice maker 100, multiple driving units may be provided. For example, driving units may be provided at opposing sides of the ice maker.

FIG. 4 further shows the upper ejector 300, which may be removably coupled to the upper assembly 110. The upper ejector 300 may include an ejector body 310 and a plurality of upper ejecting pins 320 that extend downward from the ejector body 310 toward the ice chambers 111. The number of upper ejecting pins 320 provided on the ejector body 310 may correspond to the number of ice chambers 111 such that each ejecting pin is configured to be pushed downward into a corresponding ice chamber during the ice ejection stage. One or both side ends of the upper ejector 300 may include a retaining member 312 that is configured to prevent a connection unit 350 from becoming uncoupled from the upper ejector 300.

The connection unit 350, which may include one or more links that couple the lower assembly 200 to the upper ejector 300, is configured to translate a rotational movement of the lower assembly 200 to an up-down movement of the upper ejector 300.

For example, when the lower assembly 200 rotates in one direction, the upper ejector 300 may descend by the connection unit 350 to allow the upper ejector pin 320 to move downward and push out the ice. Conversely, when the lower assembly 200 rotates in the opposite direction, the upper ejector 300 may ascend back to its original position.

The ice maker 100 may also include a lower ejector 400 that is configured to remove ice that may be retained within the lower portion of the ice chamber 111 in the lower assembly 200. The lower ejector 400 may include an ejector body 410 and a plurality of lower ejecting pins 420 that generally extend in a lateral and downward direction. The lower ejector 400 may be attached to the upper case 120 at a location such that, in use, when the lower assembly 200 is rotated away from the upper assembly 110, the lower assembly 200 is actuated toward the lower ejector 400 such that the lower ejecting pins 420 can press and deform the lower tray 250 to thereby remove ice that is retained in the lower portion of the chamber 111.

As illustrated in FIG. 4, the upper assembly 110 includes the upper case 120 that holds the upper tray 150 and further includes an upper support 170 that is configured to secure the upper tray 150 to the upper case 120. Portions of the upper tray 150, for example, may be positioned between the upper case 120 above and the upper support 170 below to provide a more secure coupling. Various coupling features, such as bosses, fasteners, hooks, tabs, bolts, protrusions, and the like, may be provided to help couple the upper case 120, the upper tray 150, and the upper support 170 to each other in a vertically aligned configuration. The water supply part 190 may be attached to the upper case 120.

The ice maker 100 may also include a temperature sensor 500 for detecting a temperature of the upper tray 150. For example, the temperature sensor 500 may be mounted on the upper case 120 such that, when the upper tray 150 is fixed to the upper case 120, the temperature sensor 500 contacts the upper tray 150. In other cases, the temperature sensor 500 may be mounted directly to the upper tray 150. In some implementations, one or more other temperature sensors may be provided, for example at the lower tray 250.

The lower assembly 200 may include a lower support 270 that is configured to provide support to a lower side of the lower tray 250 and a lower case 210 that is configured to provide support to an upper side of the lower tray 250. The lower case 210, the lower tray 250, and the lower support 270 may be coupled to each other through one or more coupling members, including but not limited to bosses, fasteners, hooks, tabs, bolts, protrusions, and the like.

The ice maker 100 may include a switch for turning the ice maker 100 on and off. For example, the ice maker 100 may be activated to make ice when a user turns on the switch 600. That is, when the switch 600 is turned on, water may be supplied to the ice making chambers 111 of the ice maker 100. Subsequently, the water supplied to the ice making chambers 111 can be frozen to form ice pieces that are in turn ejected from the ice making chambers 111.

An exemplary ice making process of the ice maker 100 will be detailed below with reference to FIGS. 5 to 9.

Figure 5:
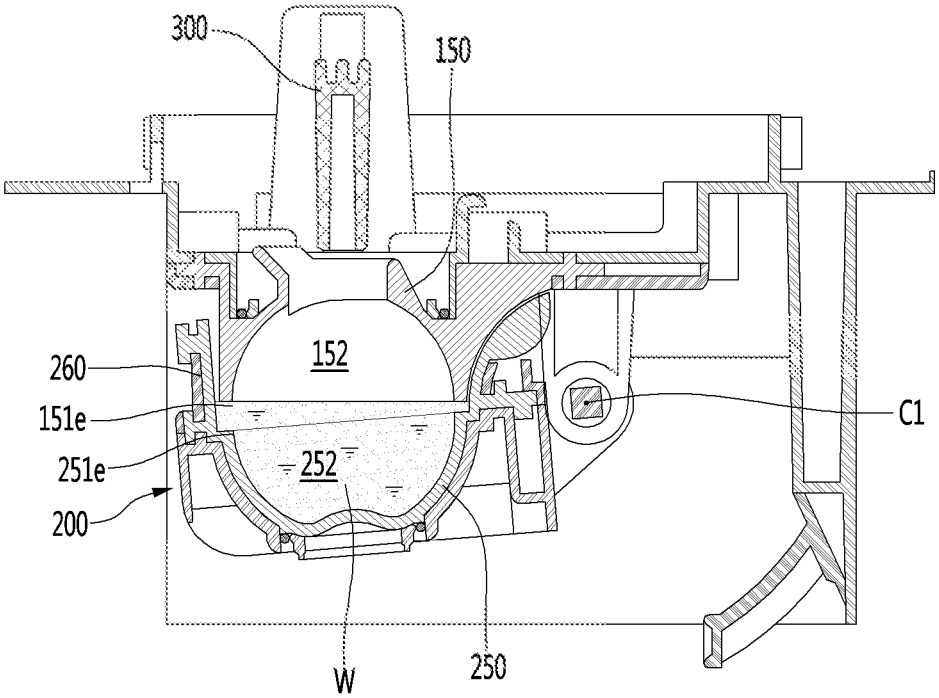
FIGS. 5-9 are cross-sectional views taken along line B-B of FIG. 3A illustrating an example ice making process.

Referring to FIG. 5, water W may be supplied to the ice making chamber 111, which is made up of an upper chamber 152 and a lower chamber 252, when the lower tray 250 is in a water supply position. As explained above, the water may be received through the water receiving hole 112 from the water supply part 190.

In the water supply position, which is illustrated in FIG. 5, the lower tray 250 may be rotated about a rotation axis cl such that the ice making chamber 111 is not completely closed. That is, the ice making chamber 111 may remain slightly open such that a preset angle is formed between a lower surface 151*e* of the upper tray 150 and an upper surface 251*e* of the lower tray 250. The preset angle may be between 0 and 90 degrees. In some cases, the preset angle may be approximately 8 degrees. By leaving the ice making chamber slightly open by the preset angle while receiving the water, adjacent chambers within the ice making chamber 111 can be fluidically connected to each other. Accordingly, even if water is supplied via the water receiving hole 112 to just one of a plurality of chambers, the supplied water can be distributed to all the chambers. That is, all the chambers can be filled by supplying water to just one of the chambers and allowing the water to overflow into the adjacent chambers.

With the lower tray 250 in the water supply position, a predetermined volume of water can be supplied to the ice making chambers 111. The predetermined volume of water may be greater than the amount of water required to create the desired ice piece. In such cases, excess water may be channeled away from the ice making chambers through one or more water escape passages that are provided by the ice making trays, as will be described further below.

When the predetermined volume of water is supplied with the lower tray 250 in the water supply position, water W may completely fill the lower chamber 252. Water W may further fill, either partially or completely, a space that is formed between the upper and lower chambers 152, 252. In some cases, some of the supplied water may fill a lower portion of the upper chamber 152. Although the upper chamber 152 may not be filled with water, water that is held in the space between the upper and lower chamber 152, 252 can subsequently be pushed into the upper chamber 152 to thereby create a fully-formed ice piece. In order to ensure that a sufficient volume of water is retained within the upper chamber 152, the volume of water that is held between the upper and lower chambers 152, 252 during the water supply position may be equal to or greater than the volume of water that can be held within the upper chamber 152.

As described in further detail below with respect to FIGS. 26 to 29, the lower tray 250 may include a circumferential wall, or a retaining wall 260, that extends vertically upward from the upper surface 251*e* and that serves to contain the water that is held above the upper surface 251*e*. That is, the retaining wall 260 is designed to prevent the water that is held between the upper and lower chambers 152, 252 during the water supply step from spilling out.

Figure 6:
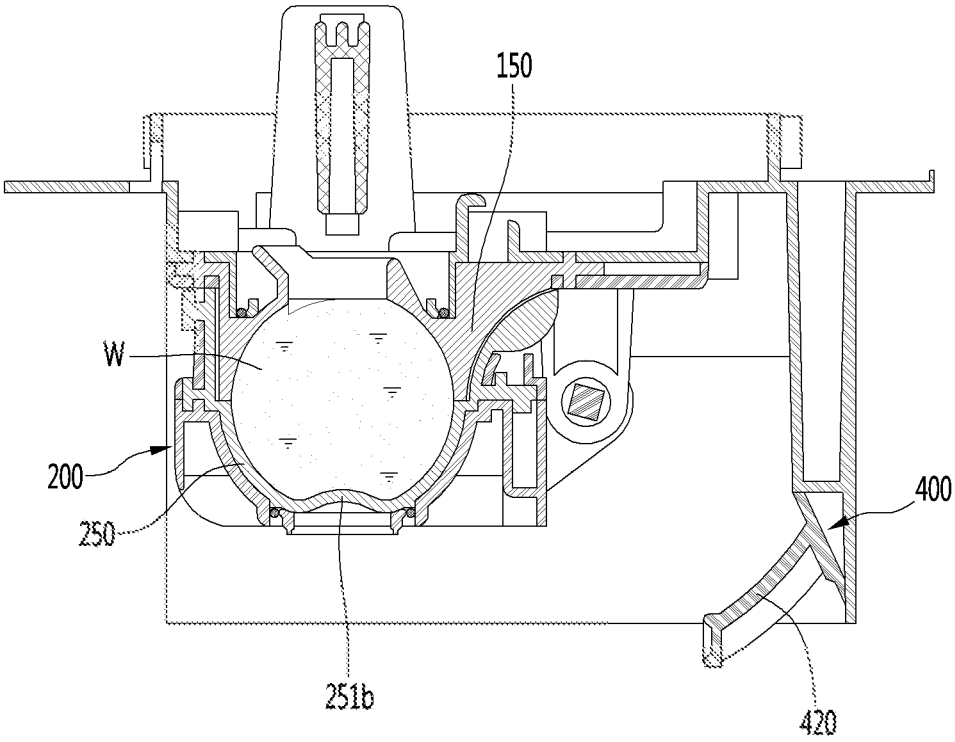

Referring to FIG. 6, the lower tray 250 is shown rotated from the water supply position shown in FIG. 5 to an ice making position. For example, the driving unit 180 may rotate the lower assembly 200 toward the upper assembly 110 such that upper surface 251*e* of the lower tray 250 become coplanar with the lower surface 151*e* of the upper tray 150. Through this motion, as can be seen in FIGS. 5 to 6, the water W that is held between the upper and lower chambers 152, 252 may be pushed upward into the upper chamber 152.

In some implementations, after a complete ice making chamber has been formed in this manner, the driving unit 180 may over-rotate the lower tray 250 toward the upper tray 150 by a small amount to ensure that no gaps are present between the upper and lower surfaces 251*e* and 151*e*. The presence of gaps in this region between the trays 250 and 150, for instance, may result in an undesirable seam or protrusion that is formed around formed ice.

Figure 7:
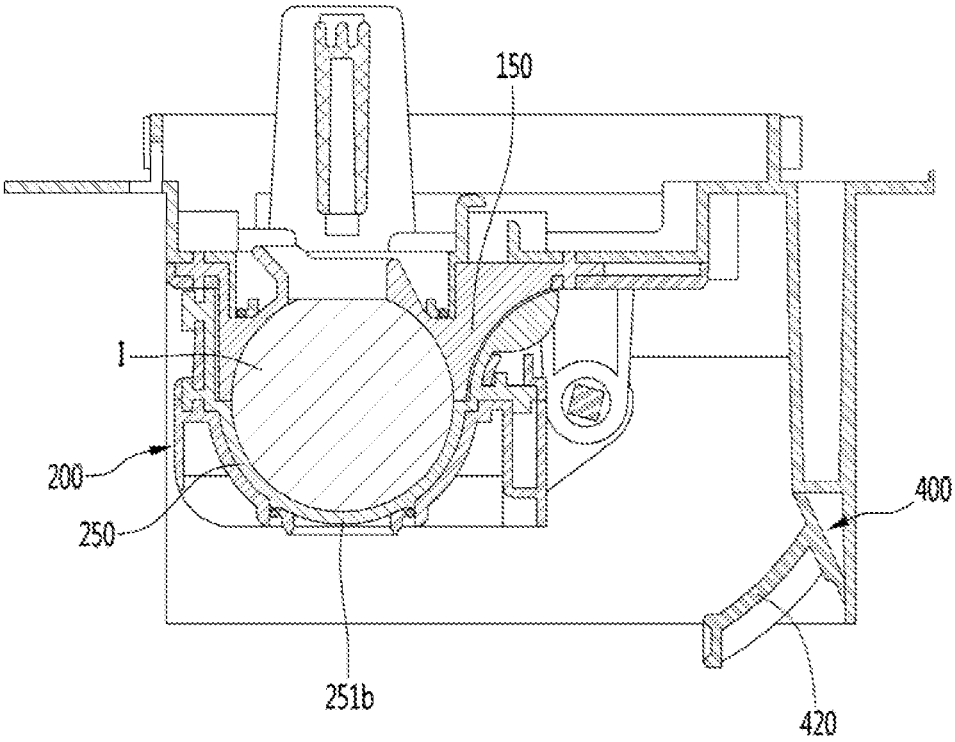

When the water W contained within the ice making chamber freezes, ice I is formed as illustrated in FIG. 7.

Referring also to FIG. 6, a lower portion of the lower tray 250 may include a deformable portion 251*b* that is configured to change shape based on an outward expansion of the ice piece within the ice making chamber during ice generation. Accordingly, the volume of the ice making chamber before ice generation (i.e. before the deformable portion 251*b* changes shape) may be less than the volume of the ice making chamber after ice generation (i.e. after the deformable portion 251*b* changes shape). Notably, because the deformable portion 251*b* is configured to more readily change its shape compared to other portions of the ice making chamber, distortion of the chamber shape caused by ice expansion may be localized to the deformable portion 251*b*.

In some implementations, the deformable portion 251*b* may initially have a convex shape that protrudes toward a center of the ice making chamber as shown in FIG. 6. As illustrated in FIG. 6, filling of the chamber with water may not generate enough pressure to substantially change the convex shape of the deformable portion 251*b*. However, once the water W within the chamber freezes, as seen in FIG. 7, the outward expansion of the ice I can push out the deformable portion 251*b* to take on a concave shape that protrudes away from the center of the ice making chamber. Accordingly, the transformation of the deformable portion 251*b* from a first shape (e.g. convex) to a second shape (e.g. concave) can help the ice making chamber to provide on a more spherical shape during the ice making stage. That is, the outward expansion of the deformable portion 251*b* can help compensate for the outward expansion of the ice to thereby provide a final ice shape that is more spherical than would have been otherwise. The deformable portion 251*b* can revert back to its original shape (i.e. first shape) after the ice piece is removed from the chamber.

The lower support 270 (FIG. 4), which may be more rigid than the lower tray 250, includes a recess that is configured to surround and physically support the spherical portion of the lower tray 250. Accordingly, outward expansion of the lower tray 250 during ice formation, or other unwanted shape distortions, may be restricted. In some cases, as explained below with respect to FIG. 33, the lower support 270 may include lower openings 274 to accommodate the deformable portion 251*b* of the lower tray 250. Accordingly, the lower support 270 can allow the deformable portion 251*b* to expand outward during ice formation while at the same time providing a supporting force to the remaining portions of the lower tray 250. In some cases, the deformable portion 251*b* of the lower tray 250 may be configured to be more flexible than the other portions of the lower tray, for instance by being made thinner, to facilitate transitioning between the first and second shapes.

Figure 8:
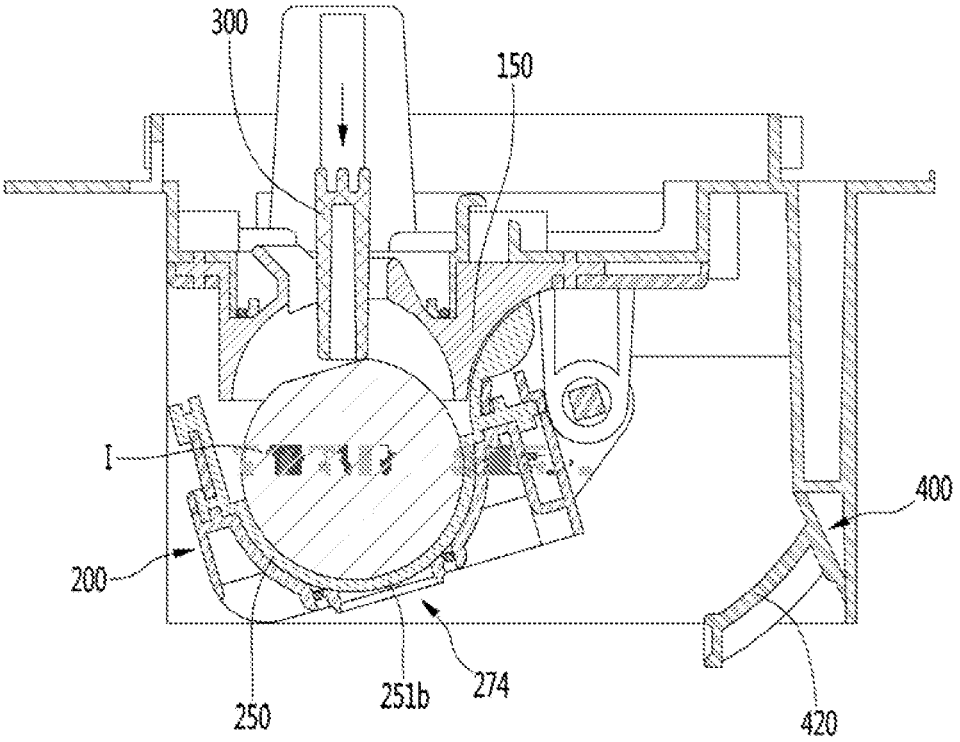
Figure 9:
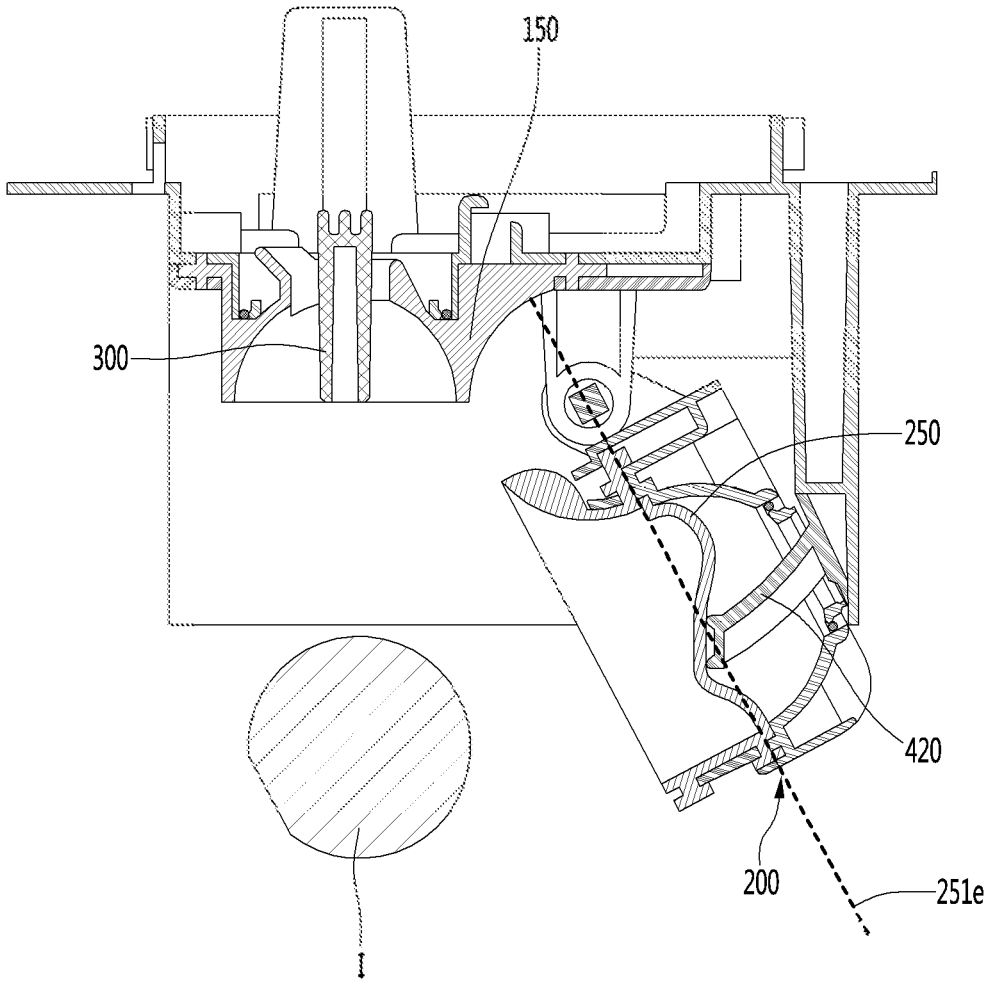

An exemplary process of ejecting the ice piece from the ice making chamber is illustrated in FIGS. 8 and 9. In particular, after the ice piece is formed inside the chamber, the driving unit 180 may rotate the lower assembly 200 away from the upper assembly 110 to separate and open up the upper and lower ice making chambers, thereby exposing the ice piece within.

During this ejection process, as illustrated in FIG. 8, the upper ejector 300 may move downward in conjunction with the outward rotation of the lower assembly 200 such that the upper ejecting pins 320 pass through the upper tray 150 and into the ice chamber 111, thereby pushing away any ice remaining inside the upper chamber 152. In this way, the ice pressed by the upper ejecting pin 320 may be separated from the upper assembly 110 and collected, for example, in the ice bin 102. In some cases, the ice piece I may remain adhered to the lower chamber 252.

As the lower assembly 200 continues to rotate outward away from the upper assembly 110, as seen in FIG. 9, any remaining ice piece I may fall out toward the ice bin 102 due to gravity. In some cases, the ice piece I may not fall out on its own and instead remain adhered to the lower ice tray 250. The continued rotation of the lower assembly 200 away from the upper assembly 110 in such cases will cause the lower ejecting pins 420 of the lower ejector 400 to pass through the lower openings 274 of the lower support 270 to press and deform the lower tray 250, for instance at the deformable portion 251*b*, to thereby remove any ice that is retained in the lower portion of the chamber. In some cases, as shown in FIG. 9, a distal end of the lower ejector 400 may extend past the upper surface 251*e* of the lower tray 250 in order to push any remaining ice piece. In some cases, a length of the ejector pins 420 may be equal to or greater than a radius of the ice making chamber.

In order to ensure that the ice piece within the chamber is properly ejected, as illustrated in FIG. 9, the lower assembly 200 may be rotated past 90 degrees from the ice making position. In some cases, the lower assembly 200 may be rotated between 120-140 degrees from the ice making position to reach the final ice ejection position.

Figure 10A:
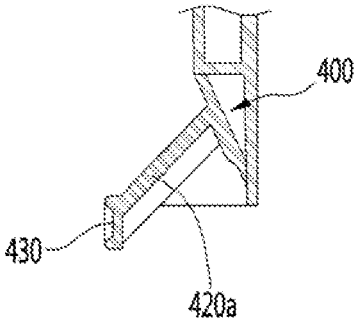
FIGS. 10A and 10B are cross-sectional views illustrating examples of ejector pins.
Figure 10B:
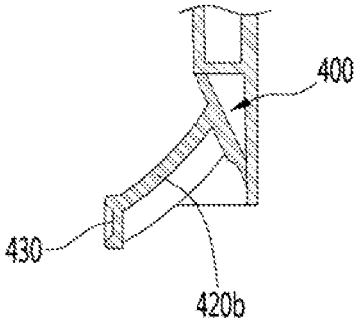

Various exemplary implementations of the ejector pin 420 are illustrated in FIGS. 10A and 10B As shown in FIG. 10A, the ejector pin 420*a* may be substantially linear in shape. The orientation angle of the ejector pin 420*a* may be chosen to be generally orthogonal to the lower assembly 200 at the final ice ejection position. For example, if the lower assembly 200 is designed to be rotated 110 degrees, the ejector pin 420*a* may be angled downward by 20 degrees. If the lower assembly 200 is designed to be rotated 130 degrees, the ejector pin 420*a* may be angled downward by 40 degrees. Alternatively, the orientation angle of the ejector pin 420*a* may be chosen to be generally orthogonal to the lower assembly 200 when a distal end 430 of the lower ejector 400 first makes contact with the lower ice tray 250. For example, if the lower ejector 400 first makes contact with the lower ice tray 250 when the lower assembly 200 has been rotated 90 degrees from the ice making position, the ejector pin 420*a* may be oriented to be substantially horizontal.

In some implementations, as shown in FIG. 10B, the ejector pin 420*b* may be curved toward the rotation shaft of the lower assembly 200. For instance, the curvature of the ejector pin 420*b* may correspond to a trajectory of the lower opening 274 such that the entire length of the ejector pin 420*b* may pass through the lower opening 274 without making contact with the lower support 270. In some cases, a radius of curvature of the ejector pin 420*b* may correspond to a radial distance between the rotation axis cl of the lower assembly 200 and the lower opening 274.

Figure 11:
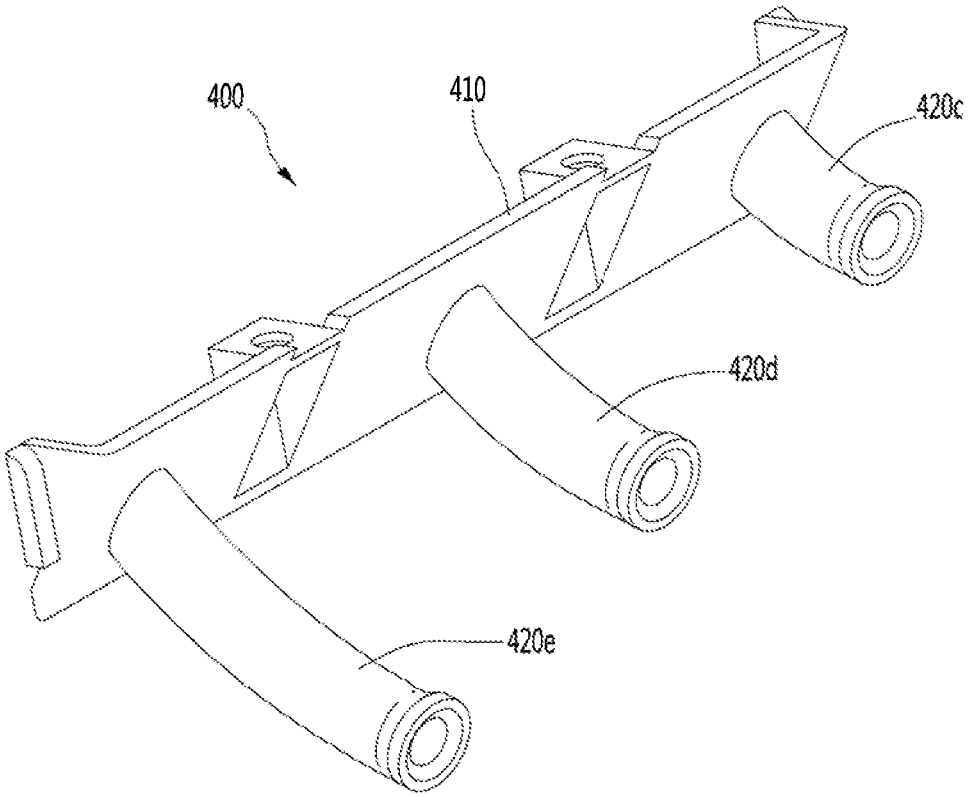
FIG. 11 is a perspective view illustrating an example lower ejector.

In some implementations, as illustrated in FIG. 11, the lower ejector 400 may include ejector pins having unequal lengths. For instance, as shown, ejector pin 420*d* may be longer than ejector pin 420*c*, and ejector pin 420*e* may be longer than ejector pin 420*d*. Accordingly, during downward rotation of the lower assembly 200 in the course of ice ejection, ejector pin 420*e* may contact/push the ice in the lower tray 250 first, followed by ejector pin 420*d* and then ejector pin 420*c*. In this way, because contact of multiple ejector pins may be staggered, peak torque required from the driving unit 180 may subsequently be reduced. This is because motor torque required to eject three ice pieces simultaneously, for instance, is less than motor torque required to eject just one piece at a time.

In some cases, a length of the ejector pin may increase along a length direction of the ejector body 410, as exemplified in FIG. 11. That is, a length of the ejector pin at a first end of the ejector body 410 (e.g. pin 420*c*) may be the shortest among all the ejector pins, and a length of the ejector pin at a second end of the ejector body 410 that is opposite the first end may be the longest (e.g. pin 420*e*). In some cases, the driving unit 180 may be provided at a side of the ice maker 100 that corresponds to the first end of the ejector body 410. That is, the first end of the ejector body associated with the shortest ejector pin may be positioned closer to the driving unit 180 than the second end of the ejector body associated with the longest ejector pin.

In some cases, torque provided by the driving unit 180 may cause the lower assembly 200 to twist as it is being rotated, particularly when a portion of the lower assembly 200 encounters additional resistance from the ejector pins. In such cases, the side of the lower assembly 200 that is farther away from the driving unit 180 may rotate at a slower rate than the side that is closer to the driving unit 180. For example, when the side of the lower assembly that is closer to the driving unit 180 has been rotated 110 degrees, for example, the opposite side farther away from the driving unit 180 may only be rotated by 100 degrees due to the twisting (i.e. wringing effect) of the lower assembly 200. By correspondingly increasing the lengths of the ejector pins based on their distance from the driving unit 180, for example as shown in FIG. 11, the extra pin length may compensate for the reduced rotation in that region stemming from the twisting effect. Accordingly, a sufficient length of the ejector pin may nevertheless be inserted through the lower opening 274, despite the twisting, in order to eject the ice.

As will be understood by a skilled artisan from the disclosure herein, different shapes, sizes, and orientations of the ejector pins may be used.

Figure 12:
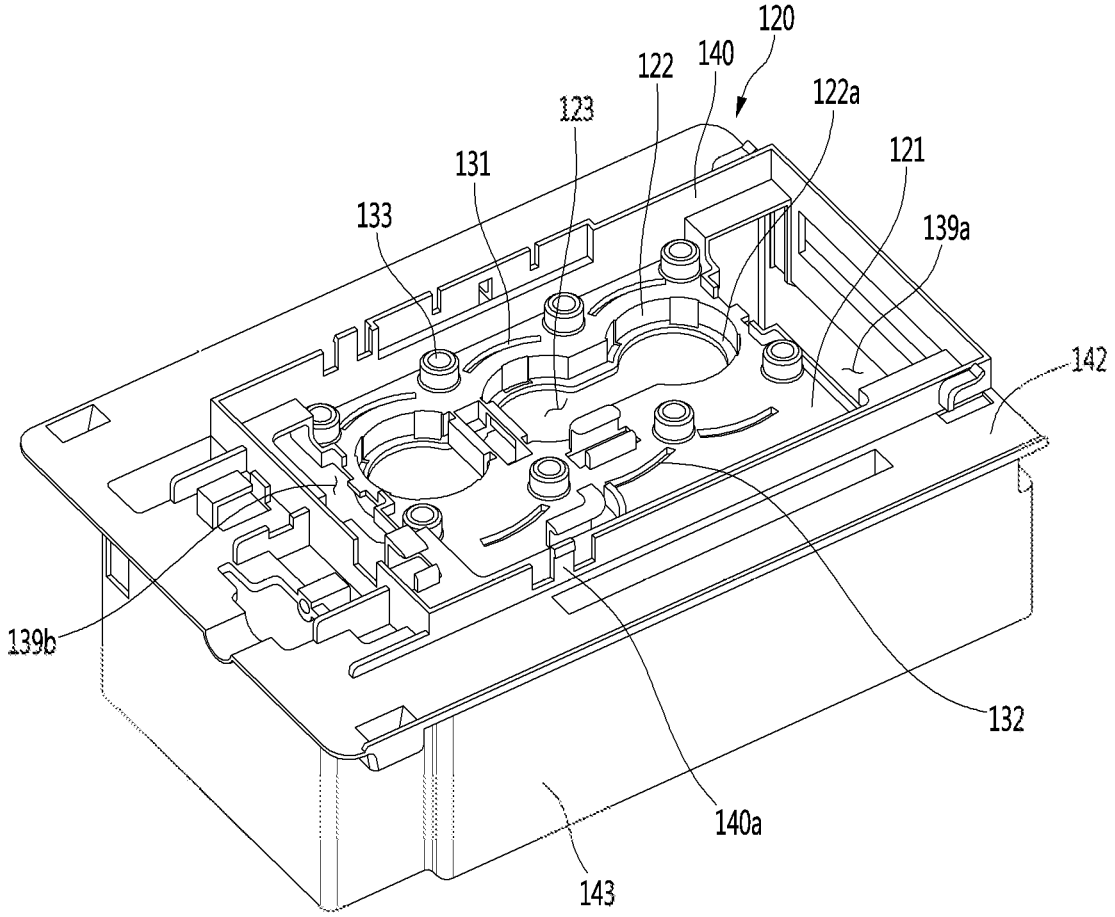
FIG. 12 is a top perspective view illustrating an upper case of the ice maker.
Figure 13:
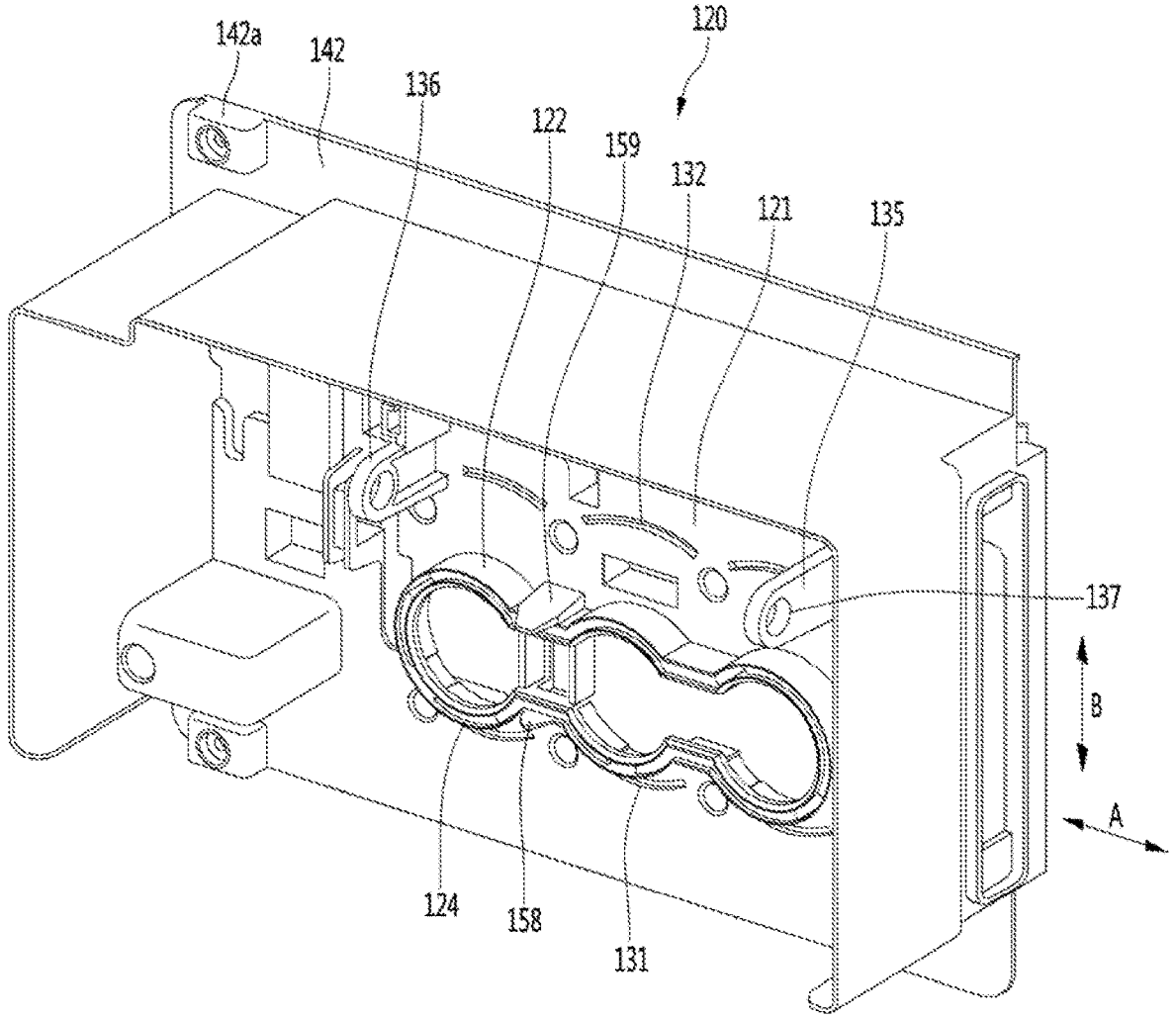
FIG. 13 is a bottom perspective view of the upper case of the ice maker.

Referring now to FIGS. 12 and 13, top and bottom perspective views, respectively, of the upper case 120 of the ice maker 100 according to one implementation is shown. The upper case 120 may at least partially define an outer surface of the ice maker 100 and may be mounted within the freezing compartment 4 to thereby couple the ice maker 100 to the refrigerator 1. In some cases, the upper case 120 may be attached to the housing 101 of the freezing compartment 4.

The upper case 120 may include an upper plate 121 to which the upper assembly 110 is coupled. For example, the upper tray 150 may come in contact with and become attached to a bottom surface of the upper plate 121. The upper tray may include an opening 123 through which a portion of the upper tray 150 can pass through. Accordingly, when the upper tray 150 is attached to the bottom surface of the upper plate 121, a portion of the upper tray 150 may protrude upward through the opening 123. A more secure coupling between the upper plate 121 and the upper tray 150 may be achieved as a result.

Alternatively, the upper tray 150 may be positioned above the upper plate 121 such that the upper tray 150 protrudes downward through the opening 123. The upper plate 121 may include a recess part 122 that is recessed downward from an upper surface of the upper plate 121. The opening 123 may be defined at a bottom surface 122*a* of the recess part 122. The upper tray 150 that protrudes downward through the opening 123 may be accommodated in the recess part 122.

As seen in FIG. 13, a heater coupling part 124, for example a groove configured to accommodate a heater therein, may be provided to the upper plate 121. As further explained below with respect to FIG. 20, the heater coupling part 124 holds an upper heater that is configured to heat the upper tray 150. In some cases, the heater coupling part 124 may be provided vertically below the recess part 122.

The upper case 120 may include installation ribs 158 and 159, which may protrude downward from the bottom surface of the upper plate 121. Additional pairs of ribs may be provided to the upper case 120. The installation ribs 158 and 159 can be used to mount the temperature sensor 500 (FIG. 4) to the upper case 120.

For example, as seen in FIG. 13, the pair of ribs 158 and 159 may be spaced apart from each other along a direction B. Accordingly, the temperature sensor 500 may be held between the pair of installation ribs 158 and 159.

Slots 131 and 132 may be defined in the upper plate 121. The slots may be configured to receive and be coupled to corresponding protrusions that are provided to the upper tray 150. In some cases, the slot-protrusion relationship may be reversed (i.e. protrusions are provided to the upper plate 121 and slots are defined in the upper tray 150). Other types of coupling structures between the upper plate 121 and the upper tray 150 may also be used.

First slots 131 may be spaced apart from the second slots 131 along the direction B such that the slots are positioned on opposite sides of the opening 123. Each of the first slots 131 may be spaced from each other along a direction A, and each of the second slots 132 may be spaced apart from each other along the direction A. The plurality of ice chambers 111 may be arranged along the direction A. Direction A may be orthogonal to direction B and further parallel to the rotation axis cl of the lower assembly 200.

In some cases, the first and second slots 131 and 132 may have a curved shape, for example convex with respect to the opening 123, thus allowing a length of each of the slots to be extended. By increasing the slot length, along with the length of the corresponding protrusion of the upper tray 150, a coupling force between the upper tray 150 and the upper case 120 may be increased.

In some implementations, a distance between the first upper slot 131 and the opening 123 may be different from that between the second upper slot 132 and the opening 123. For example, the distance between the first upper slot 131 and the opening 123 may be greater than that between the second upper slot 132 and the opening 123.

Figure 17:
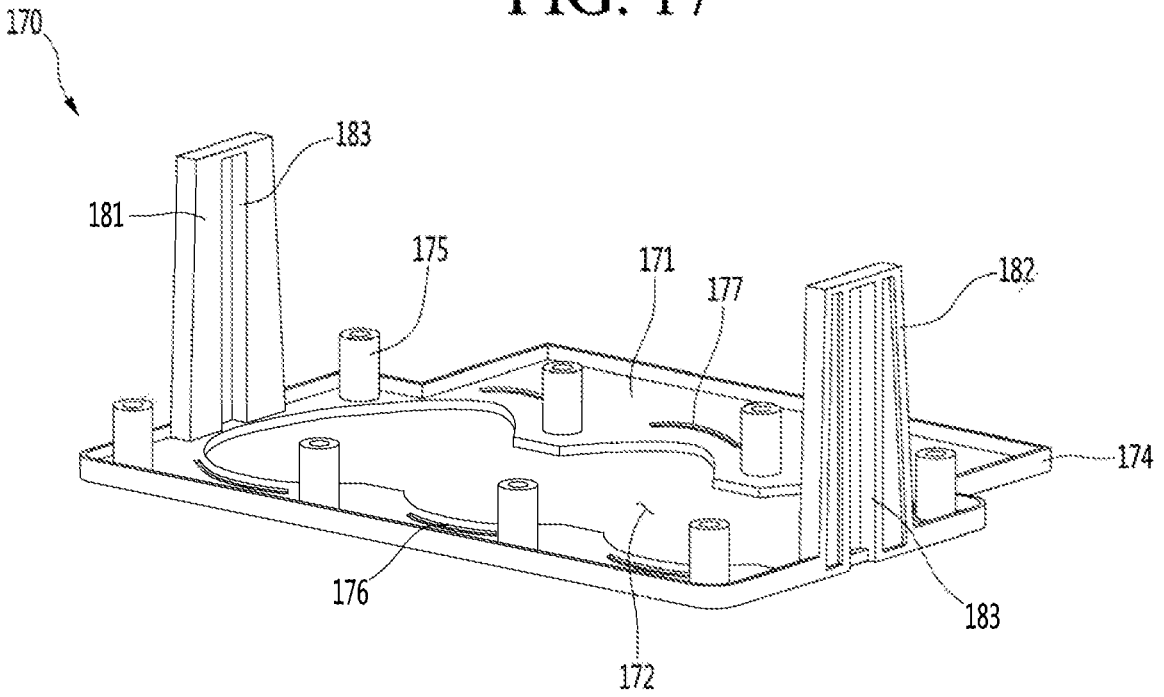
FIG. 17 is a top perspective view illustrating an upper support of the ice maker.
Figure 18:
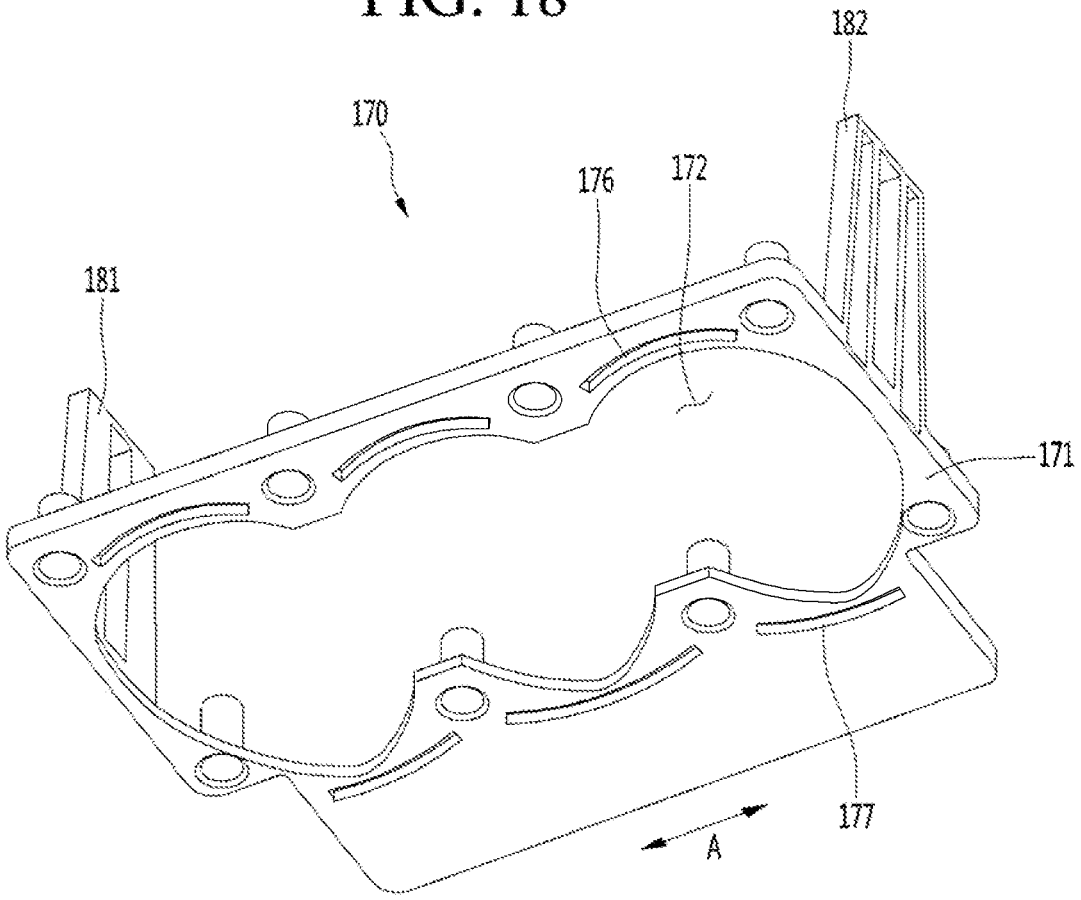
FIG. 18 is a bottom perspective view of the upper support.

Referring to FIG. 12, the upper plate 121 may include a plurality of sleeves 133 that are configured to receive corresponding coupling bosses 175 of the upper support 170 (FIG. 17). The sleeve 133 may have a cylindrical shape and extend upward from the upper plate 121. A plurality of sleeves 133 may be provided on the upper plate 121. The plurality of sleeves 133 may be arranged to be spaced apart from each other in the direction of the arrow A. In some cases, the plurality of sleeves 133 may be arranged in a plurality of rows in the direction of the arrow B. In some cases, each of the sleeves 133 may be positioned between adjacent ones of the slots 131 and/or between adjacent ones of the slots 132.

Referring to FIG. 13, hinge supports 135 and 136 may be provided to the upper case 120. The hinge supports 135 and 136 may protrude downward from the bottom surface of the upper plate 121 and are configured to rotatably support the lower assembly 200. A hinge opening 137 may be defined in each of the hinge supports 135 and 136.

Referring back to FIG. 12, the upper case 120 may include a vertical extension part 140 that extends vertically upward from an upper surface of the upper case 120 and further extends circumferentially around the upper plate 121. The vertical extension part 140 may extend upward from the upper plate 121. The vertical extension part 140 may include one or more coupling hooks 140*a* that are configured to couple the upper case 120 to the housing 101. The water supply part 190 (FIG. 4) may be coupled to the vertical extension part 140, for example via coupling slots defined the vertical extension part 140.

The upper case 120 may further include a horizontal extension part 142 that extends horizontally outward from the vertical extension part 140 to form an upper horizontal surface of the upper case 120. The horizontal extension part 142 may include a screw coupling part 142*a* that is configured to receive a screw that couples the upper case 120 to the freezer compartment.

The upper case 120 may further include a circumferential sidewall 143 that extends downward from the horizontal extension part 142 and at least partially surrounds a circumference of the upper and lower assemblies 110, 200. The circumferential sidewall 143 may form an eternal appearance of the ice maker 100 and helps provide a protective barrier between the various moving components of the ice maker 100, such as the lower assembly 200, and the rest of the freezing compartment. As illustrated in FIG. 13, one side of the circumferential sidewall 143 may be left open to, for example, allow a user to access the inside of the ice maker 100. In some cases, the lower ejector 400 may be attached to an inner side of the circumferential sidewall 143.

Figure 14:
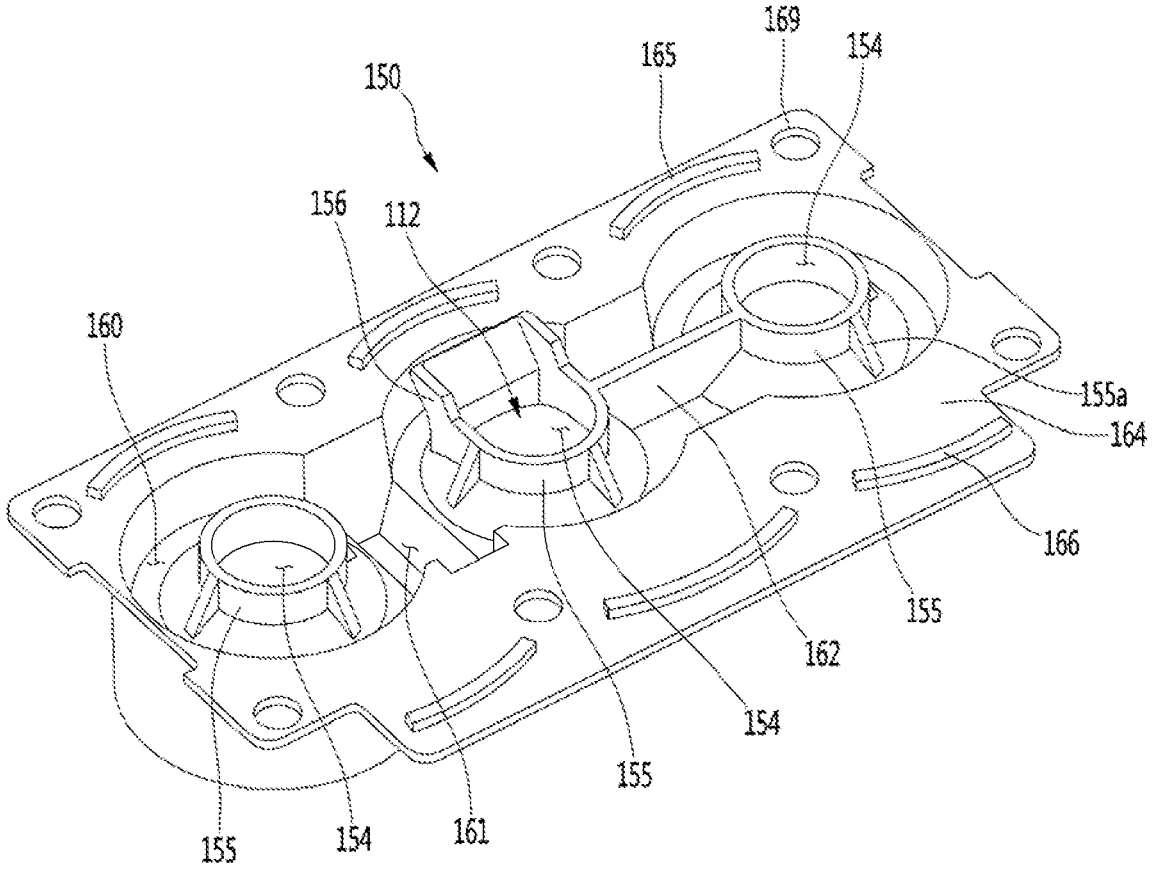
FIG. 14 is a top perspective view illustrating an upper tray of the ice maker.
Figure 15:
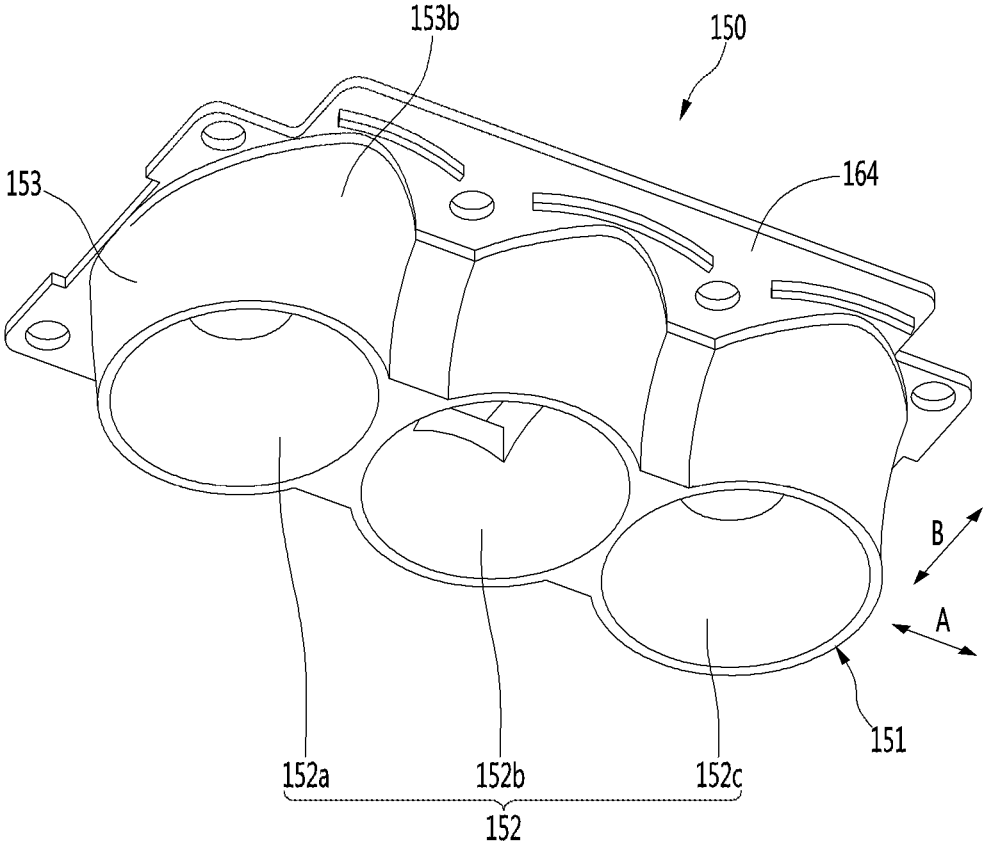
FIG. 15 is a bottom perspective view of the upper tray.
Figure 16:
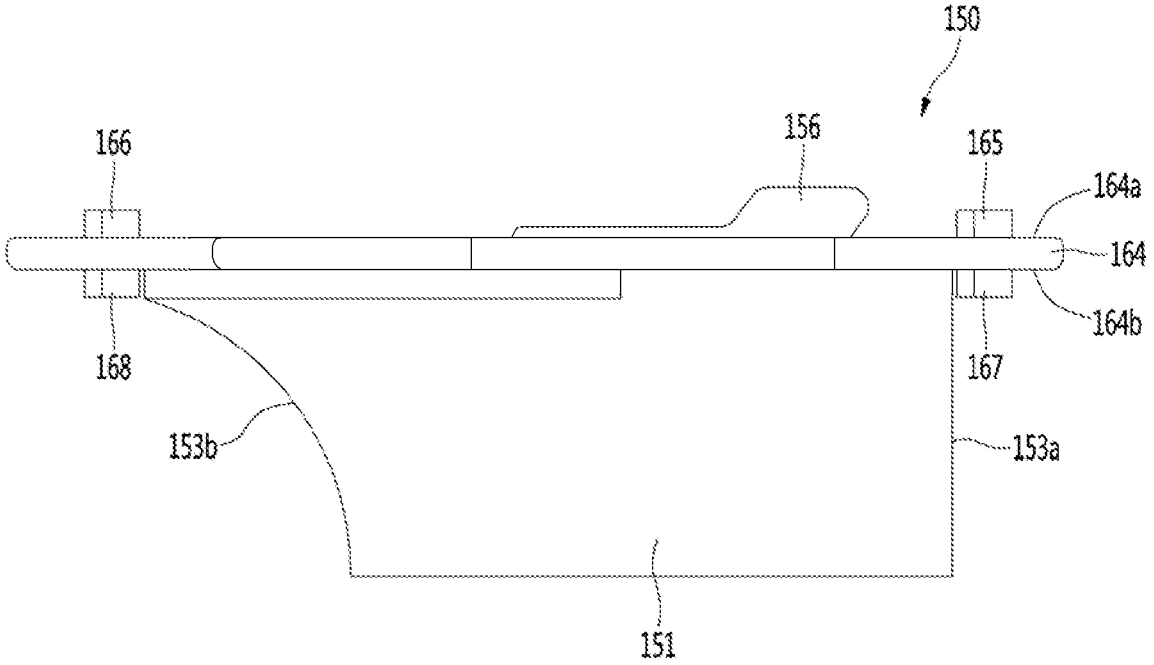
FIG. 16 is a side view of the upper tray.

Referring now to FIGS. 14 to 16, the upper tray 150 includes, among other things, the upper chamber 152 that provides a mold for shaping the upper half of the ice piece being made. The upper chamber 152 may be hemispherical in shape, for example, to form the upper hemisphere of a spherical ice piece. The upper chamber 152 may include an array of upper chambers, such as upper chambers 152*a*, 152*b*, 152*c*, to enable making multiple ice pieces at a time.

The upper tray 150 may be integrally molded as one piece. Alternatively, the upper tray 150 may be made from separate pieces that are attached together.

In one implementation, the upper tray 150 may be made of a flexible material that is capable of being restored to its original shape after being deformed by an external force. For example, the upper tray 150 may be made of a silicone material. Accordingly, the upper tray 150 may be deformed during, for example, the ice ejection process but may subsequently return to its original shape to generate additional ice pieces. The spherical shape of the ice, therefore, may be maintained through repetitive uses. In some cases, the upper tray 150 may be intentionally deformed during the ice ejection process to facilitate removal of the ice piece.

In some cases, for reasons discussed below, the upper tray 150 may be made from a heat-resistant material that will maintain its shape when heated. A silicone material, which exhibits good heat resistance, may also be used for this purpose.

The upper tray 150 may include an upper tray body 151 that defines an internal space for molding ice, namely one or more upper chambers 152 that make up the upper half of the ice chamber 111.

In one implementation, the upper chambers 152 may include a first upper chamber 152*a*, a second upper chamber 152*b*, and a third upper chamber 152*c*. The one or more upper chambers 152 may be defined within a chamber wall 153 that forms an outer appearance of the upper tray body 151. In some cases, separate chamber walls may be provided to form each upper chamber. In other cases, as shown in FIG. 15, a single chamber wall 153 may be used to define individual chambers within.

As illustrated in FIG. 15, the plurality of upper chambers 152*a*, 152*b*, and 152*c* (as well as fewer or greater number of upper chambers depending on the implementation) may be spaced apart from each other and arranged along the direction A. As explained above with respect to FIG. 13, direction A may be parallel to the rotation axis cl of the lower assembly 200.

As shown in FIG. 14, the upper tray body 151 may include a plurality of upper tray openings 154, with one opening being provided for each chamber 111. For example, three upper tray openings 154 may be defined in an upper surface of the upper tray body 151 to correspond to each of the three chambers 111 underneath. Cold air from the freezer may be guided into the chambers 111 via the openings 154.

Moreover, the upper ejecting pins 320 of the upper ejector (FIG. 4) may be inserted downward through the upper tray openings 154 to help eject the ice pieces. In some cases, an inlet wall 155 that surrounds and extends upward from a circumference of the upper tray openings 154 may be provided to provide increased structural support.

In some implementations, one or more first connection ribs 155*a* may be provided along a circumference of the inlet wall 155 to help prevent the inlet wall 155 from being deformed, for example, when the upper ejector 300 is inserted into the inflow opening 154. The first connection rib 155*a* may connect the inlet wall 155 to the upper tray body 151. For example, the first connection rib 155*a* may be integrated with the circumference of the inlet wall 155 and an outer surface of the upper tray body 151. In some cases, the plurality of connection ribs 155*a* may be disposed along the circumference of the inlet wall 155.

The two inlet walls 155 corresponding to the second upper chamber 152*b* and the third upper chamber 152*c* may be connected to each other through the second connection rib 162. The second connection rib 162 may also help prevent the inlet wall 155 from being deformed.

One of the upper tray openings 154 may be configured as the water receiving hole 112. For example, as shown in FIG. 14, the water receiving hole 112 may be enlarged and further surrounded by a water supply guide 156 that provides a funnel-like structure for receiving the water supply part 190 (FIG. 4). The water supply guide 156 may be provided as an extension of the inlet wall 155 corresponding to the water receiving chamber, for instance chamber 152*b* as illustrated. The water supply guide 156 may be inclined upward and outward from the inlet wall 155.

The upper tray 150 may further include a first accommodation part 160. Referring also to FIG. 13, the recess part 122 of the upper case 120 may be accommodated in the first accommodation part 160. A heater coupling part 124 may be provided in the recess part 122, and an upper heater 148 (FIG. 20) may be provided in the heater coupling part 124.

The first accommodation part 160 may be shaped to surround the upper chambers 152*a*, 152*b*, and 152*c*. The first accommodation part 160 may be recessed downward from a top surface of the upper tray body 151. The heater coupling part 124 to which the upper heater 148 is coupled may be accommodated in the first accommodation part 160.

The upper tray 150 may further include a second accommodation part 161 that is configured to house the temperature sensor 500 (FIG. 4).

For example, the second accommodation part 161 may be recessed downward from a bottom surface of the first accommodation part 160. The second accommodation part 161 may be disposed between two adjacent upper chamber. For example, the second accommodation part 161 may be disposed between the first upper chamber 152*a* and the second upper chamber 152*b*. By providing separate spaces for accommodating the heater and the temperature sensor in this manner, the temperature sensor 500 may be prevented from directly measuring heat coming from the heater 148. Rather, in the state in which the temperature sensor 500 is accommodated in the second accommodation part 161, the temperature sensor 500 may contact and measure a temperature of an outer surface of the upper tray body 151.

Referring to FIGS. 15 and 16, the chamber wall 153 may include a vertical portion 153*a* and a curved portion 153*b*. The curved portion 153*b* is curved outward toward the rotation axis cl. As described below with respect to FIG. 30, an outer surface of the curved portion 153*b* may help define a water escape passage that is designed to guide excess water out of the chambers 111. Moreover, the curved surface of the curved portion 153*b* can provide a guiding surface for the lower tray 250 when the lower assembly 200 is opened and closed relative to the upper tray 150.

The upper tray 150 may further include a horizontal extension part 164 that extends horizontally outward from and surrounds the circumference of the upper tray body 151. The horizontal extension part 164 may be sandwiched between the upper case 120 and the upper support 170 below to provide a secure coupling of the upper tray 150 to the ice maker 100.

For example, a bottom surface 164*b* of the horizontal extension part 164 may contact the upper support 170, and a top surface 164*a* of the horizontal extension part 164 may contact the upper case 120. That is, at least a portion of the horizontal extension part 164 may be disposed between the upper case 120 and the upper support 170.

The horizontal extension part 164 may include a plurality of upper protrusions 165 and 166 that are configured to be inserted into the plurality of upper slots 131 and 132. In some cases, the protrusion-slot relationship may be reversed.

The plurality of upper protrusions 165 and 166 may include a first upper protrusion 165 and a second upper protrusion 166 disposed at an opposite side of the first upper protrusion 165 with respect to the inflow opening 154.

The first upper protrusion 165 may be inserted into the first upper slot 131, and the second upper protrusion 166 may be inserted into the second upper slot 132. The first upper protrusion 165 and the second upper protrusion 166 may protrude upward from the top surface 164*a* of the horizontal extension part 164. The first upper protrusion 165 and the second upper protrusion 166 may be spaced apart from each other in the direction of the arrow B of FIG. 15. The plurality of first upper protrusions 165 may be arranged to be spaced apart from each other in the direction of the arrow A. In some cases, one or both of the first and second upper protrusion 165, 166 may have a curved shape.

The upper protrusions 165, 166 can provide lateral coupling to help restrict a lateral movement and/or deformation of the horizontal extension part 164 relative to the upper case 120 during the ice making and/or the ice ejection process.

The horizontal extension part 164 may further include a plurality of lower protrusions 167 and 168. The plurality of lower protrusions 167 and 168 may be configured to be inserted into corresponding lower slots that are defined in the upper support 170. As with the upper protrusions and slots, the protrusion-slot relationship may be reversed.

The plurality of lower protrusions 167 and 168 may include a first lower protrusion 167 and a second lower protrusion 168 disposed at an opposite side of the first lower protrusion 167 with respect to the upper chamber 152. The first lower protrusion 167 and the second lower protrusion 168 may protrude upward from the bottom surface 164*b* of the horizontal extension part 164.

The first lower protrusion 167 may be disposed opposite the first upper protrusion 165 with respect to the horizontal extension part 164. The second lower protrusion 168 may be disposed opposite the second upper protrusion 166 with respect to the horizontal extension part 164. The first lower protrusion 167 may be spaced apart from the vertical wall 153*a* of the upper tray body 151. The second lower protrusion 168 may be spaced apart from the curved wall 153*b* of the upper tray body 151.

Each of the plurality of lower protrusions 167 and 168 may also be provided in a curved shape. Similar to the upper protrusions, the lower protrusions can provide lateral coupling to help restrict a lateral movement and/or deformation of the horizontal extension part 164 relative to the upper support 170 during the ice making and/or the ice ejection process.

In some implementations, the horizontal extension part 164 may include one or more through-holes 169 that may be used, for instance, to receive corresponding coupling bosses of the upper support 170. One or more of the through-holes 169 may be positioned between adjacent ones of the upper or lower protrusions 165, 167. One or more of the through-holes 169 may be positioned between adjacent ones of the upper or lower protrusions 166, 168.

Referring to FIGS. 10 and 11, the upper support 170 may include a support plate 171 that is designed to contact and support the upper tray 150. For example, a top surface of the support plate 171 may contact the bottom surface 164*b* of the horizontal extension part 164 of the upper tray 150. The support plate 171 may define a plate opening 172 through which a portion of the upper tray body 151 may be inserted through to thereby extend downward from the support plate 171. The support plate 171 may also include a circumferential wall 174 that surrounds all or a portion of the outer edge of the support plate 171. Accordingly, the circumferential wall 174 may surround and support an outer side surface of the horizontal extension part 164 of the upper tray 150. A top surface of the circumferential wall 174 may contact a bottom surface of the upper plate 121 (FIG. 13).

In some cases, the support plate 171 may include a plurality of lower slots 176 and 177. The plurality of lower slots 176 and 177 may include a first lower slot 176 into which the first lower protrusion 167 is inserted and a second lower slot 177 into which the second lower protrusion 168 is inserted.

The plurality of first lower slots 176 may be disposed to be spaced apart from each other in the direction of the arrow A on the support plate 171. Also, the plurality of second lower slots 177 may be disposed to be spaced apart from each other in the direction of the arrow A on the support plate 171.

The support plate 171 may further include a plurality of coupling bosses 175. The plurality of coupling bosses 175 may protrude upward from the top surface of the support plate 171. Each of the coupling bosses 175 may pass through the through-hole 169 of the horizontal extension part 164 and further be inserted into the sleeve 133 (FIG. 12) of the upper case 120.

In the state in which the coupling boss 175 is inserted into the sleeve 133 (FIG. 12), a top surface of the coupling boss 175 may be disposed at the same height as a top surface of the sleeve 133 or disposed at a height lower than that of the top surface of the sleeve 133.

A coupling member, such as a screw B1 (FIG. 3A), may be used to couple the upper case 120 to the upper support 170. The screw B1 may include a body part and a head part having a diameter greater than that of the body part. The screw B1 may be coupled to the coupling boss 175 from an upper side of the coupling boss 175. When assembled, the head part of the screw B1 may contact and press down on the top surfaces of the sleeve 133 and the coupling boss 175.

The upper support 170 may further include unit guides 181 and 182 for guiding the connection unit 350 connected to the upper ejector 300. The unit guides 181 and 182 may, for example, extend upward from opposing side ends of the support plate 171. The unit guides 181 and 182 may extend upward from the top surface of the support plate 171. In some cases, the unit guides 181 and 182 may be integral with the circumferential wall 174.

Each of the unit guides 181 and 182 may include a guide slot 183 that extends along the length of the guides 181, 182. Both ends of the ejector body 310 of the ejector 300 may pass outward through each of the guide slots 183 and couple to the connection unit 350. Accordingly, when the rotation force from the driving unit 180 is transmitted to the ejector body 310 via the connection unit 350, the ejector body 310 may move vertically up and down along the guide slot 183.

Figure 19:
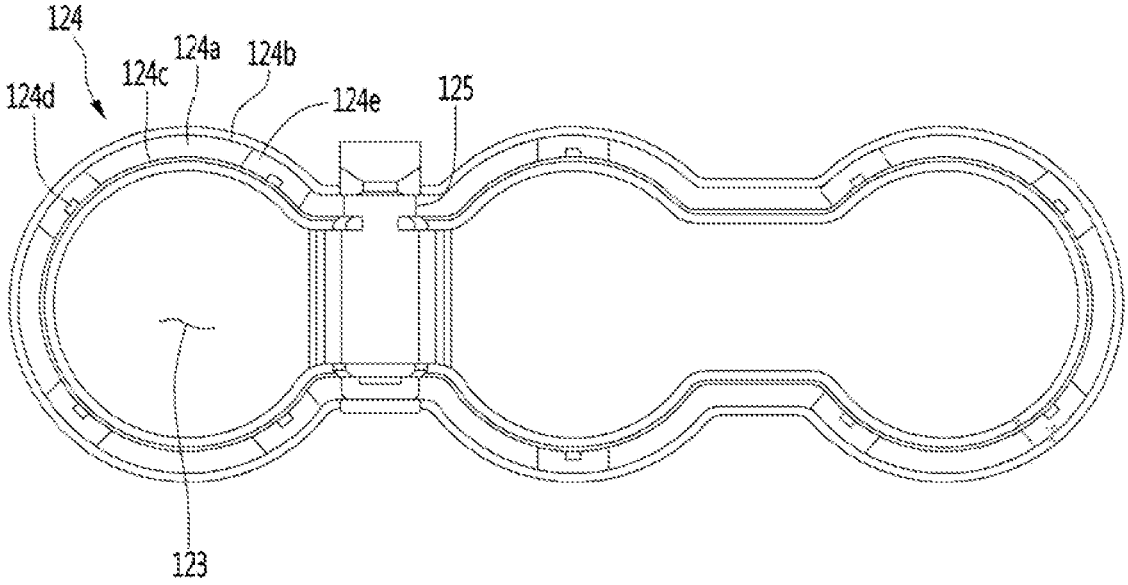
FIG. 19 is an enlarged view illustrating an example heater coupling part in the upper case of FIG. 12.
Figure 20:
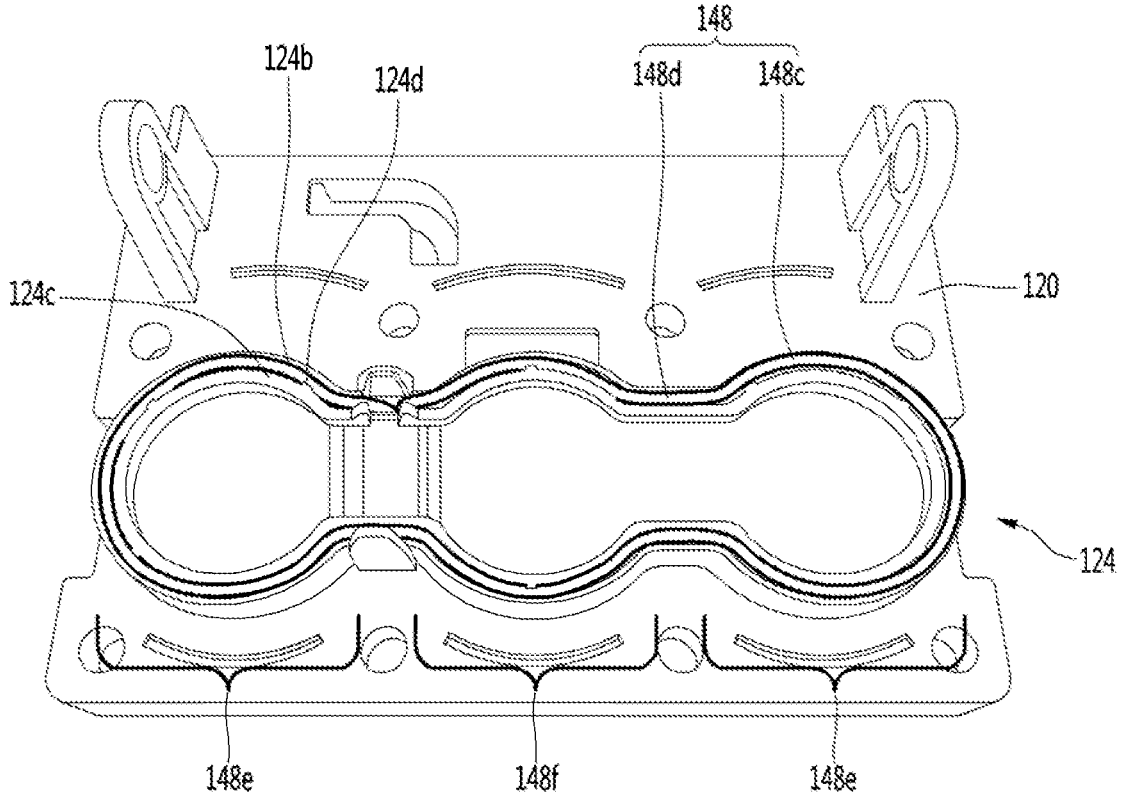
FIG. 20 is a top perspective view illustrating an example coupled state between an example heater and the upper case of FIG. 12
Figure 21:
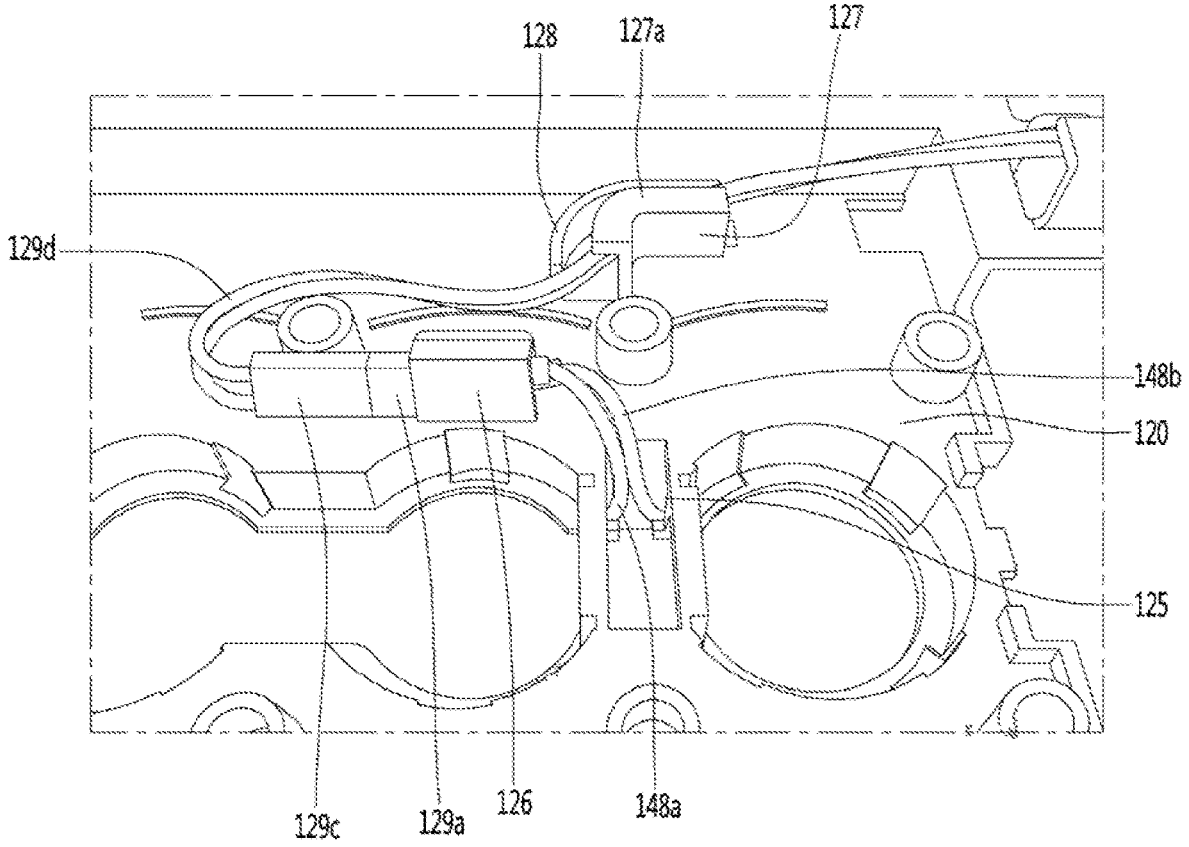
FIG. 21 is a view illustrating an example wiring of the heater.
Figure 22:
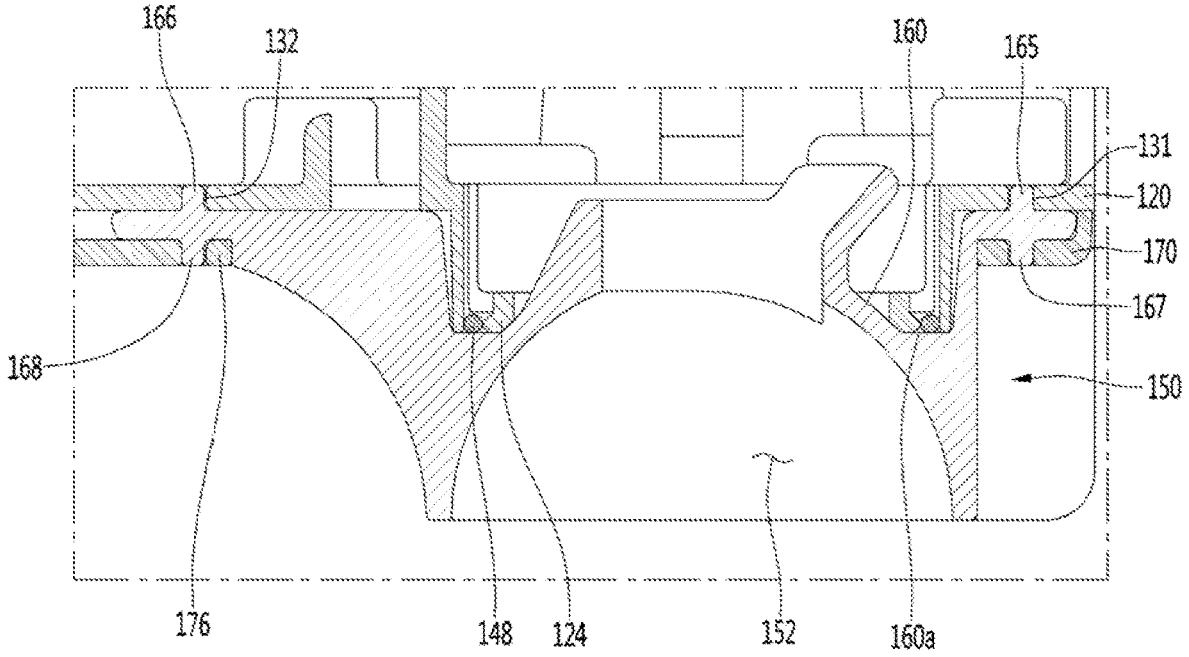
FIG. 22 is a cross-sectional view illustrating an example upper assembly of the ice maker.

Referring now to FIGS. 19-21, the heater coupling part 124, which can be provided to the upper case 120 to heat the upper tray 150 (FIG. 13), may include a heater accommodation groove 124*a* for accommodating the upper heater 148. The upper heater 148 may be a wire-type heater. Accordingly, the upper heater 148 may be bendable to correspond to a shape of the heater accommodation groove 124*a*.

In some implementations, the heater accommodation groove 124*a* may be recessed upward from a bottom surface of the recess part 122 of the upper case 120. The heater accommodation groove 124*a*, and consequently the upper heater 148 accommodated therein, may be arranged to surround an outer perimeter of the opening 123. Accordingly, the upper heater 148 may be disposed to surround the outer surface of each of the plurality of upper chambers 152 so that the heat from the upper heater 148 may be uniformly transferred to the interior of the plurality of upper chambers 152 of the upper tray 150. When the upper tray 150 is coupled to the upper case 120, the heater coupling part 124 may be inserted into the first accommodation part 160 of the upper tray 150 such that the heater 148 is positioned vertically below the upper tray openings 154.

In some implementations, as illustrated in FIGS. 19 and 20, the heater accommodation groove 124*a* may be defined between an outer wall 124*b* and an inner wall 124*c*. In some cases, the upper heater 148 that is accommodated in the heater accommodation groove 124*a* may have a diameter that is larger than heater accommodation groove 124*a* such that a portion of the upper heater 148 protrudes beyond the heater coupling part 124. By way of example, a portion of the heater 148 may extend 0.5 mm from the lowermost surface of the heater coupling part 124.

Accordingly, because the portion of the upper heater 148 protrudes to the outside of the heater accommodation groove 124*a* in the state in which the upper heater 148 is accommodated in the heater accommodation groove 124*a*, the upper heater 148 may directly contact the upper tray 150. In some cases, because the heater coupling part 124 is designed to be flush with the contacting surface of the upper tray 150, the portion of the upper tray 150 that makes contact with the protruded portion of the heater 148 may become deformed to accommodate the heater 148. In such cases, heat transfer from the heater 148 to the upper tray 150 may be improved.

In some cases, a separation prevention tab 124*d* may be provided on one or both of the outer wall 124*b* and the inner wall 124*c* to prevent the upper heater 148 accommodated in the heater accommodation groove 124*a* from being separated from the heater accommodation groove 124*a*. The separation prevention tab 124*d* may extend from one of the inner wall 124*c* and the outer wall 124*b* toward the other of the inner wall 124*c* and the outer wall 124*b*. For example, the tab 124*d* may extend to half the distance or less of the separation distance between the inner and outer walls 124*c*, 124*b* to allow the heater 148 to be inserted into the groove 124*a* during assembly but otherwise be prevented from being easily pulled out during use.

As shown in FIG. 20, the upper heater 148 may include a rounded portion 148*c* and a linear portion 148*d*. The rounded and linear shapes of the heater 148 may be defined by the corresponding shape provided by the heater accommodation groove 124*a*. In some cases, the shapes of the individual heater portions may be pre-defined.

The rounded portions 148*c* may be disposed along the circumference of the upper chamber 152 to more effectively transfer heat to the interior of the upper chamber 152. The linear portions 148*d* connect the rounded portions 148*c* and help provide heat to portions of the upper tray 150 that are not in contact with the rounded portions 148*c*.

As also shown in FIG. 20, the upper heater 148 may be divided into edge portions 148*e* and inner portions 148*f*. While FIG. 20 shows a single heating wire that surrounds the entirety of the opening 123, the edge and inner portions of the upper heater 148 may be provided by shorter heating wires that are connected together. While the illustration depicts one inner portion and two edge portions to correspond to the three upper chambers 152, a fewer or greater number of inner portions may be provided to correspond to the total number of upper chambers 152 provided.

A length of one edge portion 148*e* of the heater 148 may be greater than a length of one inner portion 148*f* of the heater 148. Because the outer upper chamber 152*a* or 152*c* that corresponds to the edge portion 148*e* may have a larger external surface area that is exposed to the cold air in the freezing compartment compared to the inner chamber 152*b* (FIG. 15) that corresponds to the inner portion 148*f*, the upper chamber 152*a*, 152*c* may be cooled more rapidly than the inner chamber 152*b*. Accordingly, by providing a longer heating element at the edge portions 148*e*, a greater amount of heat may be supplied to the outer chambers 152*a*, 152*c*, compared to the inner chamber 152*b*, thereby helping to equalize the temperature across the chambers.

In some cases, a through-opening 124*e* may be defined in a bottom surface of the heater accommodation groove 124*a*. When the upper heater 148 is accommodated in the heater accommodation groove 124*a*, a portion of the upper heater 148 may be disposed in the through-opening 124*e*. For example, the through-opening 124*e* may be defined in a portion of the upper heater 148 facing the separation prevention protrusion 124*d*. When the upper heater 148 is bent to be horizontally rounded, tension of the upper heater 148 may increase to cause disconnection, and also, the upper heater 148 may be separated from the heater accommodation groove 124*a*. However, by providing the through-opening 124*e* in the heater accommodation groove 124*a*, a portion of the upper heater 148 may be disposed in the through-opening 124*e* to reduce the tension of the upper heater 148, thereby preventing the heater accommodation groove 124*a* from being separated from the upper heater 148.

As shown in FIG. 21, a power input terminal 148*a* and a power output terminal 148*b* of the upper heater 148 may pass upward through a heater through-hole 125 defined in the upper case 120. The power input terminal 148*a* and the power output terminal 148*b* passing through the heater through-hole 125 may be connected to one first connector 129*a*. A second connector 129*c*, which is connected to two wires 129*d* that electrically connect to the power input terminal 148*a* and the power output terminal 148*b*, may be removably coupled to the first connector 129*a*.

A first guide part 126 guiding the upper heater 148, the first connector 129*a*, the second connector 129*c*, and the wire 129*d* may be provided on the upper plate 121 of the upper case 120. The first guide part 126 may extend upward from the top surface of the upper plate 121 and have an upper end that is bent in the horizontal direction. Thus, the upper bent portion of the first guide part 126 may limit an upward movement of the first connector 126.

The wires 129*d* may be led out to the outside of the upper case 120 after being bent in an approximately "U" shape to prevent interference with the surrounding structures. Since the wire 129*d* may include one or more bends, the upper case 120 may further include wire guides 127 and 128 for securing the wires 129*d*. The wire guides 127 and 128 may include a first guide 127 and a second guide 128, which are disposed to be spaced apart from each other in the horizontal direction. The first guide 127 and the second guide 128 may be bent in a direction corresponding to the bending direction of the wire 129*d* to minimize damage to the wires 129*d*. Thus, each of the first guide 127 and the second guide 128 may include a curved portion.

To limit upward movement of the wire 129*d* disposed between the first guide 127 and the second guide 128, at least one of the first guide 127 and the second guide 128 may include an upper guide 127*a* extending toward the other guide.

Referring to FIG. 15, a cross-sectional view of the upper assembly 110 in which the upper heater 148 is provided to the heater coupling part 124 of the upper case 120 is shown. As illustrated, the upper case 120, the upper tray 150, and the upper support 170 are coupled to each other to form the upper assembly 110. In this state, the first upper protrusion 165 of the upper tray 150 is inserted into the first upper slot 131 of the upper case 120. Also, the second upper protrusion 166 of the upper tray 150 is inserted into the second upper slot 132 of the upper case 120. Further, as shown, the first lower protrusion 167 of the upper tray 150 may be inserted into the first lower slot 176 of the upper support 170, and the second lower protrusion 168 of the upper tray 150 may be inserted into the second lower slot 177 of the upper support 170.

The coupling boss 175 of the upper support 170 may pass through the through-hole of the upper tray 150 to be accommodated in the sleeve 133 of the upper case 120. In this state, the screw B1 (FIG. 3A) may be coupled to the coupling boss 175 from an upper side of the coupling boss 175.

When the upper assembly 110 is assembled, the heater coupling part 124 to which the upper heater 148 is coupled may be accommodated in the first accommodation part 160 of the upper tray 150. In the state in which the heater coupling part 124 is accommodated in the first accommodation part 160, the upper heater 148 may contact a bottom surface 160*a* of the first accommodation part 160. When the upper heater 148 is accommodated in the heater coupling part 124 having the recessed shape to contact the upper tray body 151, transfer of heat from the upper heater 148 to the upper tray body 151 may be maximized.

At least a portion of the upper heater 148 may be disposed to vertically overlap the upper chamber 152 to maximize the transfer of heat from the upper heater 148 to the upper chamber 152. For example, the rounded portion 148*c* of the upper heater 148 may vertically overlap the upper chamber 152. Thus, a maximum distance between two points of the rounded portion 148*c* that are positioned at opposing sides with respect to the upper chamber 152 may be less than a diameter of the upper chamber 152.

In some implementations, the upper heater 148 may be a DC heater that receives DC power. The upper heater 148 may have a power output of 6 W or less. The upper heater 148 may be a line heater or a heat strip or the like. In some cases, a length of the heater 148 between its input/output terminals may be between 30-40 mm.

The upper heater 148 may be heated to help control the temperature within ice making chambers 111 and in particular the upper chambers 152. In some cases, the upper heater 148 may be used to temporarily heat the upper chamber 152 to thereby help remove the ice piece during the ice ejection stage. For instance, heat may be added during the ice ejection stage to slightly melt the surface of the ice to thereby promote detachment of the ice piece from the inner surface of the upper chamber 152.

Figure 23:
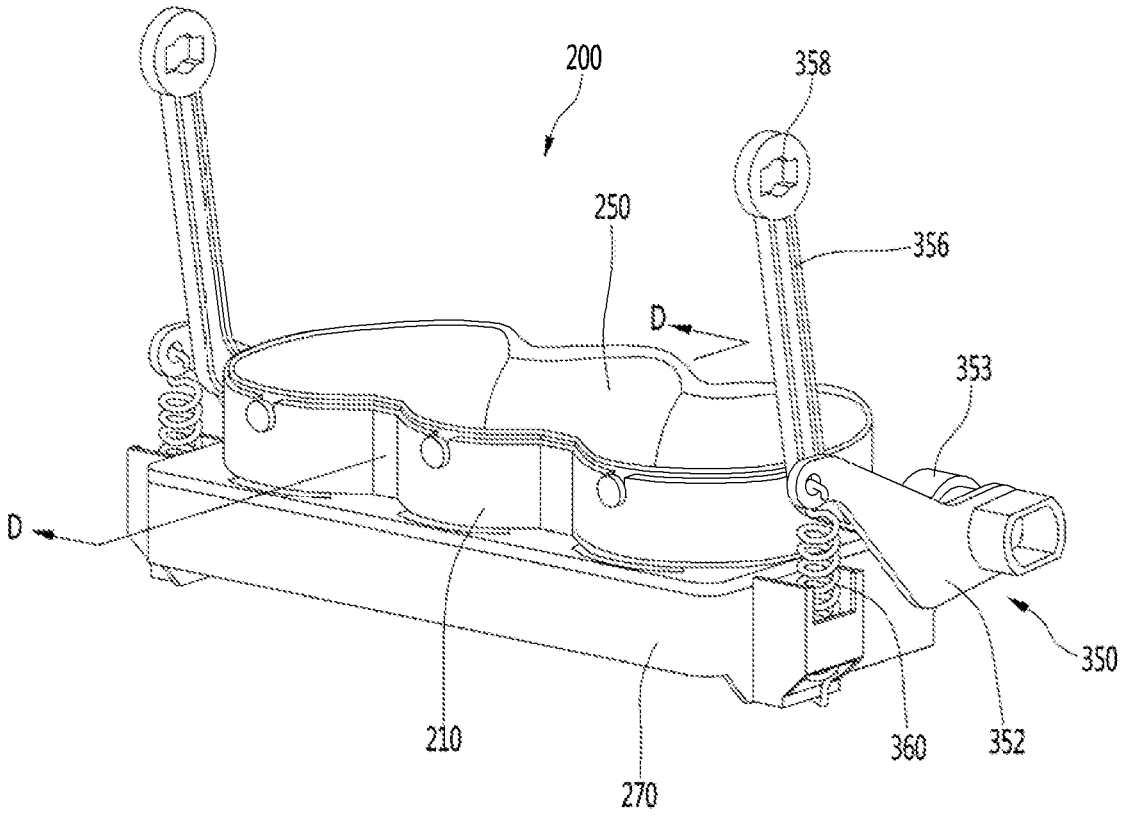
FIG. 23 is a perspective view illustrating an example lower assembly of the ice maker.
Figure 24:
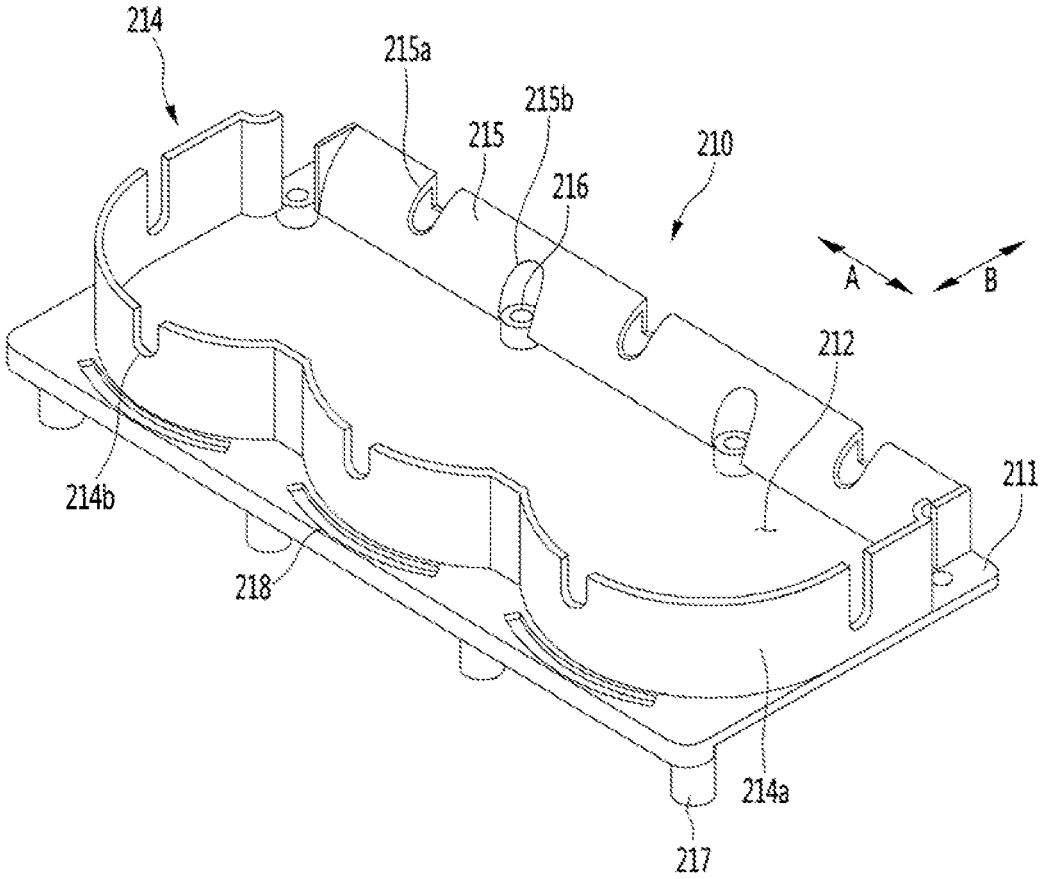
FIG. 24 is a top perspective view illustrating an example lower case of the ice maker.
Figure 25:
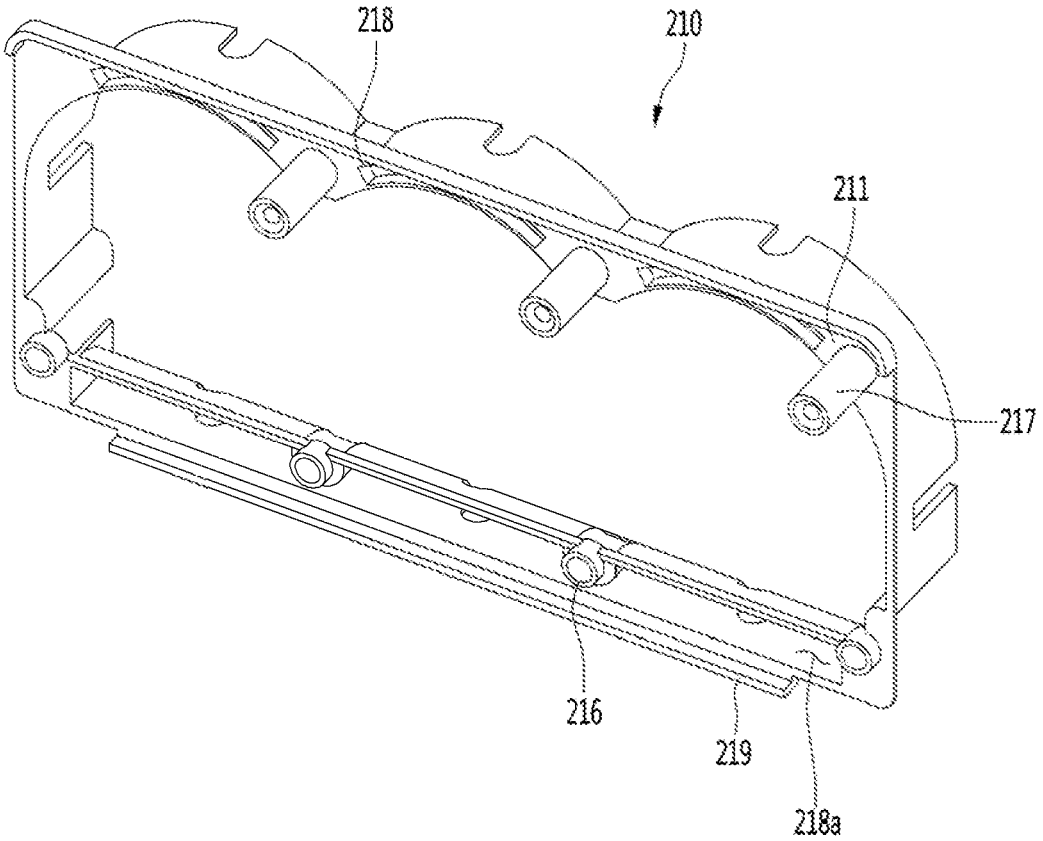
FIG. 25 is a bottom perspective view of the lower case.

Referring to FIGS. 23 to 25, the lower assembly 200 may include a lower tray 250, a lower support 270, and a lower case 210. As illustrated, the lower case 210 may surround and provide support to an upper portion of the lower tray 250, and the lower support 270 may surround and provide support to a lower portion of the lower tray 250. The lower case 210, the lower tray 250, and the lower support 270 may be coupled to each through various coupling mechanisms as further described below. In some cases, the lower support 270 may be coupled to the connection unit 350. In some cases, as shown in FIG. 23, an upper end of the lower case 210 may be coplanar with an upper end of the lower tray 250 when the lower tray 250 is inserted into and coupled to the lower case 210.

The connection unit 350 may include a first link 352 that receives torque from the driving unit 180 to allow the lower support 270 to rotate together with the first link 352 during the various ice making stages. A second link 356 may be further be connected to the lower support 270 to transfer the rotational motion of the lower support 270 to an up-down movement of the upper ejector 300.

The first link 352 and the lower support 270 may be connected to each other by an elastic member 360. For example, the elastic member 360 may be a coil spring. The elastic member 360 may have one end connected to the first link 362 and the other end connected to the lower support 270. Accordingly, when the first link 362 is rotated by the driving unit 180, the elastic member 360 may pull up on the lower support 270 to cause the lower support 270 to rotate together with the first link 362.

The elastic member 360 can provide elastic force to the lower support 270 so that contact between the upper tray 150 and the lower tray 250 may be maintained in the ice making position. For example, referring back to FIG. 6, the driving unit 180 may over-rotate the lower tray 250 toward the upper tray 150 to ensure that no gaps, which can create seams in the ice, are present between the trays. Such an over-rotation step may be needed because stopping the driving unit 180 immediately upon contact between the upper and lower trays 150, 250 may still leave some gaps between the two trays. By over-rotating the driving unit 180, and subsequently the first link 352, by a small angle, e.g. 1 degree, after the initial contact, the gaps between the two trays may be eliminated. Further, because the lower tray 250 is connected to the first link 352 via the elastic member 360, the lower tray may stop rotating once the lower tray 250 has been sufficiently compressed toward the upper tray 150 to eliminate any gaps therebetween. Even if the first link 352 continues to be additionally rotated beyond this point, the elastic member 360 can become stretched to thereby prevent the lower tray 250 from also being additionally rotated. Accordingly, additional stresses to the driving unit 180 and other components may be reduced.

In some cases, an overall height of the ice making chamber 111 may be decrease as a result of the over-rotation and subsequent compression between the trays. A stiffness the elastic member 360 may determine the amount of compression. For example, a stiff spring may cause greater compression compared to a less stiff spring.

As shown in FIG. 23, the first link 352 and the second link 356 may be disposed on both sides of the lower support 270. One or both of the first links 352 on either end may be driven by the driving unit 180. As shown in FIG. 4, the two opposing first links 352 may be connected to each other via a connection shaft 370 that can transmit torque from one link to the other. A hole 358 through which the ejector body 310 and the retaining member 312 of the upper ejector 300 can pass through may be defined in an upper portion of the second link 356.

Referring specifically to FIGS. 24 and 25, the lower case 210 may include a lower plate 211 that is configured to couple to the lower tray 250. For example, an upper surface of the lower tray 250 may contact and become attached to a bottom surface of the lower plate 211.

An opening 212, through which a portion of the lower tray 250 can pass, may be defined in the lower plate 211. For example, when an surface of the lower tray 250 is attached to a bottom surface of the lower plate 211, an upper portion of the lower tray 250 may protrude upward through the opening 212.

The lower case 210 may further include a circumferential wall 214 that extends around a periphery of the opening 212 and that is configured to provide support to the portion of the lower tray 250 that passes upward through the opening 212.

In some implementations, the circumferential wall 214 may include a vertical wall 214*a* and a curved wall 215. The vertical wall 214*a* may extend vertically upward from the lower plate 211 to surround a corresponding vertical portion of the upper tray 250. The curved wall 215 also extends generally upward from the lower plate 211 but further includes a curved surface that curves away from the opening 212. The curved portion of the curved wall 215 is designed to support a corresponding curved portion of the upper tray 250.

In some cases, the vertical wall 214*a* may include a first coupling slit 214*b* coupled to the lower tray 250. The first coupling slit 214*b* may be recessed downward from an upper end of the vertical wall 214*a*. The curved wall 215 may include a second coupling slit 215*a* that is recessed downward from an upper end of the curved wall 215.

The lower case 210 may further include a first coupling boss 216 and a second coupling boss 217. The first coupling boss 216 may protrude downward from the bottom surface of the lower plate 211. In some cases, a plurality of first coupling bosses 216 may protrude downward from the lower plate 211. The plurality of first coupling bosses 216 may be arranged to be spaced apart from each other in the direction of the arrow A.

The second coupling boss 217 may protrude downward from the bottom surface of the lower plate 211. In some cases, a plurality of second coupling bosses 217 may protrude from the lower plate 211. The plurality of first coupling bosses 217 may be arranged to be spaced apart from each other in the direction of the arrow A.

The first coupling boss 216 and the second coupling boss 217 may be disposed to be spaced apart from each other in the direction of the arrow B. As depicted in FIG. 24, a length of the first coupling boss 216 and a length of the second coupling boss 217 may be different from each other. For example, the first coupling boss 216 may have a length that is shorter than that of the second coupling boss 217.

A first coupling member may be coupled to the first coupling boss 216 at an upper portion of the first coupling boss 216. A second coupling member may be coupled to the second coupling boss 217 at a lower portion of the second coupling boss 217. A groove 215*b* may be defined in the curved wall 215 to prevent the first coupling member from interfering with the curved wall 215 when the first coupling member is coupled to the first coupling boss 216.

The lower case 210 may include a slot 218 that is configured to allow coupling between the lower case 210 and the lower tray 250. For example, a corresponding portion of the lower tray 250 may be inserted into the slot 218. The slot 218 may be disposed adjacent to the vertical wall 214*a*.

In some cases, a plurality of slots 218 may be defined to be spaced apart from each other in the direction of the arrow A. Each of the slots 218 may have a curved shape.

The lower case 210 may further include an accommodation groove 218*a* into which a portion of the lower tray 250 is inserted. The accommodation groove 218*a* may be defined by recessing a portion of the lower tray 250 toward the curved wall 215.

The lower case 210 may further include an extension wall 219 for contacting a portion of the circumference of the side surface of the lower plate 211 when it is coupled to the lower tray 250. The extension wall 219 may extended in a linear direction along the direction of the arrow A.

Referring to FIGS. 26 to 29. the lower tray 250, which may be made from a flexible material such as silicone, defines the lower portion of the plurality of ice making chambers 111, namely the lower chambers 252. In some cases, the lower tray 250 may be made from a silicone material or other similar material that is more flexible than the material used to make the upper tray 150.

Accordingly, the lower tray 250 may be restored to its original shape even after being repeatedly deformed during the ice ejection stage to remove the ice pieces from within. Thus, the desired ice shape, for example spherical ice, may be repeatedly formed without substantial variation between ice cycles. Silicone may further be useful due to its ability to withstand extreme temperature variations without deformation.

In one implementation, the lower tray 250 may include a lower tray body 251, a retaining wall 260, and a horizontal extension part 254. The retaining wall 260 may extend generally upward from the top surface of the lower tray body 251, and the horizontal extension part 254 may extend horizontally outward from an interface between the lower tray body 251 and the retaining wall 260. The lower tray body 251 defines one or more chambers 252 that forms the lower half of the ice chambers 111. For example, for spherical ice, the lower chambers 252 may be generally hemispherical in shape. For example, lower chambers 252*a*, 252*b*, and 252*c* shaped for forming spherical ice pieces may be defined within the lower tray body 251. In particular, the lower chambers may be defined by chamber walls 252*d* that are part of the lower tray body 251.

The lower tray body 251, the retaining wall 260, and the horizontal extension part 254 may be provided as a single, integrated piece, for example by being molded together. Accordingly, all three components can be made from the same flexible material. In some cases, a subset of these components may be formed separately and attached together, for example through adhesives or other bonding techniques. For example, the retaining wall 260 and the lower tray body 251 may be formed separately and subsequently attached together, with the horizontal extension part 254 having been formed together with either the retaining wall 260 or the lower tray body 251. In some cases, the retaining wall 260 and the lower tray body 251 may be formed together as a single piece, with the horizontal extension part 254 being a separate component that is later attached. Different types of materials may be used for the individual components, for example, depending on the particular structural requirements of each.

The lower tray 250 may further include a first extension part 253 between the chamber walls 252*d* and the horizontal extension part 254. The first extension part 253 may be extended along an outer perimeter of the lower tray body 251.

As explained above with respect to FIG. 5, the retaining wall 260 of the lower tray 250 extends upward from the lower tray body 251 to help retain an additional volume of water above the lower chambers 252. In particular, supplied water for filling the upper chambers 152 can be initially held within the retaining wall 260 and later pushed up into the upper chambers 152 based on the closing of the lower tray 250 as explained above with respect to FIGS. 5 to 9.

In more detail, with reference to FIGS. 26 to 29, the retaining wall 260 generally extends in a vertically upward orientation from the upper surface 251*e* of the lower tray body 251. An opening defined by the lower edge of the retaining wall 260 may be larger than the opening defined by the chamber walls 252*d* at the upper surface 251*e* of the lower tray body 251. Accordingly, a circumferential ledge may be provided around the opening of the lower tray body 251. When the upper tray 150 and the lower tray 250 are brought together, as shown in FIG. 30, during the ice making stage, the bottom surface of the upper tray body 151 makes sealing contact with the circumferential ledge to thereby create fully-formed ice chambers 111 inside the upper and lower tray bodies 151 and 251. The diameter of the chamber opening defined at the upper surface 251*e* of the lower tray body 251 may be equal to the diameter of the chamber opening defined at the lower surface 151*e* of the upper tray body 151 such that, when the upper and lower trays are brought together, the interior surfaces of the two tray bodies are flush with each other. In this state, the retaining wall 260 may surround the upper tray body 151 as seen in FIG. 30.

The retaining wall 260 may include a vertical portion 260*a* and a curved portion 260*b*. The vertical portion 260*a* and the curved portion 260*b* of the lower tray's retaining wall 260 are configured to conform to and surround, respectively, the vertical portion 153*a* and the curved portion 153*b* of the upper tray's chamber wall 153 (FIG. 16). Thus, the vertical portion 260*a* may be extended vertically upward from the lower tray body 251, and the curved portion 260*b* may be curved away from the lower chamber 252 and toward the rotation axis cl. The curvature of the curved portion 260*b* may be substantially identical to the curvature of the curved portion 153*b* such that, when the upper and lower trays are brought together, a water escape passage having a constant thickness may be defined between the outer surfaces of the two curved portions 260*b* and 153*b*.

The horizontal extension part 254 may extend laterally outward from an interface region between the retaining wall 260 and the lower tray body 251 to define an overall footprint of the lower tray 250.

The lower tray 250 may include various coupling features to help couple the lower case 210, the lower tray 250, and the lower support 270 to each other in a vertically aligned configuration.

For example, the horizontal extension part 254 may include a first upper protrusion 255 that is configured to be inserted into the corresponding slot 218 of the lower case 210. The first upper protrusion 255 may be formed around the retaining wall 260 in a spaced apart manner and can help restrict a lateral movement and/or deformation of the horizontal extension part 254 relative to the lower case 210 during the ice making and/or the ice ejection process. In some cases, the first upper protrusion 255 may protrude upward from a top surface of the horizontal extension part 254 at a position adjacent to the vertical portion 260*a*.

In some implementations, a plurality of first upper protrusions 255 may be arranged to be spaced apart from each other in the direction of the arrow A. The first upper protrusion 255 may have a curved shape to increase a length of coupling between the protrusion 255 and the slot 218.

Figure 32:
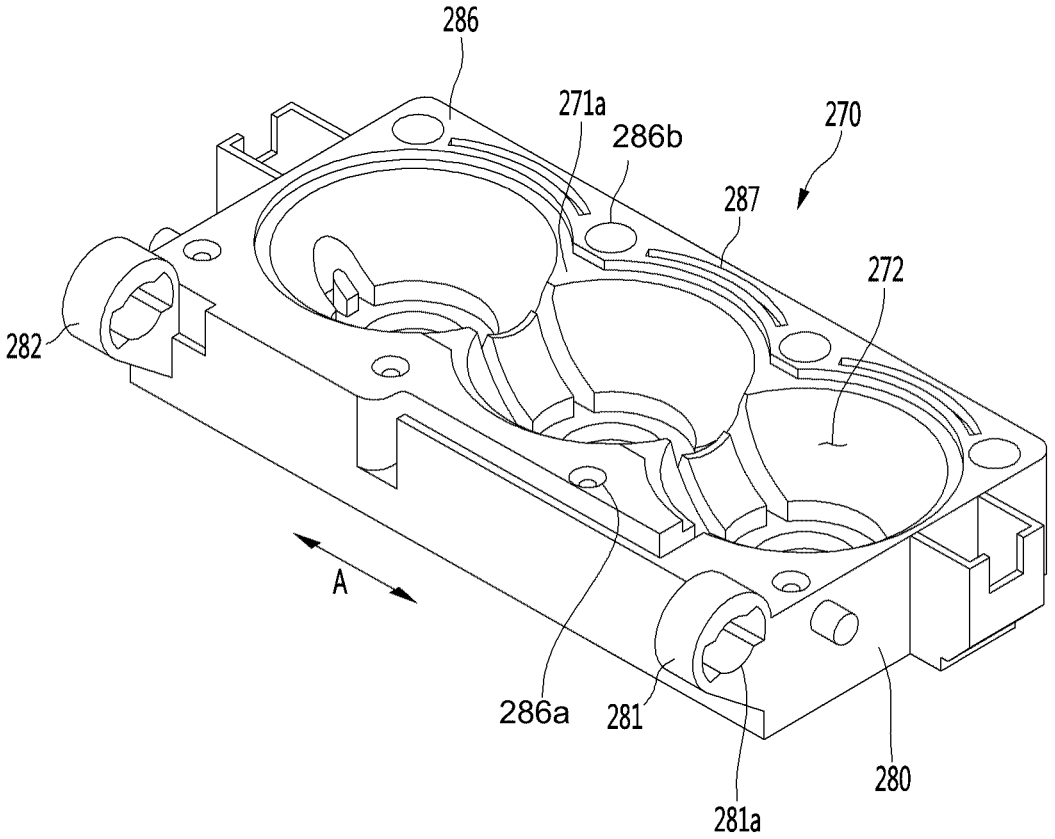
FIG. 32 is a top perspective view illustrating an example lower support of the ice maker.

The horizontal extension part 254 may include a first lower protrusion 257 that is configured to be inserted into a corresponding protrusion groove 287 of the lower support 270 (FIG. 32). The first lower protrusion 257 may protrude downward from a bottom surface of the horizontal extension part 254. In some cases, the plurality of first lower protrusions 257 may be arranged to be spaced apart from each other in the direction of arrow A.

The first upper protrusion 255 and the first lower protrusion 257 may be positioned opposite to each other with respect to the horizontal extension part 254. Accordingly, at least a portion of the first upper protrusion 255 may vertically overlap the second lower protrusion 257.

Many other types of coupling structures may be provided to the lower tray 250. As another example, a plurality of through-holes 256 may be defined in the horizontal extension part 254. The plurality of through-holes 256 may include a first through-hole 256*a* that is configured to receive the first coupling boss 216 of the lower case 210 and a second through-hole 256*b* that is configured to receive the second coupling boss 217 of the lower case 210.

Figure 26:
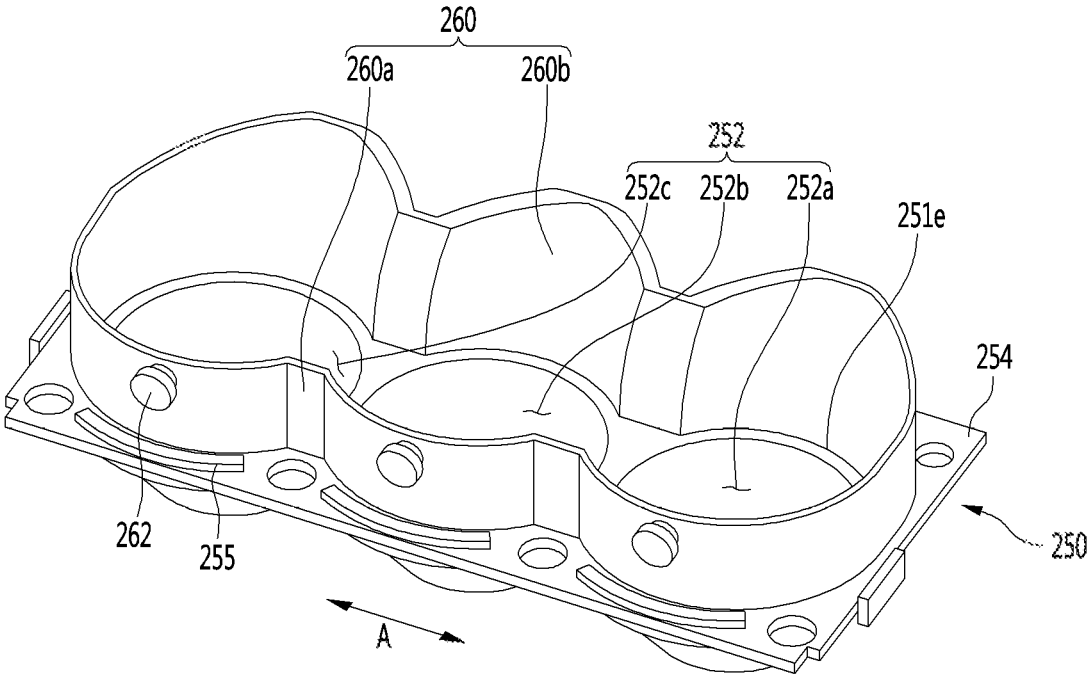
FIG. 26 is a top perspective view illustrating an example lower tray of the ice maker.
Figure 27:
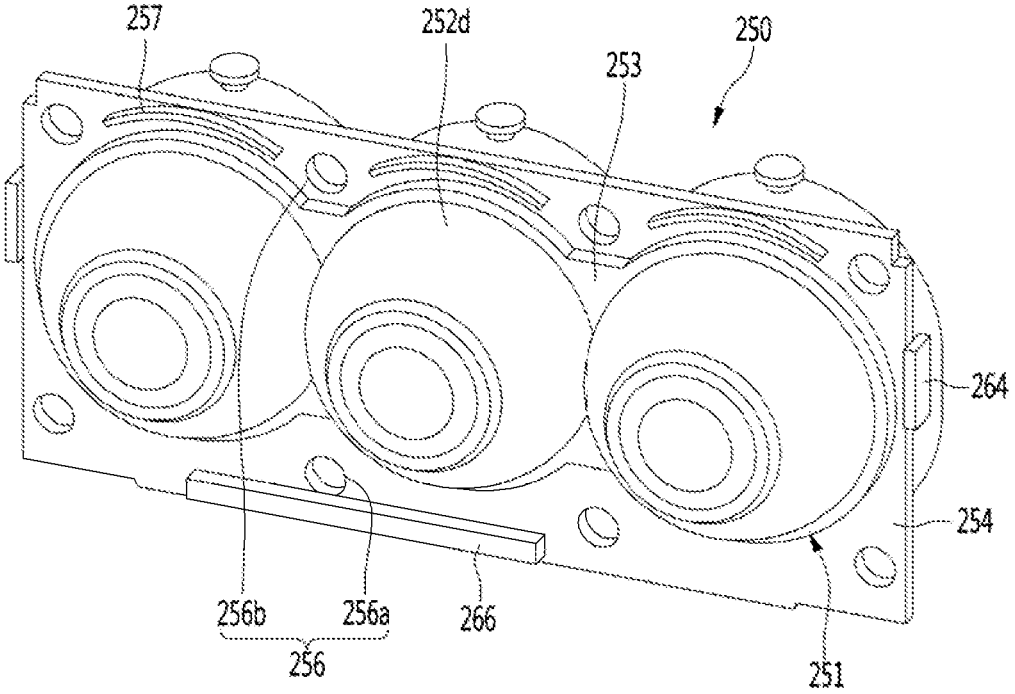
FIGS. 27 and 28 are bottom perspective views of the lower tray.

In some implementations, the plurality of through-holes 256*a* may be spaced apart from each other in the direction of the arrow A (FIG. 26). Similarly, the plurality of second through-holes 256*b* may be spaced apart from each other in the direction of the arrow A. In some cases, the plurality of first through-holes 256*a* and the plurality of second through-holes 256*b* may be disposed at opposite sides of the horizontal extension part 254 with respect to the lower chamber 252.

A portion of the plurality of second through-holes 256*b* may be positioned between adjacent ones of the first upper protrusions 255. Also, a portion of the plurality of second through-holes 256*b* may be positioned between adjacent ones of the first lower protrusions 257.

The horizontal extension part 254 may also include one or more second upper protrusions 258 (FIG. 29) that are positioned opposite the first upper protrusions 255 with respect to the lower chamber 252.

In some cases, the second upper protrusion 258 may be formed to extend alongside the curved portion 260*b* in a spaced apart manner and can help restrict a lateral movement and/or deformation of the horizontal extension part 254 relative to the lower case 210. The second upper protrusion 258 may protrude upward from a top surface of the horizontal extension part 254 at a position adjacent to the curved portion 260*b*. In some cases, the plurality of second upper protrusions 258 may be arranged to be spaced apart from each other in the direction of the arrow A (FIG. 26). The second upper protrusion 258 may be accommodated in the corresponding accommodation groove 218*a* of the lower case 210 (FIG. 25). In some cases, when the lower tray 250 is coupled to the lower case 210, the second upper protrusions 258 may be accommodated within the curved wall 215 of the lower case 210 (FIG. 24).

In some implementations, the retaining wall 260 of the lower tray 250 may include one or more first coupling protrusions 262 that are configured to couple the retaining wall 260 to the lower case 210. In some cases, each of the first coupling protrusions 262 may be button-like structures that protrude laterally from the vertical portion 260*a* of the retaining wall 260. In particular, the first coupling protrusion 262 may be disposed on an upper portion of an outward facing surface of the vertical portion 260*a*.

The first coupling protrusion 262 may include a neck part 262*a* having a smaller diameter compared to the remaining portion of the protrusion 262. In use, the neck part 262*a* may be inserted into a first coupling slit 214*b* that is defined in the circumferential wall 214 of the lower case 210 to couple the retaining wall 260 to the lower case 210. Once secured, a portion of the circumferential wall 214 may be positioned between an inner surface of the first coupling protrusion 262 and an outer surface of the vertical portion 260*a*. In some cases, the uppermost portion of the first coupling protrusion 262 may be coplanar with the uppermost edge of the vertical portion 260*a* of the retaining wall 260.

Figure 28:
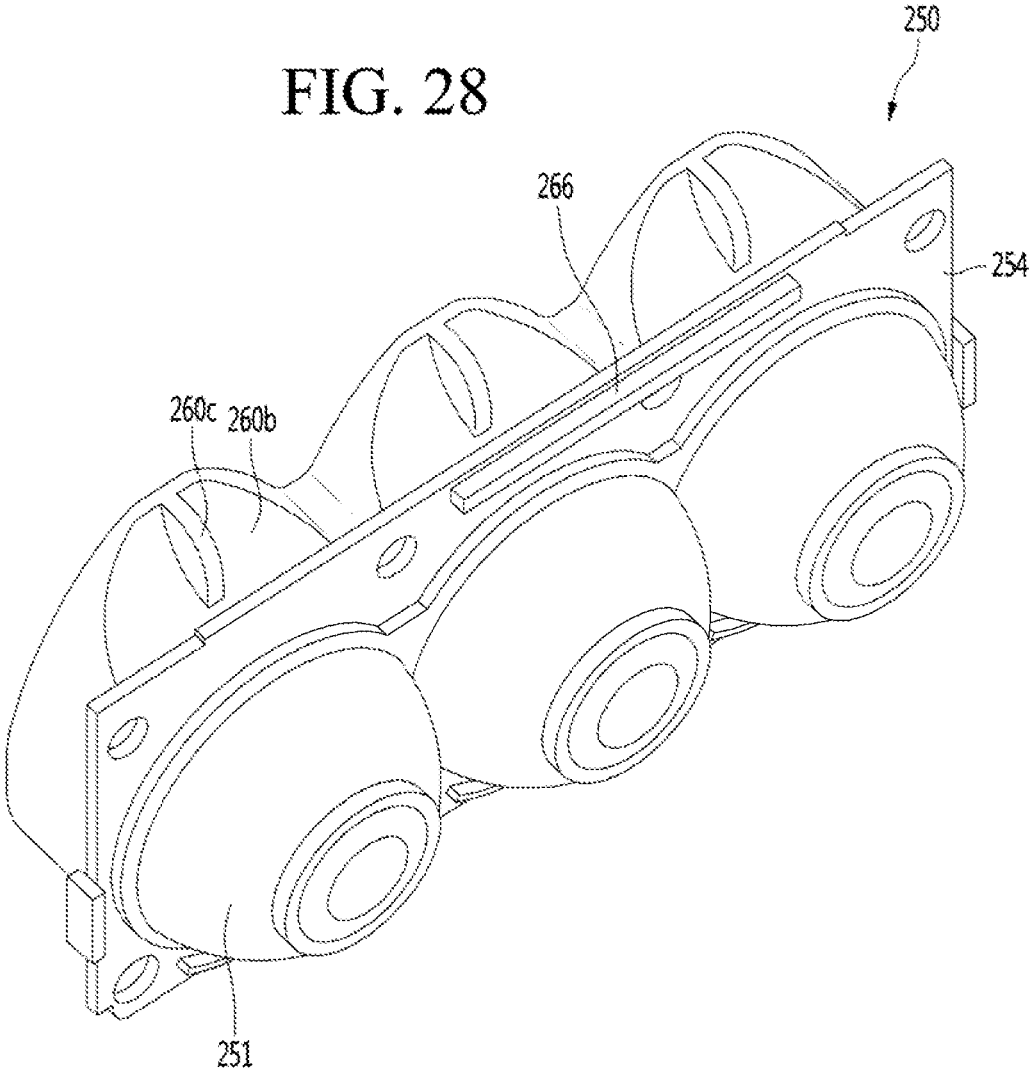
Figure 29:
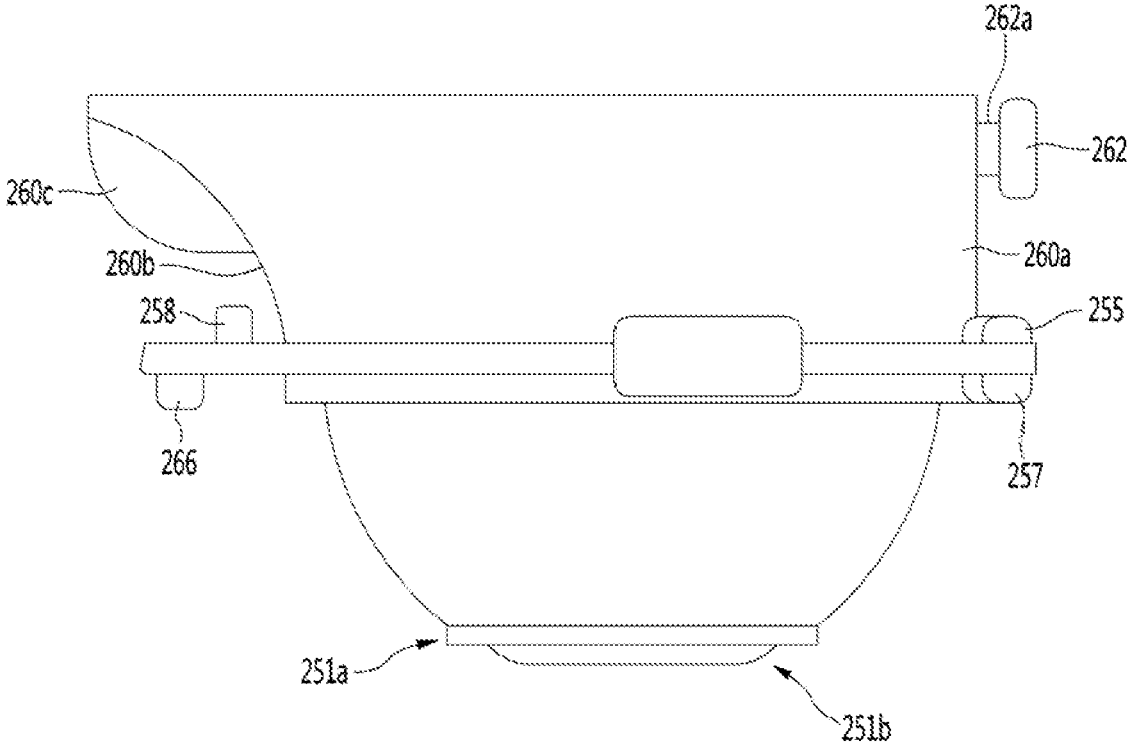
FIG. 29 is a side view of the lower tray.
Figure 30:
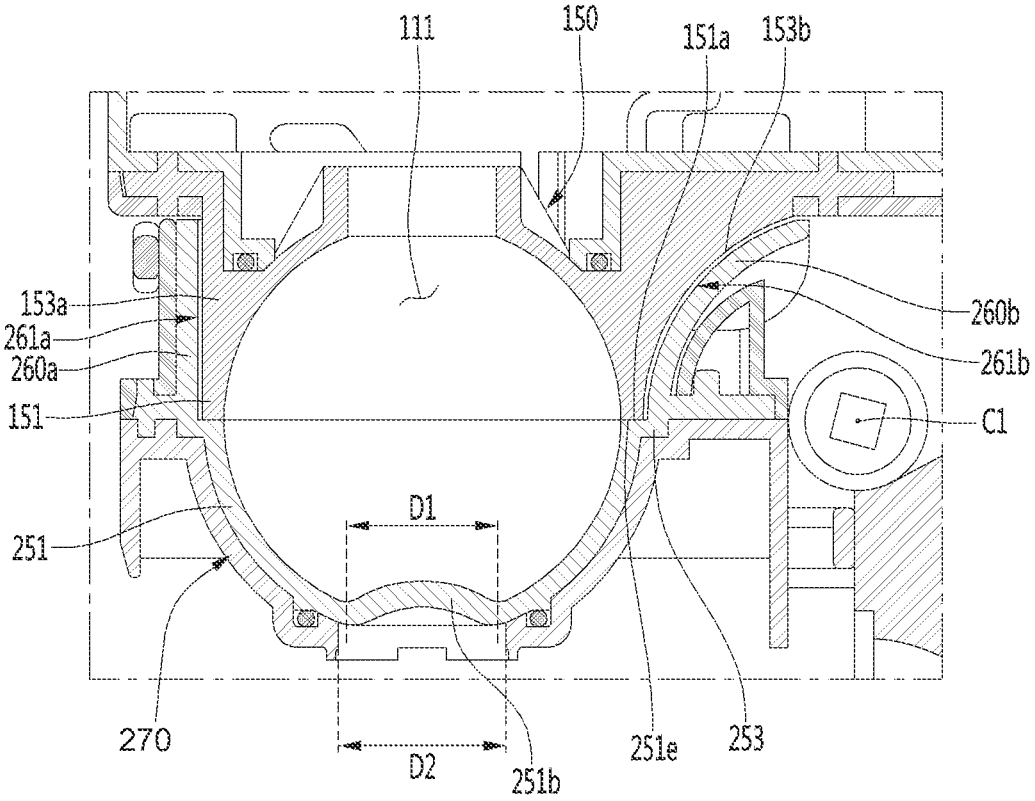
FIG. 30 is a cross-sectional view taken along line A-A of FIG. 3A illustrating a pre-frozen state of an example ice piece.

In some cases, as shown in FIGS. 28 and 29, the retaining wall 260 may further include one or more second coupling protrusions 260*c* that are configured to couple the retaining wall 260 to the lower case 210.

The second coupling protrusion 260*c* may protrude laterally from the curved portion 260*b* of the retaining wall 260 and be configured to be inserted into a corresponding a second coupling slit 215*a* that is defined in the circumferential wall 214 of the lower case 210. By providing coupling between the curved portion 260*b* of the lower tray 250 and the circumferential wall 214 of the lower case 210, the curved shape of the curved portion 260*b* may be maintained during rotation of the lower assembly 200. Alternatively, or additionally, the curved portion 260*b* of the lower tray 250 may be made thicker compared to the remaining portions of the retaining wall 260 for increased stiffness.

In some implementations, the horizontal extension part 254 may include a second lower protrusion 266. The second lower protrusion 266 may be disposed at an opposite side of the second lower protrusion 257 with respect to the lower chamber 252. The second lower protrusion 266 may protrude downward from a bottom surface of the horizontal extension part 254 and be linearly extended along an outer edge of the horizontal extension part 254. One or more of the plurality of first through-holes 256*a* may be defined between the second lower protrusion 266 and the lower chamber 252. When the lower tray 250 is coupled to the lower support 270, the second lower protrusion 266 may be accommodated within a corresponding guide groove that is defined in the lower support 270 (FIG. 32).

In some cases, the horizontal extension part 254 may further a side restriction part 264. The side restriction part 264 may be configured to restrict a horizontal movement of the lower tray 250 when it is coupled to the lower case 210 and the lower support 270.

The side restriction part 264 may protrude laterally from the horizontal extension part 254 and can have a vertical length greater than a thickness of the horizontal extension part 254. Thus, an upper portion of the side restriction part 264 may contact a side surface of the lower case 210, and its lower portion may contact a side surface of the lower support 270.

Figure 31:
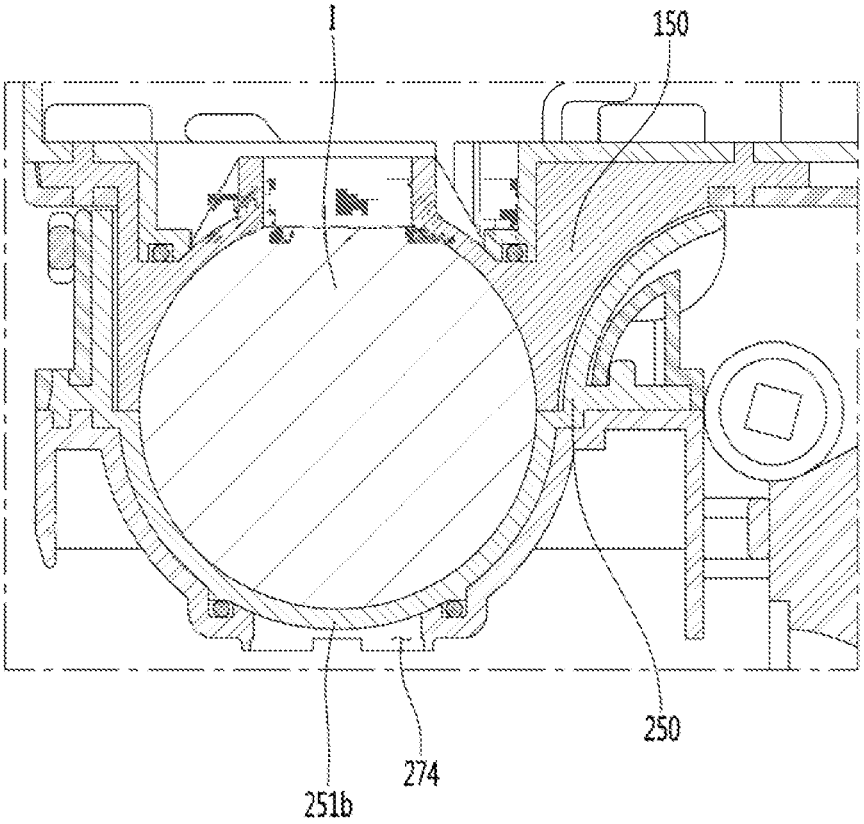
FIG. 31 is a cross-sectional view taken along line A-A of FIG. 3A illustrating a frozen state of the ice piece.

Referring to FIGS. 30 and 31, when the upper tray 150 and the lower tray 250 are brought together, for example during the ice making stage, the upper chamber 152 and the lower chamber 252 come in contact with each other to form a complete ice chamber 111 that defines, for instance, a spherical shape of the ice piece to be generated. Specifically, the bottom surface 151*a* of the upper tray body 151 contacts the upper surface 251*e* of the lower tray body 251. As described above, when the upper and lower trays are brought together in this manner, additional elastic force may be applied by the elastic member 360 to further compress the two tray bodies toward each other, thereby helping to eliminate gaps between the two tray bodies.

When the lower assembly 200 and the upper assembly 110 are brought together as shown in FIG. 30, a first water escape passage 261*a* may be defined between a vertical portion 153*a* of the upper tray 150 and a vertical portion 260*a* of the lower tray 250. Similarly, a second water escape passage 261*b* may be formed between a curved portion 153*b* of the upper tray 150 and a curved portion 260*b* of the lower tray 250.

The first water escape passage 261*a* may be formed by configuring an outer surface of the vertical portion 153*a* to be spaced apart from an inner surface of the vertical portion 260*a* when the retaining wall 260 surrounds the chamber wall 153 (e.g. in the ice making stage). The second water escape passage 261*b* may be formed by configuring an outer surface of the curved portion 153*b* of the upper tray 150 to be spaced apart from an inner surface of the curved portion 260*b* of the lower tray 250 when the retaining wall 260 surrounds the chamber wall 153 (e.g. in the ice making stage).

By way of example, the first and water escape passages 261*a*, 261*b* may be between 1 to 2 mm in thickness. In some cases, the first and water escape passages 261*a*, 261*b* may have a thickness of less than 1 mm. In some cases, the thickness may be less than 0.5 mm.

Referring also to FIGS. 5 to 9, when the water retained within the retaining wall 260 is pushed up to fill the upper chambers 252 by the upward rotation of the lower assembly 200, excess water may flow into the water escape passages 261*a*, 261*b*. That is, excess water maybe guided away from the ice making chamber 111 through the water escape passages 261*a*, 261*b* instead of overflowing through the upper tray openings 154. Excess water in the water escape passage 261*a*, 261*b* may flow out into the freezer. Alternatively, or additionally, thin pieces of ice that form within the water escape passages 261*a*, 261*b* may break up and fall out based on the back and forth movement of the lower assembly 200.

In some cases, the uppermost portion of the retention wall 260 may be positioned vertically higher than the upper tray openings 154.

With reference to FIGS. 29 to 31, the lower portion of the lower tray body 251 includes a stepped portion 251*a* and a deformable portion 251*b*. In some cases, the stepped portion 251*a* may surround a circumference of the deformable portion 251*b*.

Figure 36:
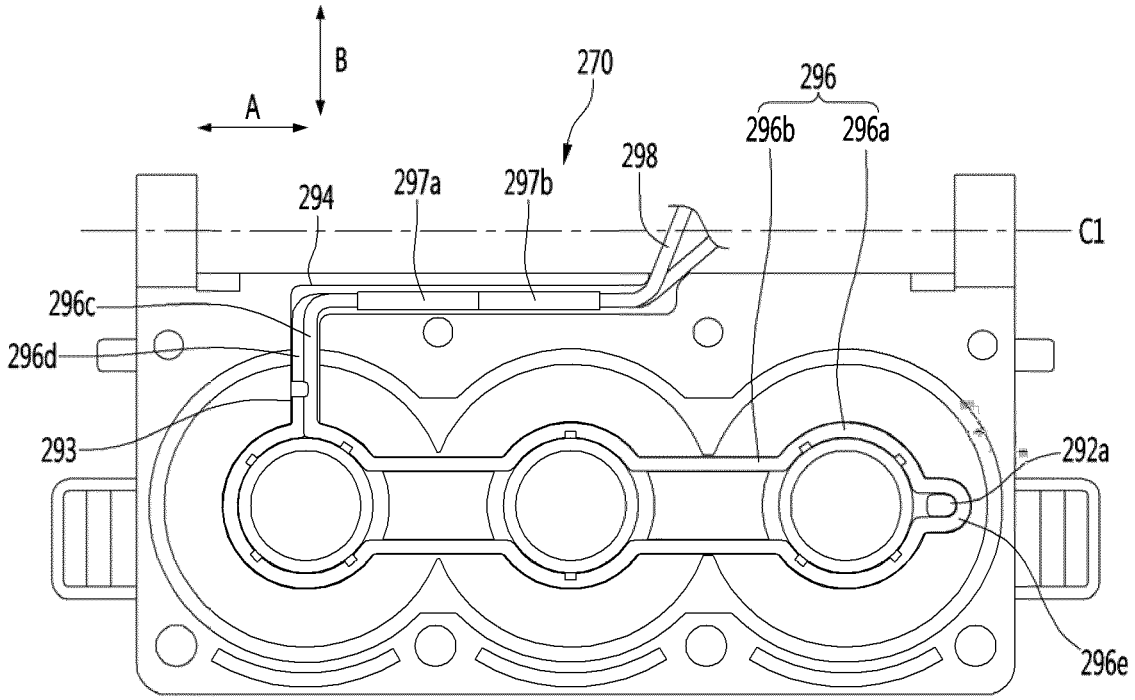
FIG. 36 is a perspective view illustrating an example coupling between a lower heater the lower support of FIG. 35.

The stepped portion 251*a* may be in a ring shape and is protruded downward from the lower tray body 251. A lower surface of the stepped portion 251*a* may be flat and can provide a heater contact surface for a lower heater 296 (FIG. 36). The stepped portion 251*a* may be positioned at any height around the circumference of the lower tray body 251. In some implementations, in order to provide heat to a lower portion of the chamber 252 during the ice making process, the stepped portion 251*a* may be positioned at a height that is below the halfway point of the height of the lower chamber 252. In some cases, the stepped portion 251*a* may be positioned at the lowermost portion of the lower tray body 251. In some cases, as illustrated in FIG. 29, only the deformable portion 251*b* of the lower tray body 251 may be positioned below the stepped portion 251*a*. An inner diameter of the stepped portion 251*a* may be larger than a diameter of the ejector pin 320 such that the ejector pin 320 can pass through the stepped portion 251*a* during the ice ejection stage.

The deformable portion 251*b* may change from a first shape to a second shape during the ice generation process. For example, as shown in FIG. 30, the deformable portion 251*b* may have a convex shape (i.e. first shape) before ice is formed within the ice chamber 111; however, after the ice I is formed within the ice chamber 111, outward expansion of the ice I may exert an outward force on the deformable portion 251*b* to change the convex shape to a concave shape (i.e. second shape).

A recess part 251*c* may be defined at a lower surface of the deformable portion 251*b* to allow the deformable portion 251*b* to more readily transition from the first shape to the second shape. For example, due to the presence of the recess part 251*c*, the deformable portion 251*b* may have a uniform thickness across its entire before and after the shape change. In some cases, the recess part 251*c* may reduce a thickness of the deformable portion 251*b* relative to the remaining portions of the lower tray body 251 to thereby increase flexibility of the deformable portion 251*b*. Accordingly, the deformable portion 251*b* may be able to more easily transition between the first and second shapes. By adjusting the thickness or, in some cases, the material properties of the deformable portion 251*b*, the amount of expansion force required to transition from the first shape to the second shape may be adjusted.

By including an appropriately designed deformable portion 251*b* to the lower chamber 252, the desired final shape of the ice generated within the ice chamber 111 may be achieved. Notably, because water expands when phase-changed into solid ice, the shape of the ice chamber 111 itself may change as the water expands and turns into ice. For instance, a spherical chamber into which water is supplied may expand and become distorted when the water contained inside freezes. This is especially true in ice maker configurations in which the top portion of the chamber may be colder than the bottom portion of the chamber, thus causing the water to freeze starting from the top and moving down (see FIG. 42). In such cases, the expansion/distortion of the ice chamber 111, which is made of a flexible material, may largely be localized to the lowermost portion of the chamber that freezes last. Consequently, the lowermost portion of the ice formed inside such a chamber may include a nipple-like protrusion.

In contrast, by including the deformable portion 251*b* at the lowermost portion of the chamber 111, the anticipated expansion of the ice in that region can be accounted for. For example, by including a convex deformable portion at the lower part of the lower chamber 252, a localized expansion of ice in that region can cause the convex portion to become concave, thus transforming the shape of the lower chamber 252 to be closer to the desired hemispherical shape. In turn, a more hemispherical lower portion of the ice can lead to a more spherical shape overall.

The shape and location of the deformable portion 251*b* may be adjusted depending on the specific location and size of the expected region of expansion/deformation.

Figure 33:
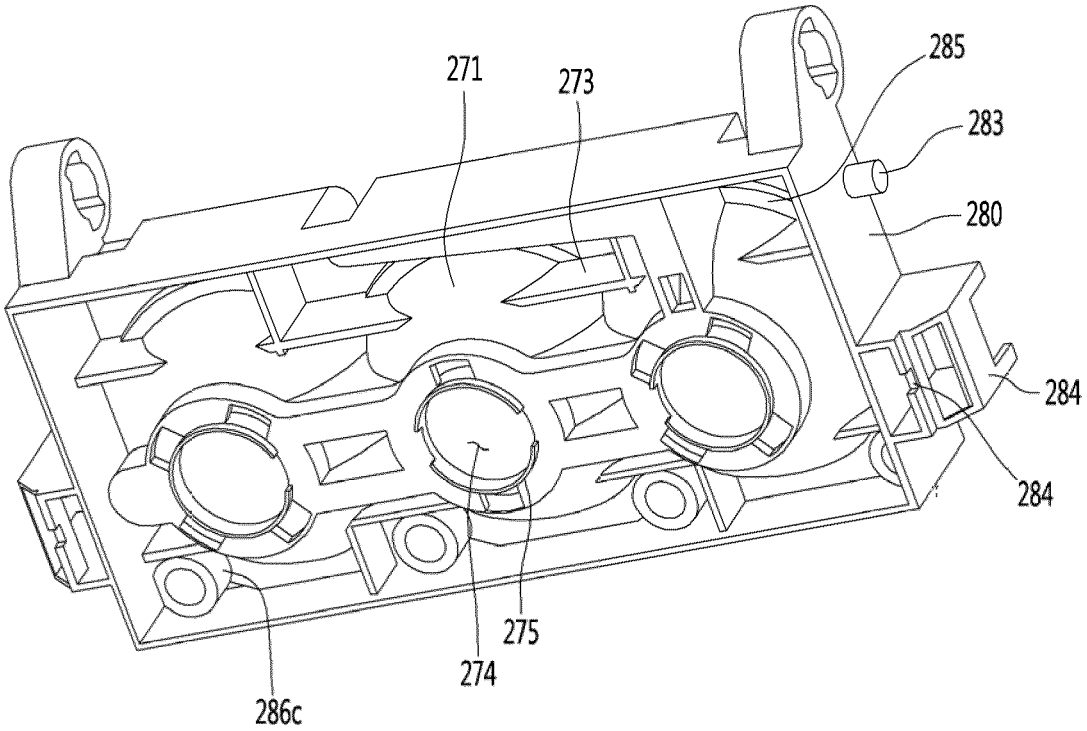
FIG. 33 is a bottom perspective view of the lower support.
Figure 34:
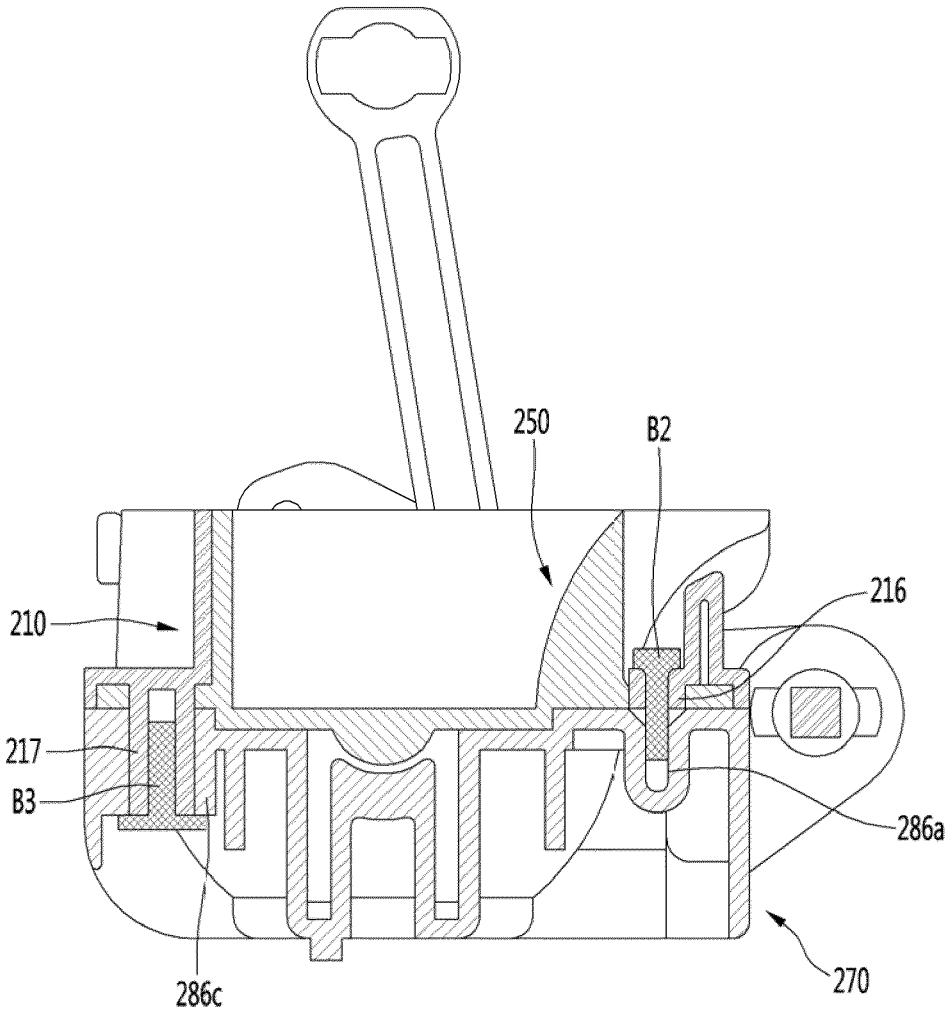
FIG. 34 is a cross-sectional view taken along line D-D of FIG. 23 illustrating the example lower assembly in an assembled state.

Referring now to FIGS. 32 to 34, the lower support 270 of the lower assembly 20 may include a support body 271 that is configured to provide support to the lower tray 250. In particular, the support body 281 may define three chamber accommodation portions 272 that are configured to surround and provide support to corresponding chamber walls 252*d* of the lower tray body 251. For example, if the lower tray body 251 has a generally hemispherical shape that is defined by the chamber walls 252*d*, then the chamber accommodation portion 272 may be shaped correspondingly to have a hemispherical shape. Accordingly, the lower support 270 can help prevent an outward expansion of the lower tray body 251, for example during ice generation when outward expansion forces can act on the lower tray body 251. The lower support 270 can be made from plastic or other similar materials that may be more rigid than the lower tray body 251.

The support body 271 may define one or more openings 274 through which the lower ejector 400 can pass during the ice ejection stage. For example, three lower openings 274 may be defined to correspond to the three chamber accommodation parts 272 in the support body 271. Referring also to FIGS. 30 and 31, the lower openings 274 can provide space through which the deformable portion 251*b* of the lower tray body 251 can expand outward. That is, while the remaining portions of the chamber accommodation portion 272 serve to constrain the contacted portions of the lower tray body 251 from expanding outward, the lower opening 274 may overlap with the deformable portion 251*b* to allow a change from the first shape (e.g., convex shape) to a second shape (e.g., concave shape). Accordingly, as shown in FIG. 30, a diameter D1 of the deformable portion 251*b* may be less than a diameter D2 of the lower opening 274.

In some implementations, a reinforcement rib 275 may be provided around a circumference of the lower opening 274 to provide additional structural reinforcement. Structural reinforcement may also be provided through one or more connection ribs 273 that are provided across adjacent ones of the chamber walls 252*d*. The lower support 270 may also include a stepped portion 285 that extends laterally from an upper end of the support body 271.

In some cases, the lower support may include a second extension wall 286 that is stepped and extends from an edge of the stepped portion 285. Thus, a top surface of the second extension wall 286 may be positioned vertically higher than the stepped portion 285.

The first extension part 253 of the lower tray 250 (FIG. 30) may be seated on a top surface 271*a* of the support body 271, and the second extension wall 286 may surround the side surface of the first extension part 253 of the lower tray 250. Here, the second extension wall 286 may contact the side surface of the first extension part 253 of the lower tray 250.

The lower support 270 may further include protrusion grooves 287 that is configured to receive and secure the first lower protrusion 257 of the lower tray 250. Each of the protrusion grooves 287 may have a matching curved shape. The protrusion groove 287 may be defined in the second extension wall 286.

The lower support 270 may further include one or more first coupling grooves 286*a* to which a first coupling member B2 (FIG. 34), which is passed through the first coupling boss 216 of the upper case 210, can be coupled. In some cases, the one or more first coupling grooves 286*a* may be defined in the second extension wall 286.

The plurality of first coupling grooves 286*a* may be arranged to be spaced apart from each other in the direction of the arrow A on the second extension wall 286. A portion of the plurality of first coupling grooves 286*a* may be defined between adjacent ones of the protrusion grooves 287.

In some cases, the lower support 270 may define a boss through-hole 286*b* through which the second coupling boss 217 of the upper case 210 can pass. The boss through-hole 286*b* may be provided, for example, in the second extension wall 286. A sleeve 286*c* that surrounds the second coupling boss 217, which has passed through the boss through-hole 286*b*, may be disposed on the second extension wall 286. The sleeve 286*c* may have a cylindrical shape with an open lower end. A second coupling member B3 may be coupled to the second coupling boss 217 from a lower side of the lower support 270.

The sleeve 286*c* may have a lower end that is disposed at the same height as a lower end of the second coupling boss 217. Alternatively, the lower end of the sleeve 286*c* may be disposed at a height lower than that of the lower end of the second coupling boss 217. Accordingly, when the second coupling member B3 is provided, the head part of the second coupling member B3 may contact bottom surfaces of the second coupling boss 217 and the sleeve 286*c*. Alternatively, the head part may contact a bottom surface of the sleeve 286*c*.

The lower support 270 may further include an outer wall 280 that surrounds the lower tray body 251. The outer wall 280 may be extended downward from an outer perimeter of the second extension wall 286. The lower support 270 may further include a plurality of hinge bodies 281 and 282 that are configured accommodate, respectively, hinge supports 135 and 136 of the upper case 210. The plurality of hinge bodies 281 and 282 may be spaced apart from each other in a direction of the arrow A (FIG. 32). Each of the hinge bodies 281 and 282 may define therein a second hinge hole 281*a*. The shaft connection part 353 of the first link 352 may pass through the second hinge hole 281. The connection shaft 370 may be connected to the shaft connection part 353.

A distance between the plurality of hinge bodies 281 and 282 may be less than a distance between the plurality of hinge supports 135 and 136. Thus, the plurality of hinge bodies 281 and 282 may be disposed between the plurality of hinge supports 135 and 136.

The lower support 270 may further include a coupling shaft 283 to which the second link 356 is rotatably coupled. The coupling shaft 383 may be disposed on each of both surfaces of the outer wall 280.

In some cases, the lower support 270 may include an elastic member coupling part 284 to which the elastic member 360 is coupled. The elastic member coupling part 284 may define a space in which a portion of the elastic member 360 is accommodated. The elastic member coupling part 284 may include a hook part 284*a* to which a lower end of the elastic member 360 can be hooked.

Figure 35:
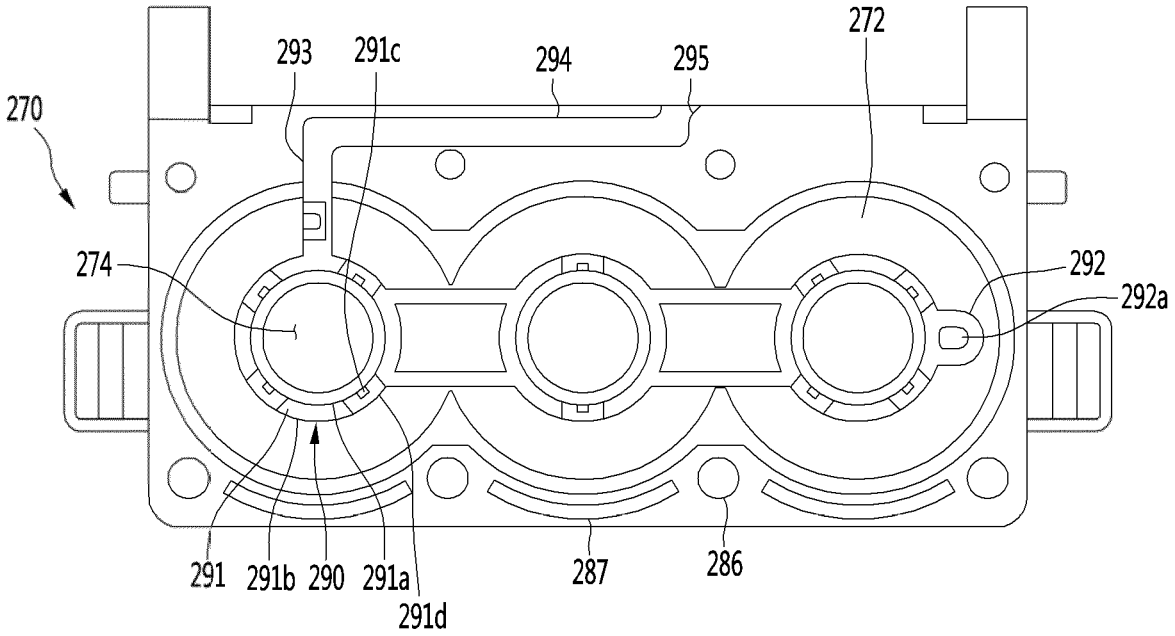
FIG. 35 is a plan view of the lower support.
Figure 37:
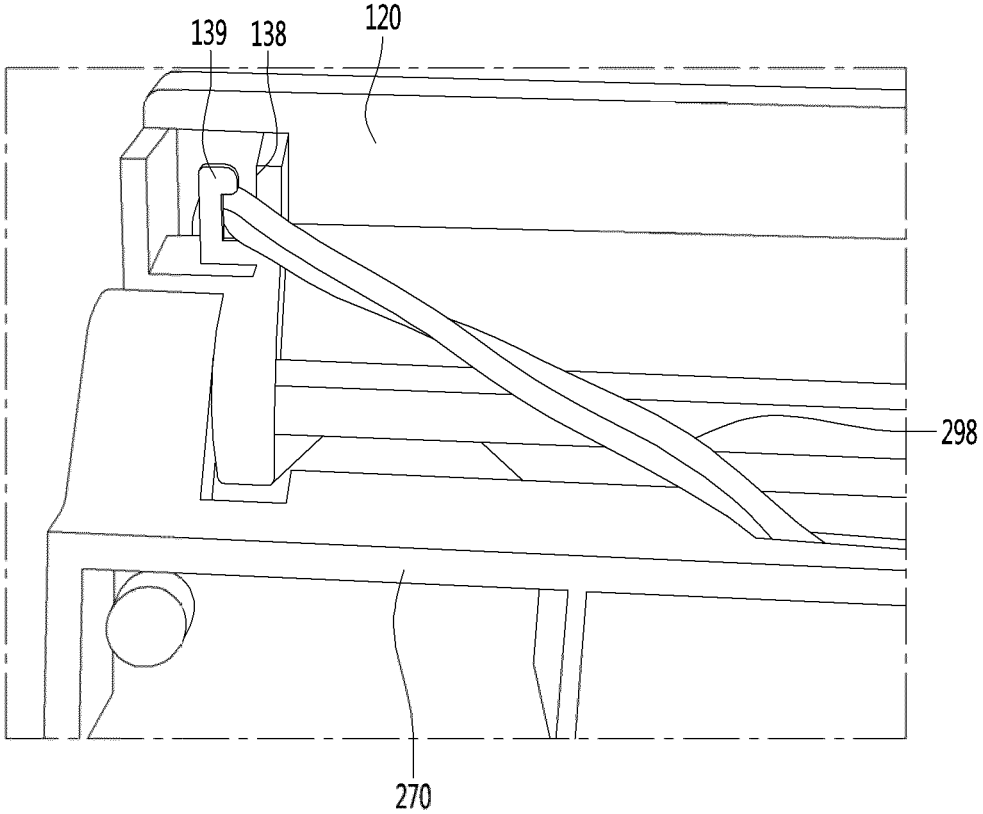
FIG. 37 is a perspective view illustrating example wiring connected to the lower.

Referring to FIGS. 35 to 37, the lower heater 296 may be provided to the lower support 270 in order to provide heat to the lower tray 250 during the ice making process. In particular, the heater 296 may provide heat to the lower chamber 252 during the ice making process to cause the ice within the ice chamber 111 to start freezing from the upper side of the chamber 111. Accordingly, by controlling the propagation of ice formation in this manner, air bubbles within the ice, which can give rise to hazy/opaque ice, may be directed to the bottommost portion of the ice. Thus, a substantial portion of the ice made within the chamber 111 may be transparent. Similar to the upper heater 148, the lower heater 296 may be a flexible wire-type heater, for example a line heater or a heat strip.

The lower heater 296 may be installed on the lower support 270 to make contact with and heat the lower tray 250. For example, the lower heater 296 may contact the lower tray body 251 to thereby provide heat to the lower chamber 252. In particular, the lower heater 296 may be disposed around a circumference of the chamber walls 252*d*.

The lower support 270 may further include a heater coupling part 290 to which the lower heater 296 is coupled. The heater coupling part 290 may include a heater accommodation groove 291 that is recessed from the chamber accommodation part 272 of the lower tray body 251. The heater coupling part 290 may thus include an inner wall 291*a* and an outer wall 291*b*. In some cases, the inner wall 291*a* may have a ring shape, and the outer wall 291*b* may surround the inner wall 291*a*. When the lower heater 296 is accommodated in the heater accommodation groove 291, the lower heater 296 may surround at least a portion of the inner wall 291*a*.

The lower support 270 may define lower openings 274. The lower opening 274 may be defined in a region defined by the inner wall 291*a*. Thus, when the chamber wall 252*d* of the lower tray 250 is accommodated in the chamber accommodation part 272, the chamber wall 252*d* may contact a top surface of the inner wall 291*a*. The top surface of the inner wall 291*a* may be a rounded surface corresponding to the chamber wall 252*d* having the hemispherical shape.

The lower heater may have a diameter greater than a recessed depth of the heater accommodation groove 291 such that a portion of the lower heater 296 protrudes to the outside of the heater accommodation groove 291 in the state in which the lower heater 296 is accommodated in the heater accommodation groove 291. The protruded portion of the lower heater 296 may be pressed into the lower tray body 251 to allow for better heat transfer into the lower tray body 251. In some cases, the lower heater 296 may protrude approximately 0.5 mm above the accommodation groove 291.

In some implementations, a separation prevention protrusion 291*c* may be provided on one or both the outer wall 291*b* and the inner wall 291*a* to help prevent the lower heater 296 accommodated in the heater accommodation groove 291 from being separated from the heater accommodation groove 291.

The lower heater 296 may be accommodated in the heater accommodation groove 291 from an upper side of the outer wall 291*a* toward the inner wall 291*a*. Thus, the separation prevention protrusion 291*c* may be disposed on the inner wall 291*a* to prevent the lower heater 296 from interfering with the separation prevention protrusion 291*c* while the lower heater 296 is accommodated in the heater accommodation groove 291. The separation prevention protrusion 291*c* may protrude from an upper end of the inner wall 291*a* toward the outer wall 291*b*.

In some cases, the separation prevention protrusion 291*c* may extend to half the distance or less of the separation distance between the inner and outer walls 291*a*, 291*b* to allow the heater 296 to be inserted into the groove 291 during assembly but otherwise be prevented from being easily pulled out during use.

As illustrated in FIG. 36, when the lower heater 296 is accommodated in the heater accommodation groove 291, the lower heater 296 may be classified into a rounded portion 296*a* and a linear portion 296*b*. For example, the lower heater 296 may be divided into the rounded portion 296*a* and the linear portion 296*b* to correspond to the rounded portion and the linear portion of the heater accommodation groove 296. The rounded portion 296*a* may be disposed along the circumference of the lower chamber 252. The linear portion 296*b* may be used to connect the rounded portions 296*a* to each other.

As seen in FIG. 35, a through-opening 291*d* may be defined t a bottom surface of the heater accommodation groove 291. Thus, when the lower heater 296 is accommodated in the heater accommodation groove 291, a portion of the lower heater 296 may be accommodated in the through-opening 291*d*. For example, the through-opening 291*d* may be defined in a portion of the lower heater 296 facing the separation prevention protrusion 291*c*.

When the lower heater 296 is bent, increased tension may be applied to the lower heater 296, thus causing the heater from being disconnected and/or separated from the heater accommodation groove 291. However, a portion of the lower heater 296 may be disposed in the through-opening 291*d* to reduce tension on the lower heater 296, thereby preventing the heater accommodation groove 291 from being separated from the lower heater 296.

The lower support 270 may include a first guide groove 293 that guides a power input terminal 296*c* and a power output terminal of the lower heater 296 accommodated in the heater accommodation groove 291. The lower support 270 may also include a second guide groove 294 that extends in a transverse direction to the first guide groove 293. For example, the first guide groove 293 may extend in a direction of an arrow B (FIG. 36) in the heater accommodation part 291.

In some cases, the second guide groove 294 may extend from an end of the first guide groove 293 in a direction of an arrow A (FIG. 36). In some cases, the direction of the arrow A may be parallel to the rotational central axis C1.

In some implementations, as seen in FIG. 36, the first guide groove 293 may extend from one of the left and right chamber accommodation. For example, the first guide groove 293 may extend from the leftmost chamber accommodation part among the three chamber accommodation parts.

In some implementations, the power input terminal 296*c* and the power output terminal 296*d* of the lower heater 296 may be connected to a first connector 297*a*. Additionally, a second connector 297*b* to which two wires 298 corresponding to the power input terminal 296*c* and the power output terminal 296*d* are connected may be connected to the first connector 297*a*. When the first connector 297*a* and the second connector 297*b* are connected to each other, the first connector 297*a* and the second connector 297*b* may be accommodated in the second guide groove 294.

The wire 298 connected to the second connector 297*b* may be led out from the end of the second guide groove 294 to the outside of the lower support 270 through an lead-out slot 295 defined in the lower support 270.

In some cases, different amount of heat may need to be provided to the individual lower chambers 252 to achieve a uniform temperature across the multiple chambers. For example, because the outer chambers may be exposed to more cold air than the middle chambers, more heat may need to be provided to the outer chambers to achieve uniform temperature across all the chambers. As another example, because some heat may be generated by the power input terminal 296*c* and the power output terminal 296*d*, a chamber that is closest to these terminals, for example, may experience an increased temperature compared to the remaining chambers. Non-uniform heat provided across the chambers may lead to different levels of transparency for the ice generated within those chambers.

Accordingly, in some implementations, additional heater grooves 292 may be provided around the chamber accommodation portion 272 to help achieve uniform heat distribution. For example, as seen in FIGS. 35 and 36, the additional heater groove 292 may extend outward from the main heater accommodation groove 291. Accordingly, because a contact area between the chamber accommodation part 272 and the lower heater 296 may increase in the region of the additional heater groove 292, the amount of heat provided to that region may correspondingly increase. That is, the additional heater groove 292 helps provide a heater extension part 296*e* for providing additional heat to a specific region of the lower tray body 251.

In some cases, a protrusion 292*a* may be provided in conjunction with the additional heater groove 292 to help secure the heater extension part 296*e*. While the implementation shown in FIG. 36 showed one possible location of the additional heater groove 292 and the corresponding heater extension part 296*e*, the heater extension apart 296*e* may be similarly provided to other locations around the lower tray 251 as needed. The upper heater 148, as seen in FIG. 20, may be similarly configured to provided additional heating to different portions of the upper tray 150.

In some cases, as seen in FIG. 37, the wire 298 that is led out of the lower support 270 may pass through a wire through-slot 138 defined in the upper case 120 to extend upward from the upper case 120. A restriction guide 139 that is configured restrict the movement of the wire 298 passing through the wire through-slot 138 may be provided in the wire through-slot 138. The restriction guide 139 may include several bends to thereby confine the wire 298 within the restriction guide 139.

Figure 38:
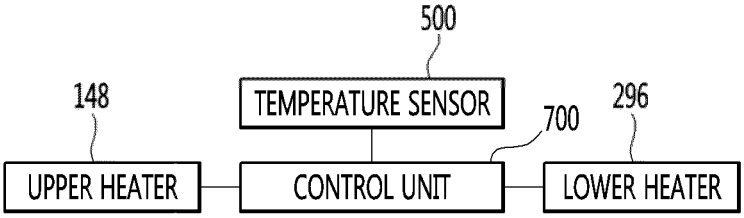
FIG. 38 is an example block diagram of the refrigerator.

Referring to FIG. 38, the refrigerator may include a control unit 700 for controlling the upper heater 148 and the lower heater 296. For example, the control unit 700 may adjust an output of the lower heater 296 during the ice making process.

Figure 39:
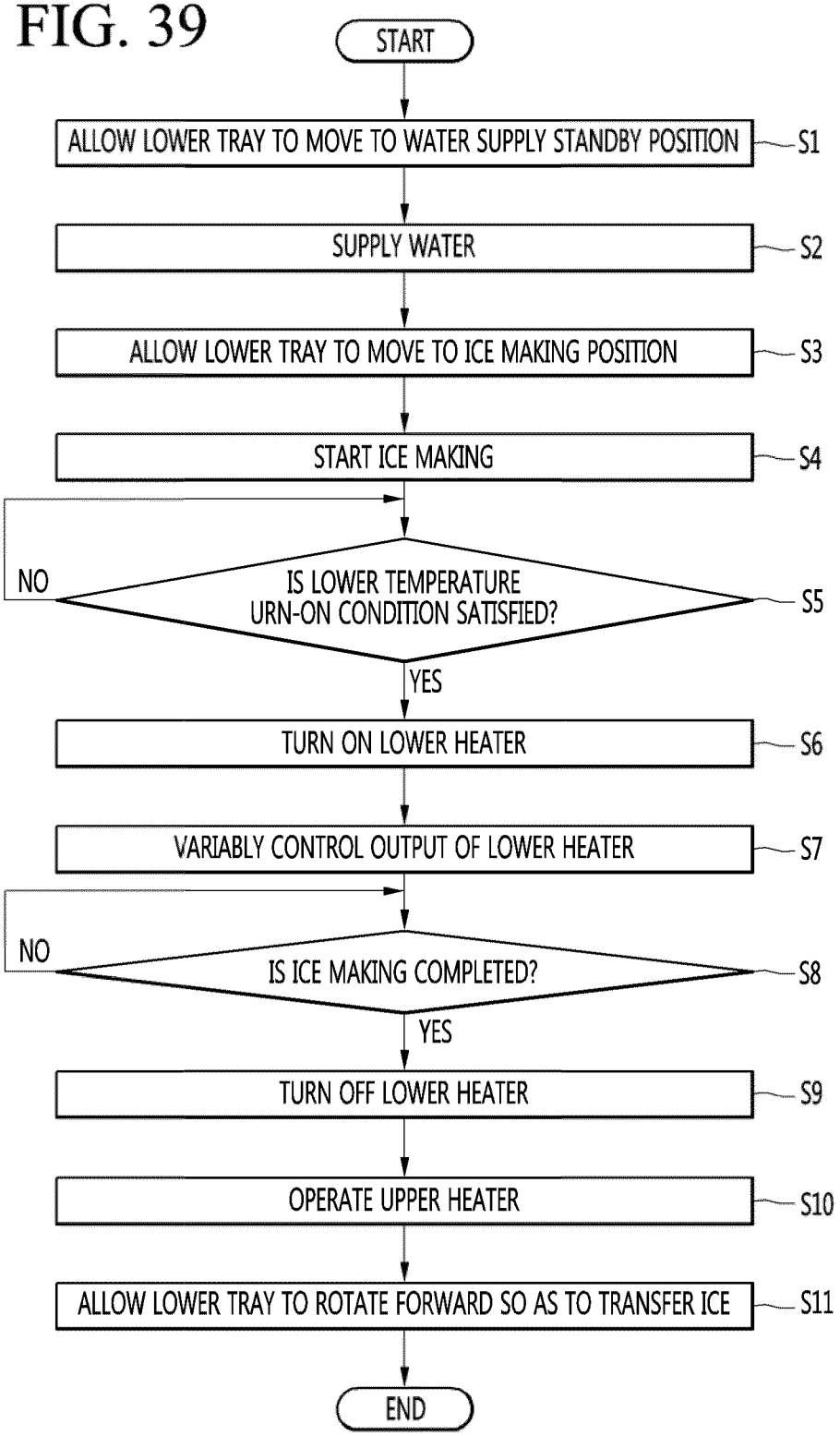
FIG. 39 is a flowchart of an example process of making ice in the ice maker.

Referring to FIG. 39, an example process flow for generating ice using the ice maker 100 is shown.

Initially, the lower assembly 200 may move to a water supply position (S1). As explained above with respect to FIG. 5, top surface 251*e* of the lower tray 250 may be spaced apart from the bottom surface 151*e* of the upper tray 150. The driving unit 180 may have rotated the lower assembly 200 in either direction to arrive at this stage. In some cases, the bottom surface 151*e* of the upper tray 150 may be disposed at a height that is equal to that of the rotation axis C1 of the lower assembly 200.

In this state, the angle between the top surface 251*e* of the lower tray 250 and the bottom surface 151*e* of the upper tray 150 at the water supply standby position of the lower assembly 200 may be approximately 8 degrees.

The supplying of water may be started in (S2). For example, water flows to the water supply part 190 through a water supply tube connected to an external water supply source or a water tank of the refrigerator 1. Subsequently, the water is guided by the water supply part 190 and supplied to the ice chamber 111. Here, the water is supplied to the ice chamber 111 through one of the upper tray openings 154, namely water receiving hole 112, of the upper tray 150.

As described above, since the top surface 251*e* of the lower tray 250 and the bottom surface 151*e* of the upper tray 150 are spaced apart from each other at this state, water that is supplied to just one of the chambers may overflow and flow into the remaining chambers as well.

Thus, the water may be fully filled in each of the plurality of lower chambers 252 of the lower tray 250.

Upon completion of the water supply stage, the lower assembly 200 is rotated toward the upper assembly 110 to the ice making position (S3). Due to this upward movement of the lower assembly 200, additional volume of water contained by the retaining wall 260 is directed into the upper chambers 152. An over-rotation of the driving unit 180 may take place at this stage to further press the lower tray 250 into the upper tray 150, thereby helping to eliminate gaps between the two trays.

Water within the chambers is allowed to freeze during the ice making process (S4).

After the ice making is started, the control unit 700 determines whether a turn-on condition of the lower heater 296 is satisfied (S5). That is, by way of example, the lower heater 296 may be turned on only when the turn-on condition of the lower heater 296 is satisfied.

Specifically, the lower heater 296 may not be turned on until the water starts to phase-change into ice. Otherwise, if the lower heater 296 is turned on before reaching the freezing point of the water in the ice chamber 111, a rate at which the temperature of the water reaches the freezing point may be lowered by the heat of the lower heater 296, resulting in a reduced ice making rate.

The control unit 700 may determine when the turn-on condition of the lower heater 296 is satisfied by determining when a temperature detected by the temperature sensor 500 reaches a turn-on reference temperature. For example, the turn-on reference temperature may be a temperature at which the freezing of water starts at the uppermost side (an inflow opening side) of the ice chamber 111.

In this implementation, since the ice chamber 111 is blocked by the upper tray 150 and the lower tray 250 except for the inflow opening 154, the water in the ice chamber 111 may directly contact the cold air through the inflow opening 154 to make ice from the uppermost side in which the inflow opening is disposed in the ice chamber 111.

When water is frozen in the ice chamber 111, a temperature of the ice in the ice chamber 111 may be below zero. Also, the temperature of the upper tray 150 may be higher than that of the ice in the ice chamber 111.

In some implementations, the temperature sensor 500 may detect the temperature of the upper tray 150 by contacting the upper tray 150 without directly detecting the temperature of the ice. According to the above-described arranged structure, to determine that making of ice is started in the ice chamber 111 on the basis of the temperature detected by the temperature sensor 500, the turn-on reference temperature may be set to the below-zero temperature.

That is, when the temperature detected by the temperature sensor 500 reaches the turn-on reference temperature, which is below zero, and the temperature of the ice in the ice chamber 111 is lower than the turn-on reference temperature, it may be indirectly determined that the ice has formed in the ice chamber 111.

When the lower heater 296 is turned on, heat of the lower heater 296 is transferred to the lower tray 250 (S6).

Thus, when the ice making is performed in the state where the lower heater 296 is turned on, ice may be made from the upper side in the ice chamber 111 because the heat is supplied to the lower chamber 252 through the water contained in the lower chamber 252.

When the ice starts to form from the upper side of the ice chamber 111, the bubbles in the ice chamber 111 may move downward. That is, because a density of water is greater than that of ice, the bubbles in the water may easily move downward to be gathered downward.

When the ice chamber 111 has a spherical shape, the horizontal cross-sectional area for each height of the ice chambers 111 are different from each other. Then, assuming that the same amount of cold air is supplied to the ice chamber 111, if the output of the lower heater 296 is the same, the horizontal cross-sectional area for each height of the ice chambers 111 may be different from each other, and thus, ice may be made at heights different from each other. That is to say, the height at which ice is made per unit time may be non-uniform. In this case, the bubbles in the water may not be properly moved downward and instead become trapped in the ice so that the ice becomes opaque.

Accordingly, the control unit 700 may control the output of the lower heater 296 according to the height of the ice made in the ice chamber 111 (S7).

In particular, the horizontal cross-sectional area of the ice increases from the upper side to the lower side of the upper chamber 152, is maximized at a boundary between the upper tray 150 and the lower tray 250, and decreases again to the lower side of the lower chamber 252. The control unit 700 may thus allow the output of the lower heater 296 to vary in response to a variation in horizontal cross-sectional area according to the height.

The control unit 700 may determine whether the ice making is completed based on the temperature sensed by the temperature sensor 500 (S8). When it is determined that the ice making is completed, the control unit 700 may turn off the lower heater 296 (S9).

In some implementations, the distance between the temperature sensor 500 and each of the ice chambers 111 may be different from each other. Thus, to determine that the making of ice is completed in all the ice chambers 111, ice ejection may be started after a certain time elapses from a time point at which it is determined that the ice making is completed.

When the ice making is completed, to eject the ice, the control unit 700 may operate the upper heater 148 (S10).

When the upper heater 148 is turned on, the heat of the upper heater 148 is transferred to the upper tray 150, and thus, the ice may be separated from the surface (the inner surface) of the upper tray 150. The heat of the upper heater 148 may also be transferred to the contact surface between the upper tray 150 and the lower tray 250 to help separate the bottom surface 151*a* of the upper tray 150 and the top surface 251*e* of the lower tray 250 from each other.

After the upper heater 148 has operated for a set time, the control unit 700 may turn off the upper heater 148. Also, the driving unit 180 may be operated at this time so that the lower assembly 200 is rotated away from the upper assembly 110 to the ice ejection position (S11).

Referring to FIGS. 40A, 40B, 41, and 42, the controlled variation of the power output of the lower heater 296 in response to variations in the horizontal cross-sections of the ice piece is illustrated.

Figure 40A:
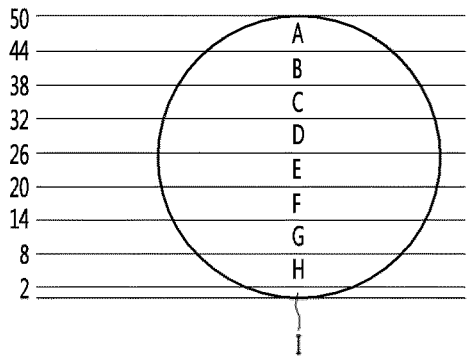
FIG. 40A is a schematic diagram illustrating example reference intervals for a spherical ice piece.

In particular, when the ice chamber is divided into the reference intervals, as shown in FIG. 40A, the heights of each of the sections A to H may be the same. Because of the deformable portion 251*b* at the bottom of the ice chamber, the height of the section I may be less than the other sections. Alternatively, all the divided sections may have the same height.

In the example of FIG. 40A, since section E has the largest diameter, it represents the maximum section volume. Thus, assuming generally uniform cooling conditions, the ice making rate in section E may be the slowest, with the rates in the smallest sections A and I being the fastest. Due to the varying ice making rates across the sections, transparency of the ice in each section—which is dictated by the presence of trapped air bubbles—may also vary across the sections. Some sections, for example, may freeze too quickly before allowing the air bubbles to escape.

By controlling the output of the lower heater 296, the freezing rate and direction may be controlled such that the air bubbles move downward toward the lowermost portion of the ice chamber 111 during the ice making process.

Figure 40B:
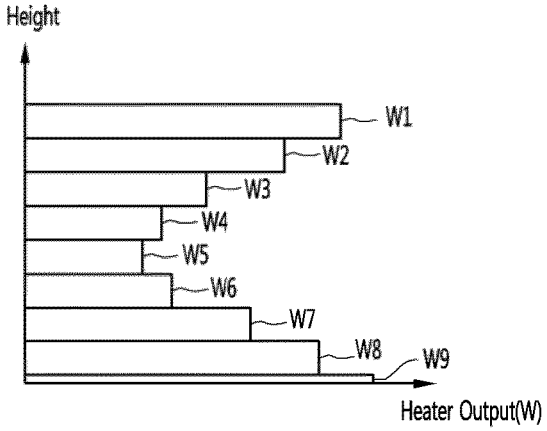
FIG. 40B is a graph illustrating sample heater outputs corresponding to the reference intervals of FIG. 40A.

For example, as shown in FIG. 40B, an output W5 of the lower heater 296 corresponding to the section E may be set to a minimum value to maximize the amount of cooling to that relatively large region.

Because the relatively smaller volume of water in section D may freeze quicker than section E, air bubbles may become trapped in section D. Accordingly, in order to delay the ice making rate in section D, a corresponding output W4 may be set to a value greater than the output W5 of the lower heater 296 in the section E. Thus, section D may be prevented from becoming frozen before section E.

By the same rationale, output W3 corresponding to section C, output W2 according to section B, and output W1 corresponding to section A may be increasingly greater.

To prevent the water in section F from freezing before section E, which would cause air bubbles in section E to become trapped, an output W6 of the lower heater 296 that corresponds to Section F may be greater than output W5. Similarly, output W7 may be greater than output W6, and output W8 may be greater still than output W7. Output W9 corresponding to section I, which has the smallest volume of water and thus susceptible to freezing the quickest, can thus be the largest.

Figure 42:
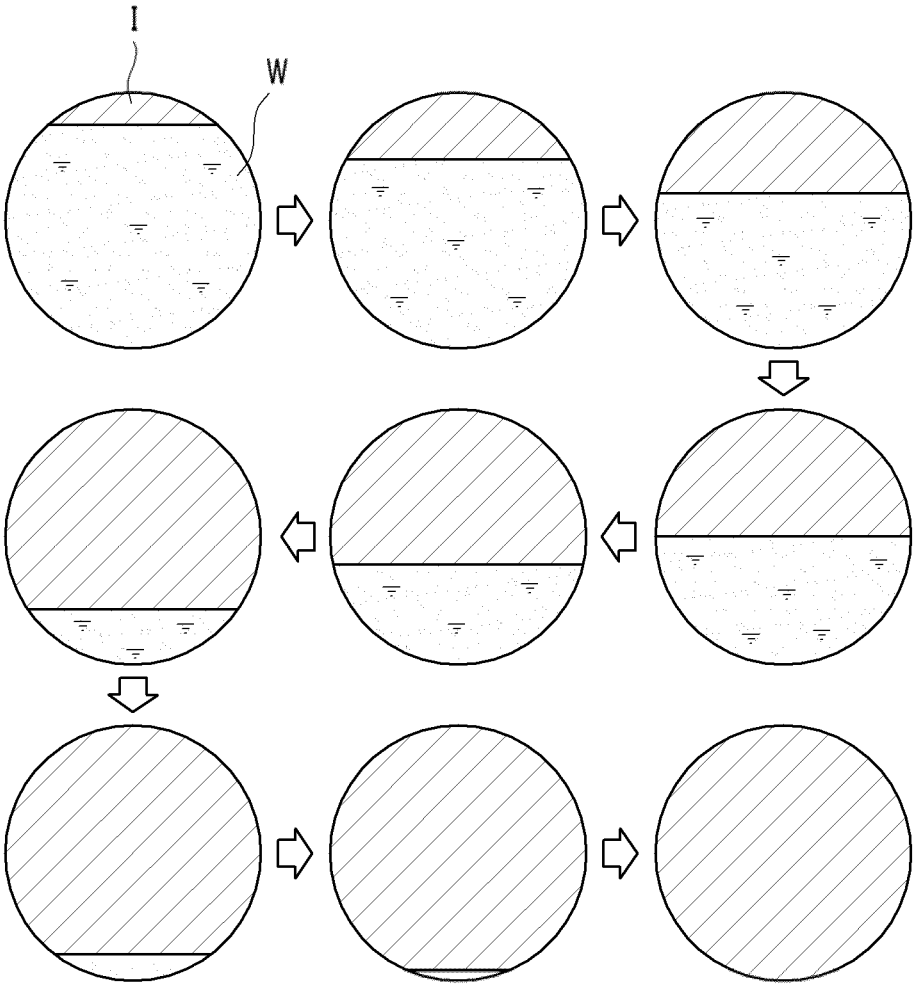
FIG. 42 is a sequential view illustrating an example progression of ice across the reference intervals of FIG. 40A.

Further referring to FIG. 42, by adjusting the power output of the lower heater 296 in the manner described above, water W within the chamber 111 can be made to freeze starting at the top such that ice I first forms at the top of the chamber and then gradually propagates toward the bottom, in the process driving the air bubbles downward.

Figure 41:
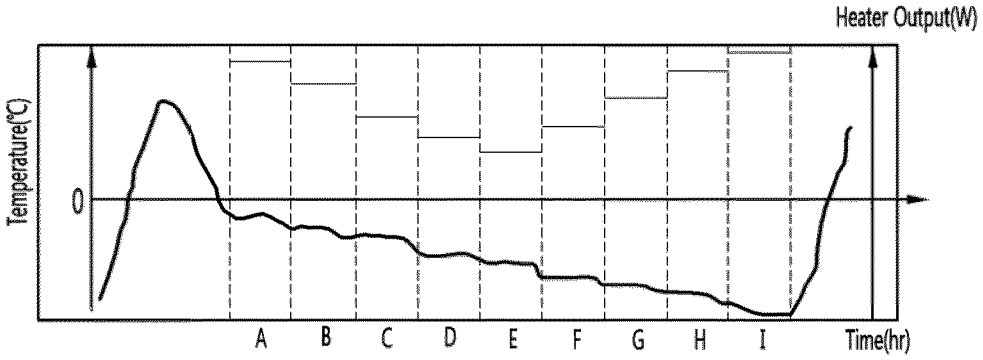
FIG. 41 is a graph illustrating an example relationship between temperature detected by a temperature sensor and a corresponding output of the lower heater during the water supply and ice making processes.

Referring to FIG. 41, the temperature detected by the temperature sensor 500 may generally decrease as a greater portion of the ice chamber 111 freezes. By storing such temperature patterns in a memory, the controller 700 can use these temperatures as reference temperatures to help determine the progress of ice propagation and to apply the corresponding amount of heat.

For example, when the temperature detected by the temperature sensor 500 reaches the reference temperature of the next section in the present section, the control unit 700 adjusts an output of the lower heater 296 corresponding to the present section to match to an output corresponding to the next section.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An ice maker comprising:

a first assembly comprising a first mold that defines a first chamber recessed in a first direction; and a second assembly comprising (i) a second mold that is made of a flexible material and defines a second chamber recessed in a second direction and (ii) a support that supports the second mold, wherein the second assembly is configured to move relative to the first assembly between (i) an open position in which the first mold and the second mold are spaced apart from each other and (ii) a closed position in which the first mold and the second mold are in contact with each other, wherein the first chamber and the second chamber are configured to, in the closed position, define an ice chamber for making ice, and the second direction is opposite to the first direction in the closed position, wherein the support comprises a chamber accommodation portion that is recessed in the second direction and that is configured to accommodate and detachably support at least a portion of the second mold, and wherein at least another portion of the second mold is fixed to the support.

2. The ice maker of claim 1, wherein the second mold comprises:

a mold body that defines the second chamber; and an extension part extending from a circumference of the mold body in a third direction intersecting the second direction, and wherein at least a portion of the mold body is accommodated in the chamber accommodation portion, and is detachably supported by the chamber accommodation portion, and the extension part is fixedly coupled to the support by contacting one surface of the support.

3. The ice maker of claim 2, further comprising an ejector configured to separate ice from the ice chamber, wherein the chamber accommodation portion defines an opening through which a portion of the mold body is exposed based on the at least a portion of the mold body being accommodated in the chamber accommodation portion, and wherein, in the open position, the ejector penetrates the opening to separate at least a portion of the mold body from the chamber accommodation portion to thereby separate ice from the second chamber.

4. The ice maker of claim 3, wherein, in the closed position, a first contact surface of the first mold and a second contact surface of the second mold is contact with each other, wherein the first contact surface defines an edge of the first chamber, and the second contact surface defines an edge of the second chamber, and wherein, in the open position, at least a portion of the mold body is positioned on a same plane as the second contact surface.

5. The ice maker of claim 2, wherein the extension part comprises:

a first extension part extending from an edge of the mold body in the third direction; and a second extension part extending further in the third direction and defining a step from the first extension part.

6. The ice maker of claim 1, wherein the second assembly further comprises:

a case configured to fix the second mold.

7. The ice maker of claim 6, wherein the case configured to surround a circumference of the second mold.

8. The ice maker of claim 6, wherein the case comprises:

a plate to which the second mold is fixed; and a plurality of bosses protruding from the plate in the second direction.

9. The ice maker of claim 8, wherein the second mold comprises:

a mold body defining the second chamber; and an extension part extending from a circumference of the mold body in a third direction intersecting the second direction, the extension part defining a plurality of through-holes, and wherein the plurality of bosses pass through the plurality of through-holes, respectively.

10. The ice maker of claim 9, wherein the extension part comprises:

a first extension part extending from an edge of the mold body in the third direction; and a second extension part extending further in the third direction and defining a step from the first extension part, and wherein the plurality of through-holes are defined in the second extension part.

11. The ice maker of claim 9, wherein the support comprises a plurality of coupling part configured to allow the plurality of bosses to be fixed to the support through the plurality of through-holes.

12. The ice maker of claim 11, further comprising:

a plurality of coupling members that penetrate the plurality of coupling part or the plurality of bosses, or that are fastened to the plurality of coupling part or the plurality of bosses.

13. The ice maker of claim 12, wherein the plurality of coupling members comprises a first coupling member and a second coupling member, wherein the plurality of bosses comprises a first boss, and a second boss spaced apart from the first boss, wherein the plurality of coupling part comprises a boss through-hole, a coupling groove spaced apart from the boss through-hole, and a sleeve disposed at a position which corresponds to a position of the boss through-hole, wherein the first coupling member penetrates through the first boss, and is fastened to the coupling groove, and wherein the second coupling member penetrates through the sleeve and the boss through-hole and is fastened to the second boss.

14. The ice maker of claim 1, wherein the first assembly is an upper assembly, and the second assembly is a lower assembly disposed below the upper assembly in the closed position, and wherein the lower assembly is configured to rotate with respect to the upper assembly.

15. A refrigerator comprising:

a cabinet defining a storage space; and an ice maker provided in the storage space, wherein the ice maker comprises:

a first assembly comprising a first mold that defines a first chamber recessed in a first direction, and a second assembly comprising (i) a second mold that is made of a flexible material and defines a second chamber recessed in a second direction and (ii) a support that supports the second mold, wherein the second assembly is configured to move relative to the first assembly between (i) an open position in which the first mold and the second mold are spaced apart from each other and (ii) a closed position in which the first mold and the second mold are in contact with each other, wherein the first chamber and the second chamber are configured to, in the closed position, define an ice chamber for making ice, and the second direction is opposite to the first direction in the closed position, wherein the support comprises a chamber accommodation portion that is recessed in the second direction and that is configured to accommodate and detachably support at least a portion of the second mold, and wherein at least another portion of the second mold is fixed to the support.

16. The refrigerator of claim 15, wherein the second mold comprises:

a mold body that defines the second chamber; and an extension part extending from a circumference of the mold body in a third direction intersecting the second direction, and wherein at least a portion of the mold body is accommodated in the chamber accommodation portion, and is detachably supported by the chamber accommodation portion, and the extension part is fixedly coupled to the support by contacting one surface of the support.

17. The refrigerator of claim 16, wherein the ice maker further comprises an ejector configured to separate ice from the ice chamber, wherein the chamber accommodation portion defines an opening through which a portion of the mold body is exposed based on the at least a portion of the mold body being accommodated in the chamber accommodation portion, and wherein, in the open position, the ejector penetrates the opening to separate at least a portion of the mold body from the chamber accommodation portion to thereby separate ice from the second chamber.

18. The refrigerator of claim 17, wherein, in the closed position, a first contact surface of the first mold and a second contact surface of the second mold is contact with each other, wherein the first contact surface defines an edge of the first chamber, and the second contact surface defines an edge of the second chamber, and wherein, in the open position, at least a portion of the mold body is positioned on a same plane as the second contact surface.

19. The refrigerator of claim 15, wherein the second assembly further comprises a case configured to fix the second mold.

20. The refrigerator of claim 19, wherein the case comprises a plate to which the second mold is fixed, and a plurality of bosses protruding from the plate in the second direction, wherein the second mold comprises a mold body defining the second chamber, and an extension part extending from a circumference of the mold body in a third direction intersecting the second direction, the extension part defining wherein a plurality of through-holes, wherein the plurality of bosses pass through the plurality of through-holes, respectively, wherein the support comprises a plurality of coupling part configured to allow the plurality of bosses to be fixed to the support through the plurality of through-holes, and wherein the ice maker further comprises a plurality of coupling members that penetrate the plurality of coupling part or the plurality of bosses, or that are fastened to the plurality of coupling part or the plurality of bosses.

* * * * *